US007995085B2

(12) United States Patent
Nomura

(10) Patent No.: US 7,995,085 B2
(45) **Date of Patent: *Aug. 9, 2011**

(54) LINE HEAD, AND AN IMAGE FORMING APPARATUS USING THE LINE HEAD

(75) Inventor: Yujiro Nomura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 148 days.

This patent is subject to a terminal disclaimer.

(21) Appl. No.: 12/139,284

(22) Filed: Jun. 13, 2008

(65) Prior Publication Data

US 2009/0009580 A1 Jan. 8, 2009

(30) Foreign Application Priority Data

Jul. 4, 2007 (JP) ..... 2007-175857
Mar. 12, 2008 (JP) ..... 2008-062695

(51) Int. Cl.
*B41J 2/45* (2006.01)

(52) U.S. Cl. ..... 347/238

(58) Field of Classification Search ..... 347/236, 347/238, 241, 244, 256, 258
See application file for complete search history.

(56) References Cited

U.S. PATENT DOCUMENTS 4,318,597 A * 3/1982 Kotani et al. ..... 396/549
4,435,064 A * 3/1984 Tsukada et al. ..... 355/1
5,260,718 A * 11/1993 Rommelmann et al. ..... 347/136
5,808,718 A 9/1998 Aikoh et al.
6,456,313 B1 * 9/2002 Hiyoshi ..... 347/238
7,242,419 B2 * 7/2007 Ohkubo ..... 347/236
7,327,377 B2 * 2/2008 Matsumoto ..... 347/238
2004/0046978 A1 3/2004 Stevens ..... 358/1.8
2005/0093963 A1 * 5/2005 Masuda ..... 347/236
2009/0041504 A1 * 2/2009 Yamaguchi et al. ..... 399/220

FOREIGN PATENT DOCUMENTS

JP 60015622 A * 1/1985
JP 0 348 003 A2 12/1989
JP 02-004546 1/1990
JP 2000158705 A * 6/2000
JP 2001-358411 12/2001
JP 2002-144627 5/2002
JP 2002-222988 8/2002
JP 2002-248803 9/2002
JP 2002-314191 10/2002
JP 2003-347581 12/2003

* cited by examiner

*Primary Examiner* — Hai C Pham

(74) *Attorney, Agent, or Firm* — DLA Piper LLP (US)

(57) ABSTRACT

A line head, includes: a plurality of first substrates each of which includes a plurality of light emitting elements which emit light beams, a second substrate to which the plurality of first substrates are bonded, and an optical system which includes a plurality of lenses which focus light beams emitted from the plurality of light emitting elements toward an image plane, and in which a plurality of lenses face each of the plurality of first substrates.

13 Claims, 43 Drawing Sheets

INTERRELATION OF SPOTS FORMED ON PHOTOSENSITIVE MEMBER SURFACE (TURN ON SIMULTANEOUSLY)

STEP OF FORMING ONE LINE LATENT IMAGE
(EMISSION TIMING IS ADJUSTED)

INTERRELATION OF SPOTS FORMED ON PHOTOSENSITIVE MEMBER SURFACE (TURN ON SIMULTANEOUSLY)

STEP OF FORMING ONE LINE LATENT IMAGE
(EMISSION TIMING IS ADJUSTED)

FIG. 17A : ABSENCE OF CHARACTERISTIC DEVIATION OF MICROLENSES
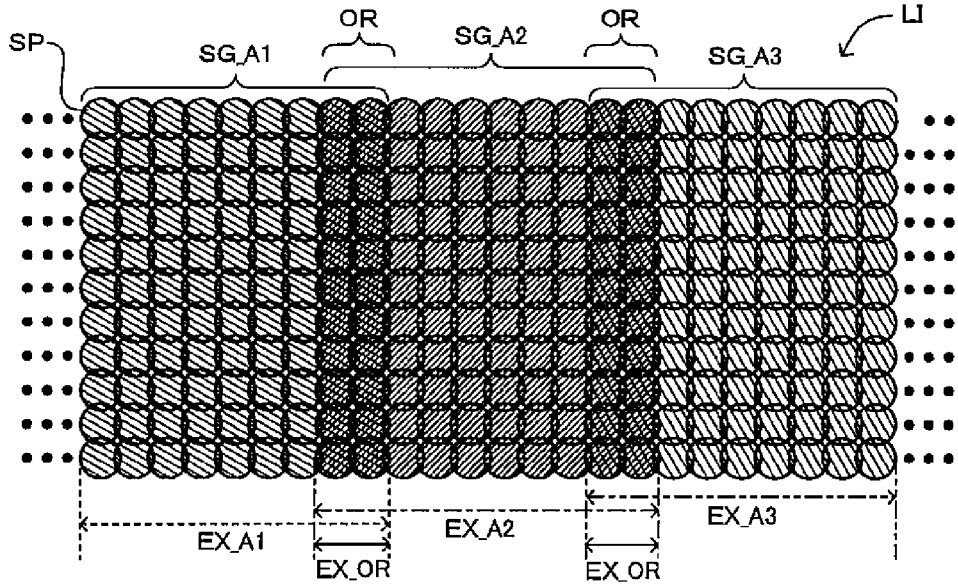
FIG. 17B : OCCURRENCE OF CHARACTERISTIC DEVIATION OF MICROLENSES
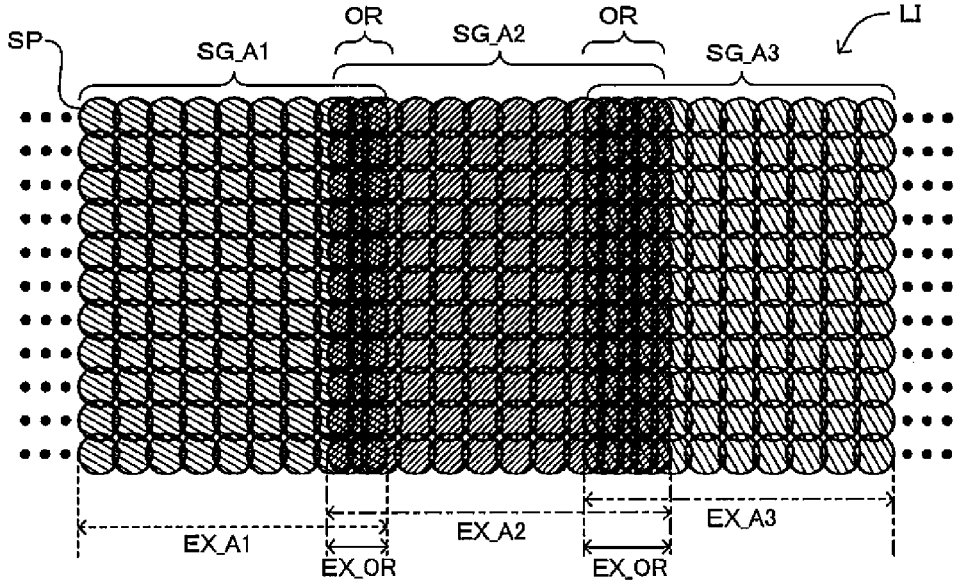
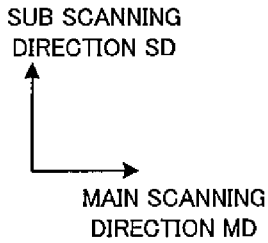

ABSENCE OF POSITIONAL DEVIATION OF EXPOSURE REGIONS

POSITIONAL DEVIATION OF EXPOSURE REGIONS 0.7・Psp

POSITIONAL DEVIATION OF EXPOSURE REGIONS 1.4・Psp

INTERRELATION OF SPOTS FORMED ON PHOTOSENSITIVE MEMBER SURFACE (TURN ON SIMULTANEOUSLY)

INTERRELATION OF SPOTS FORMED ON PHOTOSENSITIVE MEMBER SURFACE (TURN ON SIMULTANEOUSLY)

INTERRELATION OF SPOTS FORMED ON PHOTOSENSITIVE MEMBER SURFACE (TURN ON SIMULTANEOUSLY)

ABSENCE OF POSITIONAL DEVIATION

POSITIONAL DEVIATION 0.4 · Psp_in

POSITIONAL DEVIATION 0.7 · Psp_in

POSITIONAL DEVIATION 1.4 · Psp _in

POSITIONAL DEVIATION 1.7・Psp_in

FIG. 43A : OPTICAL DATA

| ITEM | SYMBOL | VALUE |
|---|---|---|
| WAVELENGTH | $\lambda$ | 750 nm |
| LENS DIAMETER | D | 0.757 mm |
| APERTURE DIAMETER | Da | 0.212 mm |
| OPTICAL MAGNIFICATION | $\beta$ | −1 |
| MAXIMUM ANGLE OF VIEW | $\omega$ | 9.8° |

FIG. 43B : LENS DATA

UNIT:mm

| SURFACE NUMBER | SURFACE TYPE | CURVATURE RADIUS | SURFACE INTERVAL | REFRACTIVE INDEX |
|---|---|---|---|---|
| S1 (OBJECT PLANE) | | ∞ | 1.1371 | |
| S2 (APERTURE PLANE) | | ∞ | 0.7508 | |
| S3 | ASPHERIC | 1.6831 | 2.0000 | $n_d$=1.5311, $\nu_d$=56 |
| S4 | ASPHERIC | −0.6107 | 1.0000 | |
| S5 (IMAGE PLANE) | | ∞ | 0 | |

FIG. 43C : ASPHERICAL COEFFICIENT

| SURFACE NUMBER | CURV | K | A |
|---|---|---|---|
| S3 | 0.59415 | −1.72823 | −0.0936012 |
| S4 | −1.63754 | 3.23411 | 0.76859 |

FIG. 43D : ASPHERICAL SURFACE DEFINITIONAL EQUATION $$Z=(CURV)h^2/[1+\sqrt{1-(1+K)(CURV)^2h^2}]+(A)h^4$$

WHERE
Z : SAGITTA OF PLANE PARALLEL TO AXIS Z
CURV : CURVATURE AT APEX OF THE SURFACE
K : CONIC COEFFICIENT
A : DEFORMING COEFFICIENT OF FOURTH ORDER $h^2=x^2+y^2$
x : COORDINATE OF X AXIS (MAIN SCANNING DIRECTION)
y : COORDINATE OF Y AXIS (SUB SCANNING DIRECTION)

LINE HEAD, AND AN IMAGE FORMING APPARATUS USING THE LINE HEAD

CROSS REFERENCE TO RELATED APPLICATION

The disclosure of Japanese Patent Applications No. 2007-175857 filed on Jul. 4, 2007 and No. 2008-062695 filed on Mar. 12, 2008 including specification, drawings and claims is incorporated herein by reference in its entirety.

BACKGROUND

1. Technical Field

The invention relates to a line head which exposes an image plane with a light beam and an image forming apparatus using the line head.

2. Related Art

There has been conventionally known a line head which focuses light beams emitted from light emitting elements toward an image plane to expose the image plane. JP-A-2-4546 proposes a line head using LEDs (light emitting diodes) as light emitting elements. This line head disclosed in JP-A-2-4546 includes a plurality of LED array chips formed with LEDs, and an image plane is exposed with light beams emitted from the LEDs of the respective LED array chips. In other words, the respective plurality of LED array chips expose areas of the image plane corresponding thereto.

SUMMARY

In the above line head, the plurality of LED array chips (chips) are arranged on a substrate using bonding technology such as die bonding. Accordingly, the plurality of chips need to be bonded to the substrate upon assembling the line head. Therefore, it is preferable that a number of bonding chips is small in light of reducing time and cost required for assembling.

An advantage of some aspects of the invention is to provide technology capable of reducing time and cost required for assembling a line head by suppressing the number of bonding chips upon assembling a line head.

According to a first aspect of the invention, there is provided a line head, comprising: a plurality of first substrates each of which includes a plurality of light emitting elements which emit light beams, a second substrate to which the plurality of first substrates are bonded, and an optical system which includes a plurality of lenses which focus light beams emitted from the plurality of light emitting elements toward an image plane, and in which a plurality of lenses face each of the plurality of first substrates.

According to a second aspect of the invention, there is provided an image forming apparatus, comprising: a latent image carrier on a surface of which a latent image is formed in an exposed part when the surface is exposed with a light, and a line head which includes a plurality of first substrates each of which includes a plurality of light emitting elements which emit light beams, a second substrate to which the plurality of first substrates are bonded, and an optical system which includes a plurality of lenses which focus light beams emitted from the plurality of light emitting elements toward the latent image carrier surface, and in which a plurality of lenses face each of the plurality of first substrates.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 17 is a diagram showing a two-dimensional latent image obtained in the case of forming the overlapping spot regions in the overlapping exposure regions.

FIGS. 43A to 43D show lens data of the microlenses in the example.

DESCRIPTION OF EXEMPLARY EMBODIMENTS

First Embodiment

Figure 1:
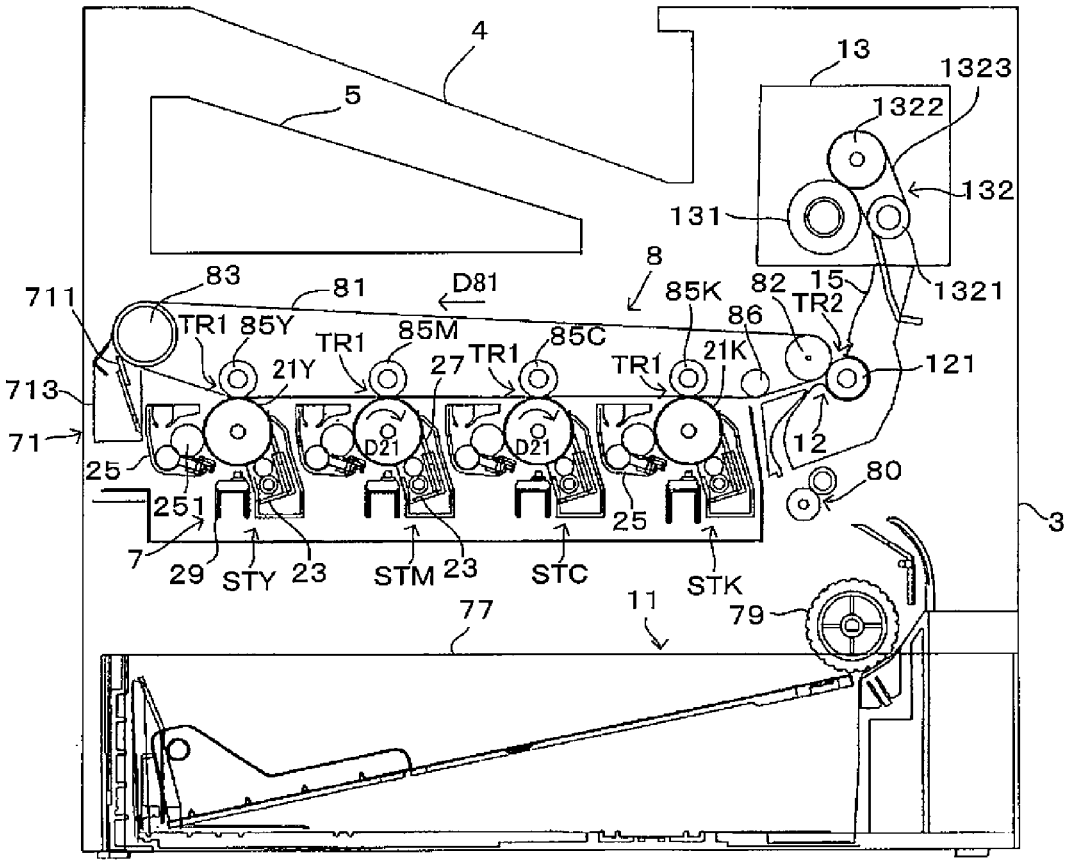
FIG. 1 is a diagram showing a first embodiment of an image forming apparatus according to the invention.
Figure 2:
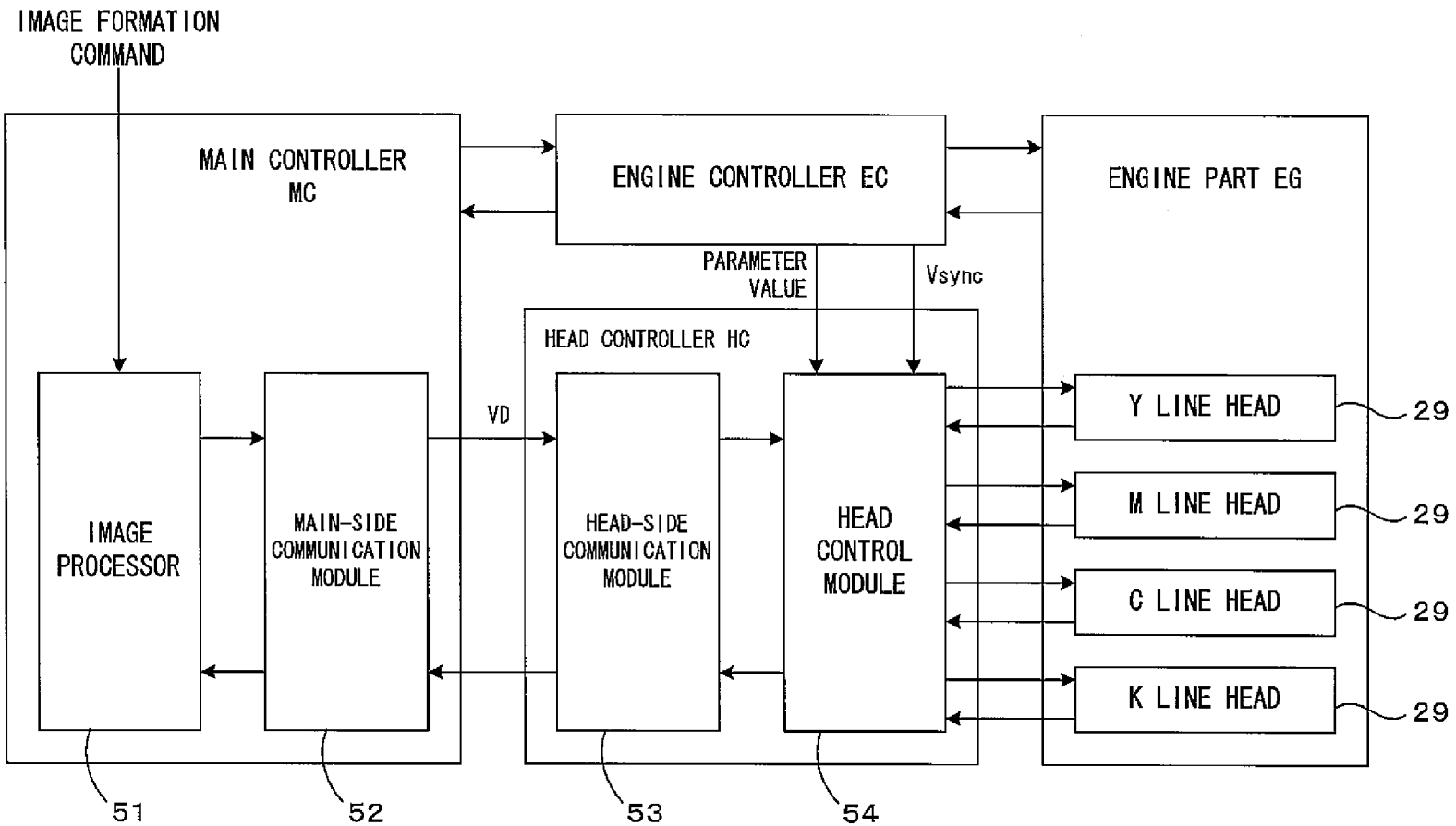
FIG. 2 is a diagram showing the electrical construction of the image forming apparatus of FIG. 1.

FIG. 1 is a diagram showing a first embodiment of an image forming apparatus according to the invention, and FIG. 2 is a diagram showing the electrical construction of the image forming apparatus of FIG. 1. This apparatus is an image forming apparatus that can selectively execute a color mode for forming a color image by superimposing four color toners of black (K), cyan (C), magenta (M) and yellow (Y) and a monochromatic mode for forming a monochromatic image using only black (K) toner. FIG. 1 is a diagram corresponding to the execution of the color mode. In this image forming apparatus, when an image formation command is given from an external apparatus such as a host computer to a main controller MC having a CPU and memories, the main controller MC feeds a control signal and the like to an engine controller EC and feeds video data VD corresponding to the image formation command to a head controller HC. This head controller HC controls line heads 29 of the respective colors based on the video data VD from the main controller MC, a vertical synchronization signal Vsync from the engine controller EC and parameter values from the engine controller EC. In this way, an engine part EG performs a specified image forming operation to form an image corresponding to the image formation command on a sheet such as a copy sheet, transfer sheet, form sheet or transparent sheet for OHP.

An electrical component box 5 having a power supply circuit board, the main controller MC, the engine controller EC and the head controller HC built therein is disposed in a housing main body 3 of the image forming apparatus according to this embodiment. An image forming unit 7, a transfer belt unit 8 and a sheet feeding unit 11 are also arranged in the housing main body 3. A secondary transfer unit 12, a fixing unit 13, and a sheet guiding member 15 are arranged at the right side in the housing main body 3 in FIG. 1. It should be noted that the sheet feeding unit 11 is detachably mountable into the housing main body 3. The sheet feeding unit 11 and the transfer belt unit 8 are so constructed as to be detachable for repair or exchange respectively.

The image forming unit 7 includes four image forming stations STY (for yellow), STM (for magenta), STC (for cyan) and STK (for black) which form a plurality of images having different colors. Each of the image forming stations STY, STM, STC and STK includes a photosensitive drum 21 on a surface of which a toner image of each color is formed. Each photosensitive drum 21 is connected to its own driving motor and is driven to rotate at a specified speed in a direction of arrow D21 in FIG. 1, whereby the surface of the photosensitive drum 21 is transported in a sub scanning direction. Further, a charger 23, the line head 29, a developer 25 and a photosensitive drum cleaner 27 are arranged in a rotating direction around each photosensitive drum 21. A charging operation, a latent image forming operation and a toner developing operation are performed by these functional sections. Accordingly, a color image is formed by superimposing toner images formed by all the image forming stations STY, STM, STC and STK on a transfer belt 81 of the transfer belt unit 8 at the time of executing the color mode, and a monochromatic image is formed using only a toner image formed by the image forming station STK at the time of executing the monochromatic mode. Meanwhile, since the respective image forming stations of the image forming unit 7 are identically constructed, reference characters are given to only some of the image forming stations while being not given to the other image forming stations in order to facilitate the diagrammatic representation in FIG. 1.

The charger 23 includes a charging roller having the surface thereof made of an elastic rubber. This charging roller is constructed to be rotated by being held in contact with the surface of the photosensitive drum 21 at a charging position. As the photosensitive drum 21 rotates, the charging roller is rotated at the same circumferential speed in a direction driven by the photosensitive drum 21. This charging roller is connected to a charging bias generator (not shown) and charges the surface of the photosensitive drum 21 at the charging position where the charger 23 and the photosensitive drum 21 are in contact upon receiving the supply of a charging bias from the charging bias generator.

The line head 29 includes a plurality of light emitting elements arrayed in the axial direction (a direction normal to the plane of FIG. 1) of the photosensitive drum 21 and is positioned separated from the photosensitive drum 21. Light beams are emitted from these light emitting elements to irradiate the surface of the photosensitive drum 21 charged by the charger 23, thereby forming a latent image on this surface. In this embodiment, the head controller HC is provided to control the line heads 29 of the respective colors, and controls the respective line heads 29 based on the video data VD from the main controller MC and a signal from the engine controller EC. Specifically, in this embodiment, image data included in an image formation command is inputted to an image processor 51 of the main controller MC. Then, video data VD of the respective colors are generated by applying various image processings to the image data, and the video data VD are fed to the head controller HC via a main-side communication module 52. In the head controller HC, the video data VD are fed to a head control module 54 via a head-side communication module 53. Signals representing parameter values relating to the formation of a latent image and the vertical synchronization signal Vsync are fed to this head control module 54 from the engine controller EC as described above. Based on these signals, the video data VD and the like, the head controller HC generates signals for controlling the driving of the elements of the line heads 29 of the respective colors and outputs them to the respective line heads 29. In this way, the operations of the light emitting elements in the respective line heads 29 are suitably controlled to form latent images corresponding to the image formation command.

In this embodiment, the photosensitive drum 21, the charger 23, the developer 25 and the photosensitive drum cleaner 27 of each of the image forming stations STY, STM, STC and STK are unitized as a photosensitive cartridge. Further, each photosensitive cartridge includes a nonvolatile memory for storing information on the photosensitive cartridge. Wireless communication is performed between the engine controller EC and the respective photosensitive cartridges. By doing so, the information on the respective photosensitive cartridges is transmitted to the engine controller EC and information in the respective memories can be updated and stored.

The developer 25 includes a developing roller 251 carrying toner on the surface thereof. By a development bias applied to the developing roller 251 from a development bias generator (not shown) electrically connected to the developing roller 251, charged toner is transferred from the developing roller 251 to the photosensitive drum 21 to develop the latent image formed by the line head 29 at a development position where the developing roller 251 and the photosensitive drum 21 are in contact.

The toner image developed at the development position in this way is primarily transferred to the transfer belt 81 at a primary transfer position TR1 to be described later where the transfer belt 81 and each photosensitive drum 21 are in contact after being transported in the rotating direction D21 of the photosensitive drum 21.

Further, in this embodiment, the photosensitive drum cleaner 27 is disposed in contact with the surface of the photosensitive drum 21 downstream of the primary transfer position TR1 and upstream of the charger 23 with respect to the rotating direction D21 of the photosensitive drum 21. This photosensitive drum cleaner 27 removes the toner remaining on the surface of the photosensitive drum 21 to clean after the primary transfer by being held in contact with the surface of the photosensitive drum.

The transfer belt unit 8 includes a driving roller 82, a driven roller (blade facing roller) 83 arranged to the left of the driving roller 82 in FIG. 1, and the transfer belt 81 mounted on these rollers and driven to turn in a direction of arrow D81 in FIG. 1 (conveying direction). The transfer belt unit 8 also includes four primary transfer rollers 85Y, 85M, 85C and 85K arranged to face in a one-to-one relationship with the photosensitive drums 21 of the respective image forming stations STY, STM, STC and STK inside the transfer belt 81 when the photosensitive cartridges are mounted. These primary transfer rollers 85Y, 85M, 85C and 85K are respectively electrically connected to a primary transfer bias generator not shown. As described in detail later, at the time of executing the color mode, all the primary transfer rollers 85Y, 85M, 85C and 85K are positioned on the sides of the image forming stations STY, STM, STC and STK as shown in FIG. 1, whereby the transfer belt 81 is pressed into contact with the photosensitive drums 21 of the image forming stations STY, STM, STC and STK to form the primary transfer positions T1I between the respective photosensitive drums 21 and the transfer belt 81. By applying primary transfer biases from the primary transfer bias generator to the primary transfer rollers 85Y, 85M, 85C and 85K at suitable timings, the toner images formed on the surfaces of the respective photosensitive drums 21 are transferred to the surface of the transfer belt 81 at the corresponding primary transfer positions TR1 to form a color image.

On the other hand, out of the four primary transfer rollers 85Y, 85M, 85C and 85K, the color primary transfer rollers 85Y, 85M, 85C are separated from the facing image forming stations STY, STM and STC and only the monochromatic primary transfer roller 85K is brought into contact with the image forming station STK at the time of executing the monochromatic mode, whereby only the monochromatic image forming station STK is brought into contact with the transfer belt 81. As a result, the primary transfer position TR1 is formed only between the monochromatic primary transfer roller 85K and the image forming station STK. By applying a primary transfer bias at a suitable timing from the primary transfer bias generator to the monochromatic primary transfer roller 85K, the toner image formed on the surface of the photosensitive drum 21 is transferred to the surface of the transfer belt 81 at the primary transfer position TR1 to form a monochromatic image.

The transfer belt unit 8 further includes a downstream guide roller 86 disposed downstream of the monochromatic primary transfer roller 85K and upstream of the driving roller 82. This downstream guide roller 86 is so disposed as to come into contact with the transfer belt 81 on an internal common tangent to the primary transfer roller 85K and the photosensitive drum 21 at the primary transfer position TR1 formed by the contact of the monochromatic primary transfer roller 85K with the photosensitive drum 21 of the image forming station STK.

The driving roller 82 drives to rotate the transfer belt 81 in the direction of the arrow D81 and doubles as a backup roller for a secondary transfer roller 121. A rubber layer having a thickness of about 3 mm and a volume resistivity of 1000 kΩ·cm or lower is formed on the circumferential surface of the driving roller 82 and is grounded via a metal shaft, thereby serving as an electrical conductive path for a secondary transfer bias to be supplied from an unillustrated secondary transfer bias generator via the secondary transfer roller 121. By providing the driving roller 82 with the rubber layer having high friction and shock absorption, an impact caused upon the entrance of a sheet into a contact part (secondary transfer position TR2) of the driving roller 82 and the secondary transfer roller 121 is unlikely to be transmitted to the transfer belt 81 and image deterioration can be prevented.

The sheet feeding unit 11 includes a sheet feeding section which has a sheet cassette 77 capable of holding a stack of sheets, and a pickup roller 79 which feeds the sheets one by one from the sheet cassette 77. The sheet fed from the sheet feeding section by the pickup roller 79 is fed to the secondary transfer position TR2 along the sheet guiding member 15 after having a sheet feed timing adjusted by a pair of registration rollers 80.

The secondary transfer roller 121 is provided freely to abut on and move away from the transfer belt 81, and is driven to abut on and move away from the transfer belt 81 by a secondary transfer roller driving mechanism (not shown). The fixing unit 13 includes a heating roller 131 which is freely rotatable and has a heating element such as a halogen heater built therein, and a pressing section 132 which presses this heating roller 131. The sheet having an image secondarily transferred to the front side thereof is guided by the sheet guiding member 15 to a nip portion formed between the heating roller 131 and a pressure belt 1323 of the pressing section 132, and the image is thermally fixed at a specified temperature in this nip portion. The pressing section 132 includes two rollers 1321 and 1322 and the pressure belt 1323 mounted on these rollers. Out of the surface of the pressure belt 1323, a part stretched by the two rollers 1321 and 1322 is pressed against the circumferential surface of the heating roller 131, thereby forming a sufficiently wide nip portion between the heating roller 131 and the pressure belt 1323. The sheet having been subjected to the image fixing operation in this way is transported to the discharge tray 4 provided on the upper surface of the housing main body 3.

Further, a cleaner 71 is disposed facing the blade facing roller 83 in this apparatus. The cleaner 71 includes a cleaner blade 711 and a waste toner box 713. The cleaner blade 711 removes foreign matters such as toner remaining on the transfer belt after the secondary transfer and paper powder by holding the leading end thereof in contact with the blade facing roller 83 via the transfer belt 81. Foreign matters thus removed are collected into the waste toner box 713. Further, the cleaner blade 711 and the waste toner box 713 are constructed integral to the blade facing roller 83. Accordingly, if the blade facing roller 83 moves as described next, the cleaner blade 711 and the waste toner box 713 move together with the blade facing roller 83.

Figure 3:
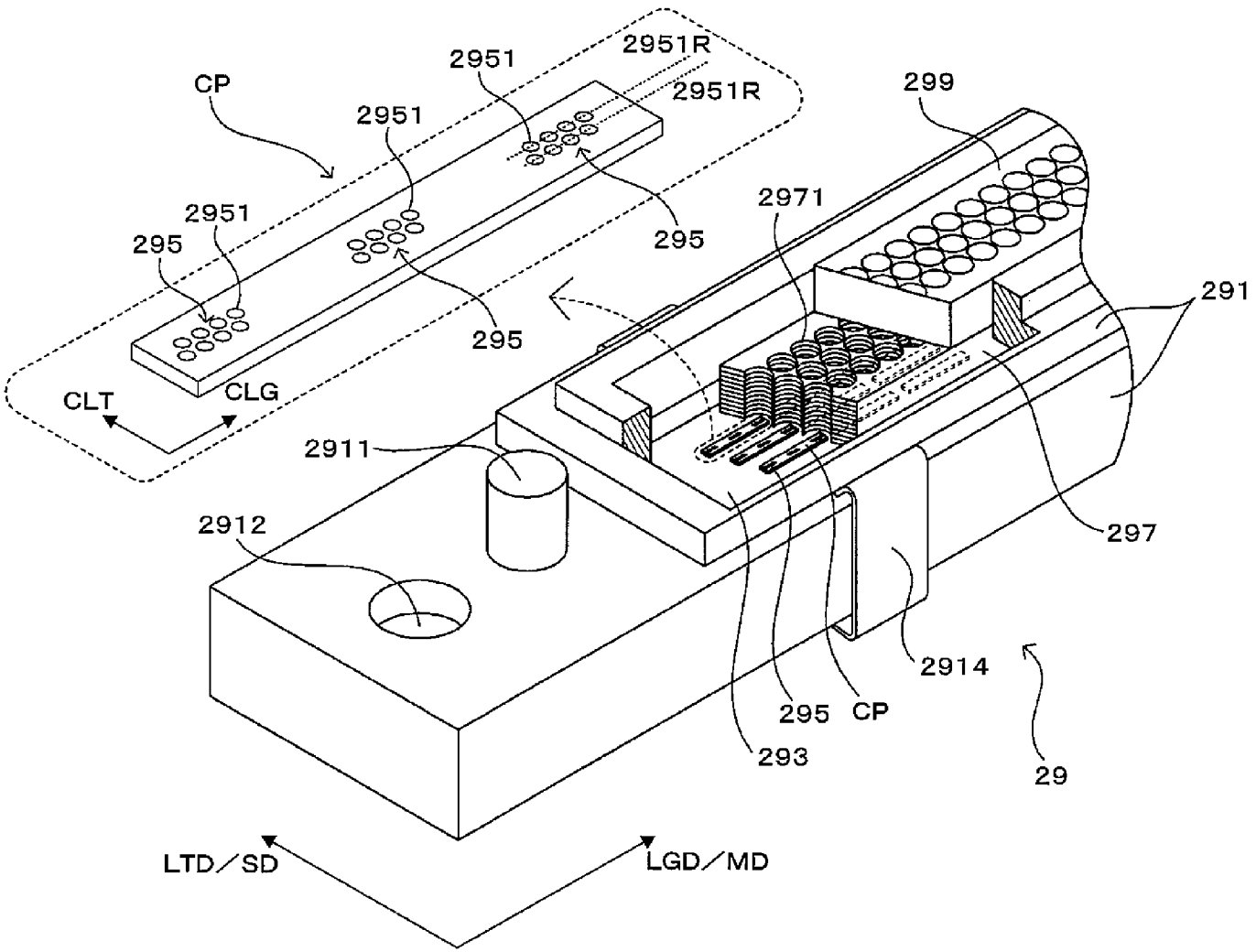
FIG. 3 is a perspective view schematically showing a line head.
Figure 4:
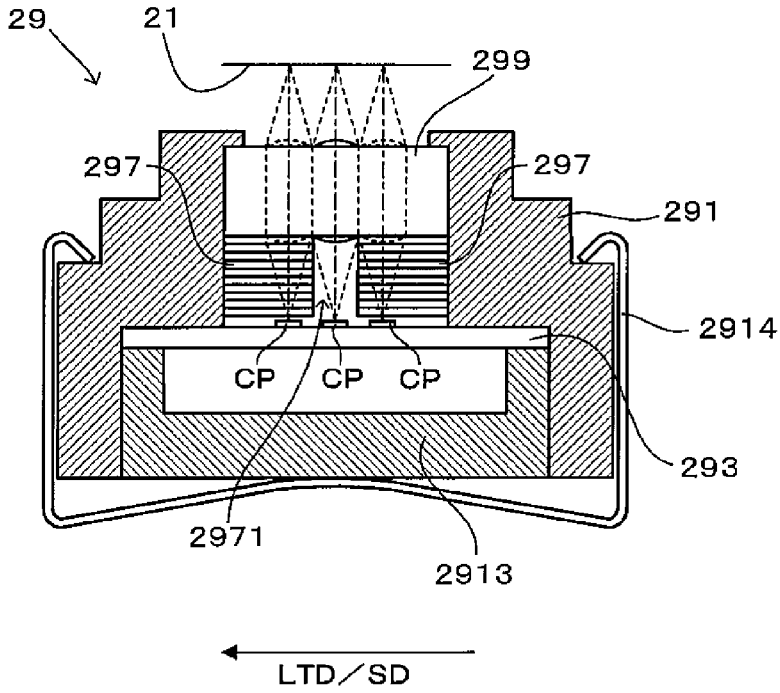
FIG. 4 is a sectional view along a width direction showing the line head.

FIG. 3 is a perspective view schematically showing a line head, and FIG. 4 is a sectional view along a width direction showing the line head. The surface of the photosensitive drum 21 the line head 29 faces is conveyed in the sub scanning direction SD orthogonal to the main scanning direction MD. The line head 29 is arranged facing the photosensitive drum surface such that the longitudinal direction LGD thereof is parallel to the main scanning direction MD and the width direction LTD approximately orthogonal to the longitudinal direction LGD is parallel to the sub scanning direction SD. In other words, the main scanning direction MD and the sub scanning direction SD in the side of the photosensitive drum 21 correspond to the longitudinal direction LGD and the width direction LTD in the side of the line head 29, respectively.

The line head 29 includes a case 291 extending in a direction parallel to the longitudinal direction LGD, and a positioning pin 2911 and a screw insertion hole 2912 are provided at each of the opposite ends of such a case 291. The line head 29 is positioned relative to the photosensitive drum 21 by fitting such positioning pins 2911 into positioning holes (not shown) perforated in a photosensitive drum cover (not shown) covering the photosensitive drum 21 and positioned relative to the photosensitive drum 21. Further, the line head 29 is positioned and fixed relative to the photosensitive drum 21 by screwing fixing screws into screw holes (not shown) of the photosensitive drum cover via the screw insertion holes 2912 to be fixed.

The case 291 retains a microlens array 299 at a position facing the outer surface of the photosensitive drum 21 and is internally provided with a light shielding member 297 and a head substrate 293 (second substrate), the light shielding member 297 being closer to the microlens array 299 than the head substrate 293. A plurality of chips CP (first substrates) are provided on the top surface (that is, surface facing the microlens array out of two surfaces of the head substrate 293) of the head substrate 293. The respective chips CP are bonded to the top surface of the head substrate 293 such that chip longitudinal axes CLG are parallel to the longitudinal direction LGD of the line head 29 and chip lateral axes 0CLT are parallel to the width direction LTD of the line head 29. In other words, as disclosed, for example, in JP-A-2002-314191, the chips CP (laser arrays in this publication) are bonded to the head substrate 293 (package substrate in this publication).

Each chip CP is a so-called LED array including a plurality of LEDs (light emitting diodes) as light emitting elements 2951 and is constructed such that a plurality of LEDs are formed on a chip-shaped silicon substrate as in LED arrays disclosed, for example, in JP-A-2002-222988 and JP-A-2003-347581. The chip CP has such a construction as shown in a broken-line enclosed area of FIG. 3. In other words, each chip CP includes a plurality of (three in FIG. 3) light emitting element groups 295 arranged at specified pitches in the longitudinal direction LGD (chip longitudinal axis CLG) of the line head 29. Each of the plurality of light emitting element groups 295 includes a plurality of (eight in FIG. 3) light emitting elements 2951. More specifically, each light emitting element group 295 is formed by arranging two light emitting element rows 2951R, in each of which a plurality of (four in FIG. 3) light emitting elements 2951 are linearly aligned in the longitudinal direction LGD (chip longitudinal axis CLG), in the width direction LTD (chip lateral axis CLT) of the line head 29. At this time, in each light emitting element group 295, the positions of the eight light emitting elements 2951 in the longitudinal direction LGD (chip longitudinal axis CLG) mutually differ. As a result, these eight light emitting elements 2951 are arranged in an offset manner.

By two-dimensionally arranging the plurality of chips CP on the head substrate 293 while being spaced apart in the longitudinal direction LGD and the width direction LTD, a plurality of light emitting element groups 295 are two-dimensionally arranged on the top surface of the head substrate 293 while being spaced apart in the longitudinal direction LGD and the width direction LTD. At this time, the positions of the plurality of light emitting element groups 295 in the longitudinal direction LGD mutually differ. When the light emitting elements 2951 of the light emitting element groups 295 are driven by a driving circuit (not shown) formed on the head substrate 293, light beams are emitted toward the photosensitive drum 21 from the light emitting elements 2951. These light beams propagate toward the light shielding member 297.

The light shielding member 297 is arranged to face the top surface of the head substrate 293 and distanced from the top surface of the head substrate 293. Such spacing is set according to the thickness of the chips CP. In other words, the contact of the light shielding member 297 and the chips CP can be prevented by providing such spacing. The light shielding member 297 is formed with a plurality of light guiding holes 2971 which are in a one-to-one correspondence with the plurality of light emitting element groups 295. Each of such light guiding holes 2971 is in the form of a substantially cylindrical hole whose central axis is parallel to a normal line to the head substrate 293, and penetrates the light shielding member 297. Thus, all the lights emitted from the light emitting elements belonging to one light emitting element group 295 are headed for the microlens array 299 via the same light guiding hole 2971, and the interference of light beams emitted from different light emitting element groups 295 is prevented by means of the light shielding member 297. The light beams having passed through the light guiding holes 2971 formed in the light shielding member 297 are imaged as spots on the surface of the photosensitive drum 21 by means of the microlens array 299. It should be noted that the specific construction of the microlens array 299 and the imaged state of the light beams by the microlens array 299 are described in detail later.

As shown in FIG. 4, an underside lid 2913 is pressed against the case 291 via the head substrate 293 by retainers 2914. Specifically, the retainers 2914 have elastic forces to press the underside lid 2913 toward the case 291, and seal the inside of the case 291 light-tight (that is, so that light does not leak from the inside of the case 291 and so that light does not intrude into the case 291 from the outside) by pressing the underside lid by means of the elastic force. It should be noted that a plurality of the retainers 2914 are provided at a plurality of positions in the longitudinal direction of the case 291.

Figure 5:
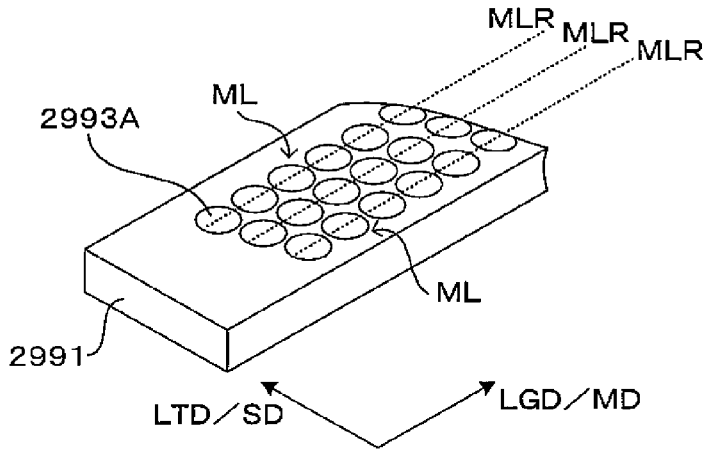
FIG. 5 is a perspective view schematically showing the microlens array.
Figure 6:
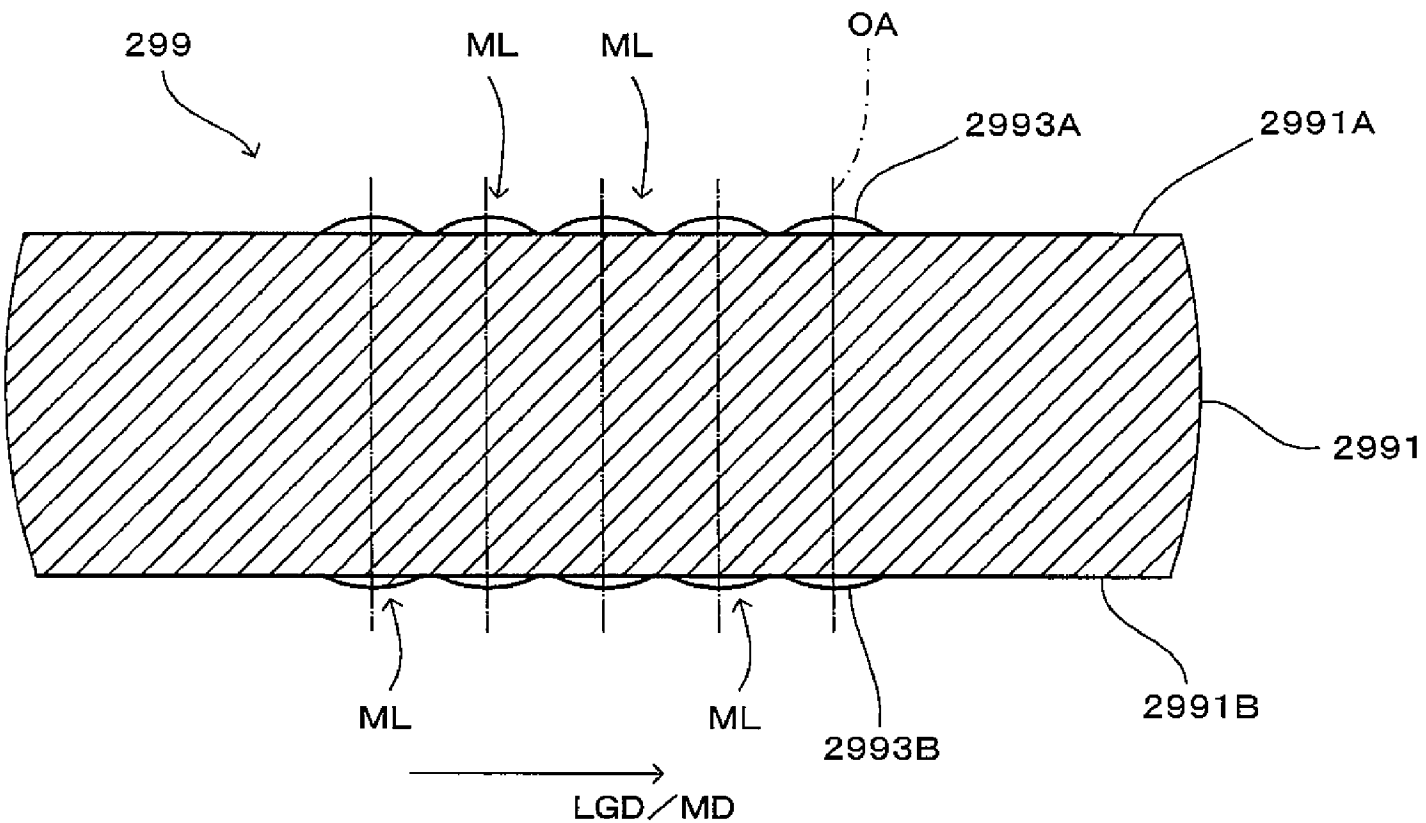
FIG. 6 is a longitudinal section of the microlens array.

FIG. 5 is a perspective view schematically showing the microlens array, and FIG. 6 is a longitudinal section of the microlens array. The microlens array 299 includes a glass substrate 2991 and a plurality of lens pairs each comprised of two lenses 2993A, 2993B arranged in a one-to-one correspondence such that they sandwich the glass substrate 2991. These lenses 2993A, 2993B can be formed of resin for instance.

Specifically, a plurality of lenses 2993A are arranged on a top surface 2991A of the glass substrate 2991, and a plurality of lenses 2993B are so arranged on an underside surface 2991B of the glass substrate 2991 as to correspond one-to-one to the plurality of lenses 2993A. Further, two lenses 2993A and 2993B constituting a lens pair have a common optical axis OA. These plurality of lens pairs are arranged in a one-to-one correspondence with the plurality of light emitting element groups 295. In other words, these plurality of lens pairs are two-dimensionally arranged at specified intervals in the longitudinal direction LGD and the width direction LTD in conformity with the arrangement of the light emitting element groups 295. More specifically, in this microlens array 299, a microlens ML is constituted by the lens pair including the lenses 2993A, 2993B and the glass substrate 2991 sandwiched between this lens pair. A plurality ("three" rows in FIG. 5) of lens rows MLR, in each of which a plurality of microlenses ML are aligned in the longitudinal direction LGD, are arranged in the width direction LTD, such that the plurality of microlenses ML are arranged at mutually different longitudinal positions. All the microlenses ML have the same construction and the same magnification m. As described later, the microlenses ML having a negative magnification m are used in this embodiment, but it goes without saying that the magnification may be set to a positive value.

Figure 7:
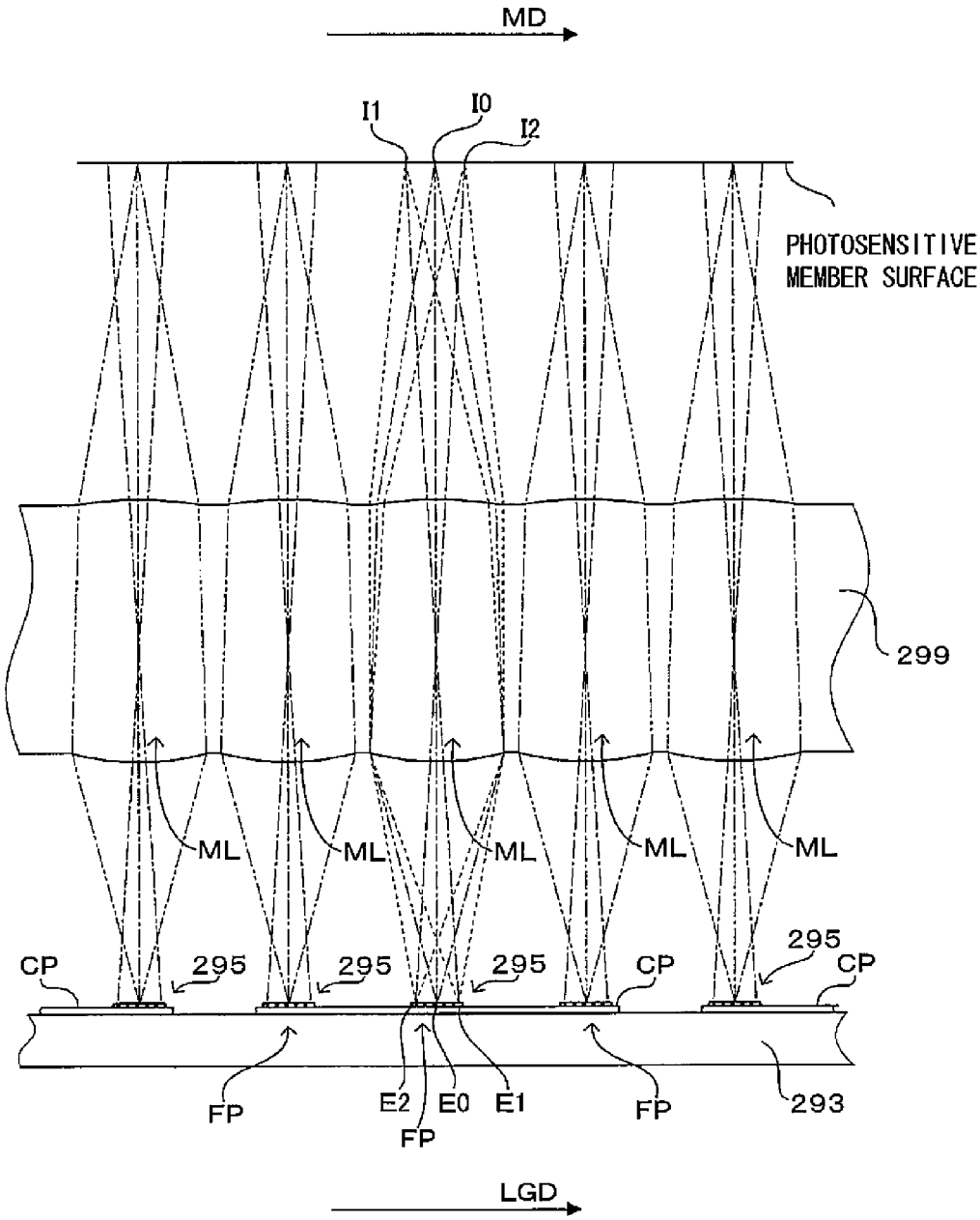
FIG. 7 is a diagram showing an imaging state of the microlens array.

FIG. 7 is a diagram showing an imaging state of the microlens array. The light shielding member 297 is not shown in FIG. 7. As shown in FIG. 7, the chips CP include the light emitting element groups 295 at facing positions FP that the microlenses ML are facing. The microlenses ML focus light beams emitted from the light emitting elements 2951 of the light emitting element groups 295 located at the facing position FP toward the surface of the photosensitive drum (photosensitive member surface). The imaging state of the microlenses ML is described below with reference to FIG. 7. In order to facilitate the understanding of the imaging characteristic of the microlens array 299, paths of light beams emitted from centers of gravity E0 of the light emitting element groups 295 and positions E1, E2 at a specified distance from the centers of gravity E0 in the longitudinal direction LGD are shown in FIG. 7. As shown by such beam paths, the light beams emitted from the respective positions reach the photosensitive member surface (image plane) via the microlens array 299. In other words, the light beams emitted from the chips CP provided on the top surface of the head substrate 293 are imaged on the photosensitive member surface by the microlenses ML of the microlens array 299.

As shown in FIG. 7, the light beam emitted from the center of gravity position E0 of each light emitting element group 295 is imaged at an intersection I0 of the photosensitive member surface and the optical axis OA of the lenses 2993A, 2993B. This results from the fact that the center of gravity position E0 of the light emitting element group 295 is located on the optical axis OA of the lenses 2993A, 2993B. The light beams emitted from the positions E1, E2 are respectively imaged at positions I1, I2 on the surface of the photosensitive drum 21. In other words, the light beam emitted from the position E1 is imaged at the position I1 located at an opposite side of the optical axis OA of the lenses 2993A, 2993B in the main scanning direction MD, and the light beam emitted from the position E2 is imaged at the position I2 located at an opposite side of the optical axis OA of the lenses 2993A, 2993B in the main scanning direction MD. In this way, each microlens ML has an inverting property (in other words, the magnification m of the microlens ML has a negative value). As shown in FIG. 7, a distance between the imaged positions I1, I0 of the light beams is longer than the one between the positions E1, E0. In other words, the absolute value of the magnification of the microlens ML is larger than 1.

Figure 8:
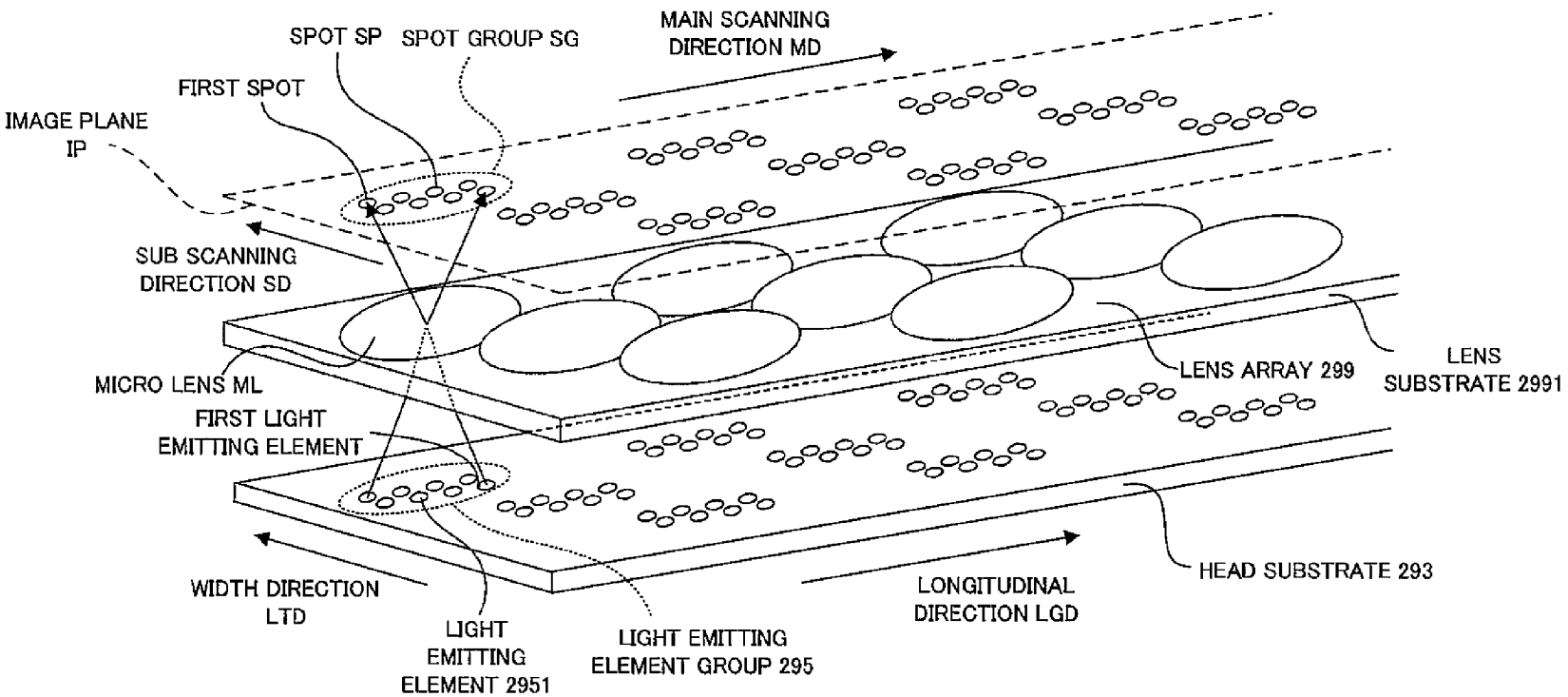
FIGS. 8 and 9 are diagrams showing terminology used in this specification.
Figure 9:
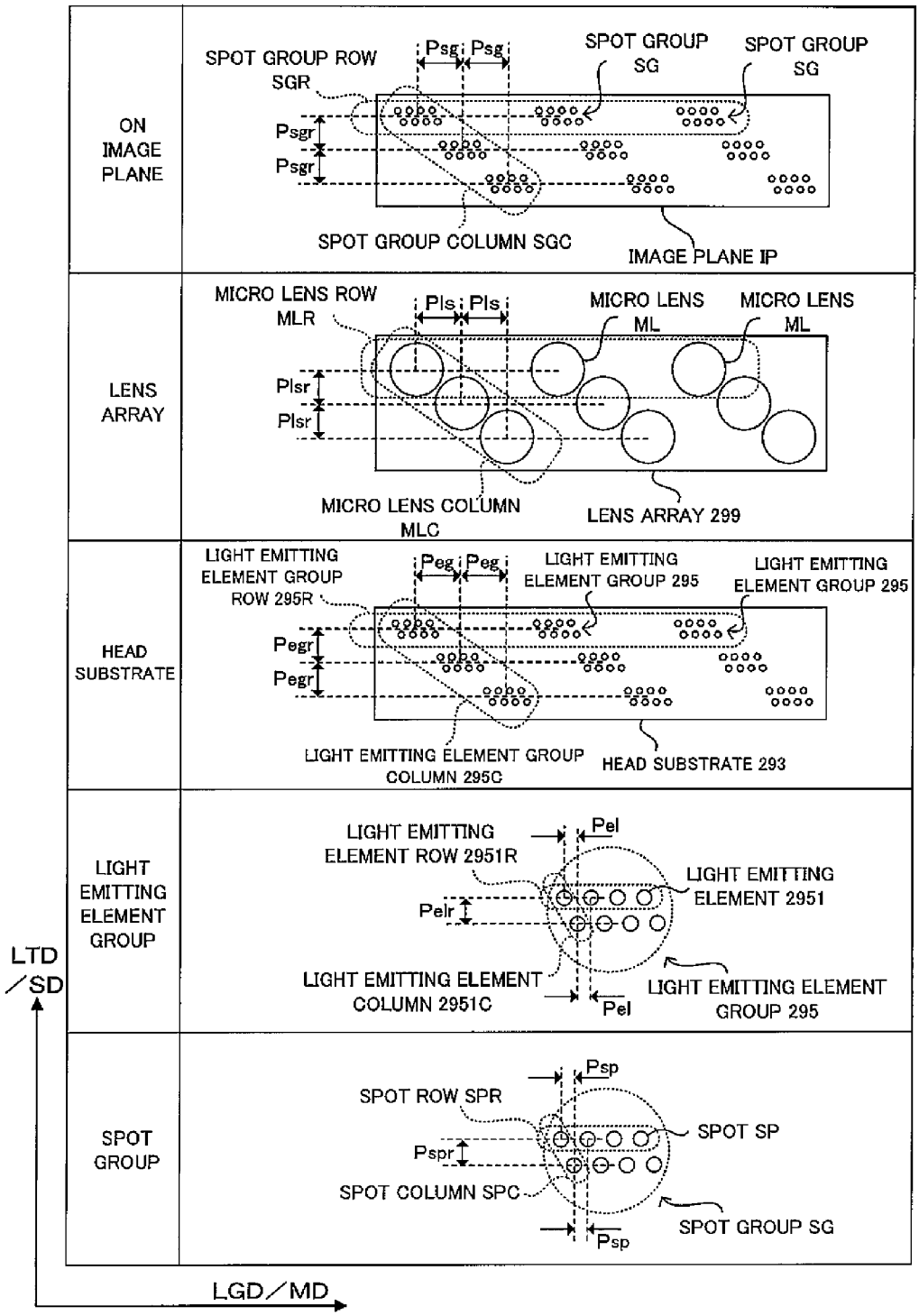

FIGS. 8 and 9 are diagrams showing terminology used in this specification. Here, terminology used in this specification is organized with reference to FIGS. 8 and 9. In this specification, as described above, a conveying direction of the surface (image plane IP) of the photosensitive drum 21 is defined to be the sub scanning direction SD and a direction normal to the sub scanning direction SD is defined to be the main scanning direction MD. Further, a line head 29 is arranged relative to the surface (image plane IP) of the photosensitive drum 21 such that its longitudinal direction LGD corresponds to the main scanning direction MD and its width direction LTD corresponds to the sub scanning direction SD.

Collections of a plurality of (eight in FIGS. 8 and 9) light emitting elements 2951 arranged on the head substrate 293 in one-to-one correspondence with the plurality of microlenses ML of the lens array 299 are defined to be light emitting element groups 295. In other words, in the head substrate 293, the plurality of light emitting element groups 295, each of which includes a plurality of light emitting elements 2951, are arranged in conformity with the plurality of microlenses ML. Further, collections of a plurality of spots SP formed on the image plane IP by focusing light beams from the light emitting element groups 295 toward the image plane IP by the microlenses ML corresponding to the light emitting element groups 295 are defined to be spot groups SG. In other words, a plurality of spot groups SG can be formed in one-to-one correspondence with the plurality of light emitting element groups 295. In each light emitting element group 295, the most upstream light emitting clement 2951 in the main scanning direction MD and the sub scanning direction SD is particularly defined to be a first light emitting element 2951. In each spot group SG, the spot SP corresponding to the first light emitting element 2951 is particularly defined to be a first spot.

FIGS. 8 and 9 show a case where the spots SP are formed with the image plane IP kept stationary in order to facilitate the understanding of the correspondence relationship of the light emitting element groups 295, the microlenses ML and the spot groups SG. Accordingly, the formation positions of the spots SP in the spot groups SG are substantially similar to the arranged positions of the light emitting elements 2951 in the light emitting element groups 295. However, as described later, an actual spot forming operation is performed while the image plane IP (surface of the photosensitive drum 21) is conveyed in the sub scanning direction SD. As a result, the spots SP formed by the plurality of light emitting elements 2951 of the head substrate 293 are formed on a straight line substantially parallel to the main scanning direction MD.

Further, spot group rows SGR and spot group columns SGC are defined as shown in the column "On Image Plane" of FIG. 9. Specifically, a plurality of spot groups SG aligned in the main scanning direction MD is defined to be the spot group row SGR. A plurality of spot group rows SGR are arranged at specified spot group row pitches Psgr in the sub scanning direction SD. Further, a plurality of (three in FIG. 9) spot groups SG arranged at the spot group row pitches Psgr in the sub scanning direction SD and at spot group pitches Psg in the main scanning direction MD are defined to be the spot group column SGC. It should be noted that the spot group row pitch Psgr is a distance in the sub scanning direction SD between the geometric centers of gravity of the two spot group rows SGR side by side with the same pitch and that the spot group pitch Psg is a distance in the main scanning direction MD between the geometric centers of gravity of the two spot groups SG side by side with the same pitch.

Lens rows MLR and lens columns MLC are defined as shown in the column of "Lens Array" of FIG. 9. Specifically, a plurality of microlenses ML aligned in the longitudinal direction LGD is defined to be the lens row MLR. A plurality of lens rows MLR are arranged at specified lens row pitches Plsr in the width direction LTD. Further, a plurality of (three in FIG. 9) microlenses ML arranged at the lens row pitches Plsr in the width direction LTD and at lens pitches Pls in the longitudinal direction LGD are defined to be the lens column MLC. It should be noted that the lens row pitch Plsr is a distance in the width direction LTD between the geometric centers of gravity of the two lens rows MLR side by side with the same pitch and that the lens pitch Pls is a distance in the longitudinal direction LGD between the geometric centers of gravity of the two microlenses ML side by side with the same pitch.

Light emitting element group rows 295R and light emitting element group columns 295C are defined as in the column "Head Substrate" of FIG. 9. Specifically, a plurality of light emitting element groups 295 aligned in the longitudinal direction LGD is defined to be the light emitting element group row 295R. A plurality of light emitting element group rows 295R are arranged at specified light emitting element group row pitches Pegr in the width direction LTD. Further, a plurality of (three in FIG. 9) light emitting element groups 295 arranged at the light emitting element group row pitches Pegr in the width direction LTD and at light emitting element group pitches Peg in the longitudinal direction LGD are defined to be the light emitting element group column 295C. It should be noted that the light emitting element group row pitch Pegr is a distance in the width direction LTD between the geometric centers of gravity of the two light emitting element group rows 295R side by side with the same pitch and that the light emitting element group pitch Peg is a distance in the longitudinal direction LGD between the geometric centers of gravity of the two light emitting element groups 295 side by side with the same pitch.

Light emitting element rows 2951R and light emitting element columns 2951C are defined as in the column "Light emitting element Group" of FIG. 9. Specifically, in each light emitting element group 295, a plurality of light emitting elements 2951 aligned in the longitudinal direction LGD is defined to be the light emitting element row 2951R. A plurality of light emitting element rows 2951R are arranged at specified light emitting element row pitches Pelr in the width direction LTD. Further, a plurality of (two in FIG. 9) light emitting elements 2951 arranged at the light emitting element row pitches Pelr in the width direction LTD and at light emitting element pitches Pel in the longitudinal direction LGD are defined to be the light emitting element column 2951C. It should be noted that the light emitting element row pitch Pelr is a distance in the width direction LTD between the geometric centers of gravity of the two light emitting element rows 2951R side by side with the same pitch and that the light emitting element pitch Pel is a distance in the longitudinal direction LGD between the geometric centers of gravity of the two light emitting elements 2951 side by side with the same pitch.

Spot rows SPR and spot columns SPC are defined as shown in the column "Spot Group" of FIG. 9. Specifically, in each spot group SG, a plurality of spots SG aligned in the main scanning direction MD is defined to be the spot row SPR. A plurality of spot rows SPR are arranged at specified spot row pitches Pspr in the sub scanning direction SD. Further, a plurality of (two in FIG. 9) spots arranged at the spot row pitches Pspr in the sub scanning direction SD and at spot pitches Psp in the main scanning direction MD are defined to be the spot column SPC. It should be noted that the spot row pitch Pspr is a distance in the sub scanning direction SD between the geometric centers of gravity of the two spot rows SPR side by side with the same pitch and that the spot pitch Psp is a distance in the main scanning direction MD between the geometric centers of gravity of the two spots SP side by side with the same pitch.

Figure 10:
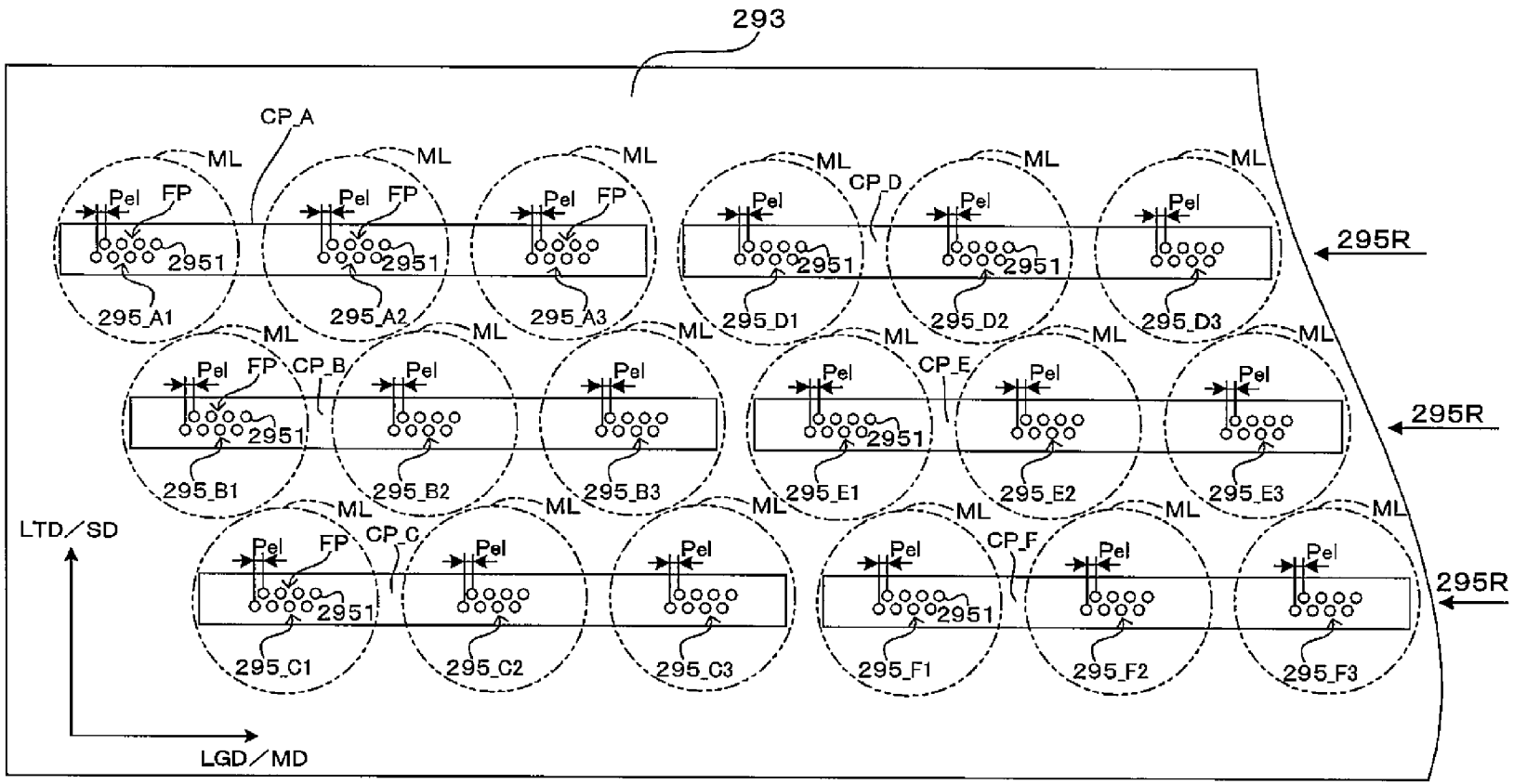
FIG. 10 is a diagram showing the arrangement of the chips on the head substrate.

FIG. 10 is a diagram showing the arrangement of the chips on the head substrate. As shown in FIG. 10, a plurality of chips CP_A, CP_B, CP_C, . . . are arranged on the top surface of the head substrate 293. The respective chips CP are arranged such that the longitudinal axes thereof are parallel to the longitudinal direction LGD and the lateral axes thereof are parallel to the width direction LTD. Here, in this specification, these chips are merely called "chips CP" in the case of not specifying which one of the plurality of chips. A plurality of microlenses ML are arranged to face each chip CP. In other words, a plurality of (three in FIG. 10) microlenses ML of the microlens array 299 face one chip CP. Each chip CP includes the light emitting element groups 295 at the facing positions FP that the microlenses ML are facing. Since three microlenses ML face one chip CP in FIG. 10, three light emitting element groups 295 are formed on one chip CP. For example, the light emitting element groups 295_A1 to 295_A3 are formed on the chip CP_A; the light emitting element groups 295_B1 to 295_B3 on the chip CP_B; and the light emitting element groups 295_C1 to 295_C3 on the chip CP_C.

At this time, as shown in FIG. 10, a specified number of light emitting element groups 295 are aligned in the longitudinal direction LGD while being spaced apart from each other, thereby forming a light emitting element group row 295R. Here, in this specification, the light emitting element groups are merely called "light emitting element groups 295" in the case of not specifying which one of the plurality of light emitting element groups 295. A plurality of ("three" in FIG. 10) light emitting element group rows 295R are arranged in the width direction LTD. These three light emitting element group rows 295R are mutually displaced at specified pitches in the longitudinal direction LGD. As a result, the light emitting element groups 295 are two-dimensionally arranged and the positions thereof in the longitudinal direction mutually differ. The plurality of microlenses ML are arranged in a one-to-one correspondence with the plurality of light emitting element groups 295 arranged as shown in FIG. 10.

As also shown in FIG. 3, each light emitting element group 295 includes eight light emitting elements 2951, which are arranged as follows. Specifically, in each light emitting element group 295, four light emitting elements 2951 are aligned at specified pitches (=twice the element pitch Pel) in the longitudinal direction LGD to form a light emitting element row 2951R. Two light emitting element rows 2951R are arranged in the width direction LTD. Further, the light emitting element rows 2951R are displaced by the element pitches Pel in the longitudinal direction LGD. Thus, in each light emitting element group 295, all the light emitting elements 2951 are arranged at mutually different longitudinal positions displaced at the element pitches Pel. Accordingly, when light beams are emitted from all the eight light emitting elements 2951 of each light emitting element group 295, these light beams are imaged on the photosensitive member surface at mutually different positions in the main scanning direction MD by the microlens ML. In other words, by turning all the eight light emitting elements 2951 of the light emitting element group 295 on, a spot group can be formed in which eight spots are aligned in the main scanning direction MD. An area of the photosensitive member surface where the spot groups are formed is exposed in this way.

Figure 11:
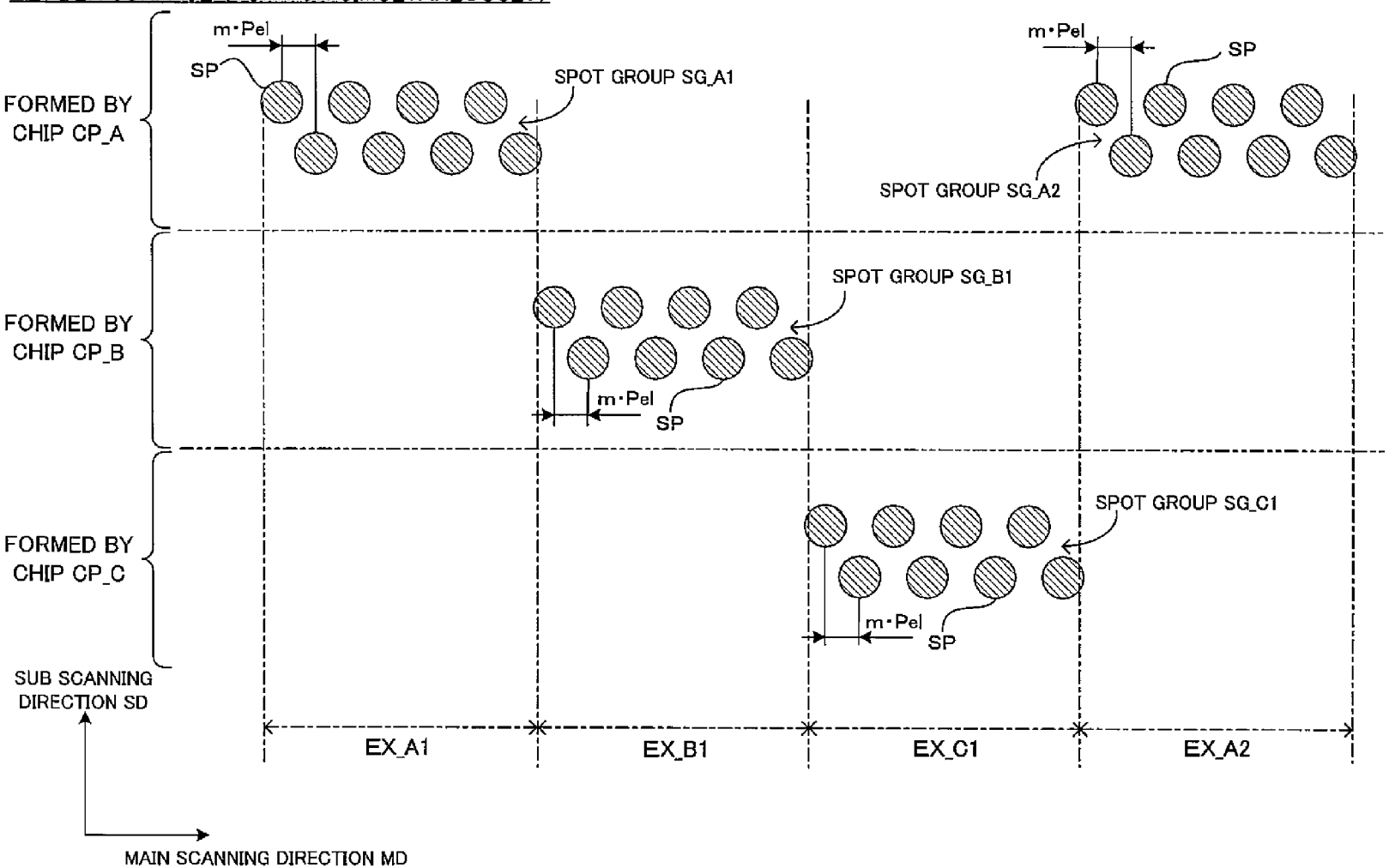
FIGS. 11 and 12 are diagrams showing the positions of spots formed on the photosensitive member surface by the line head.
Figure 12:
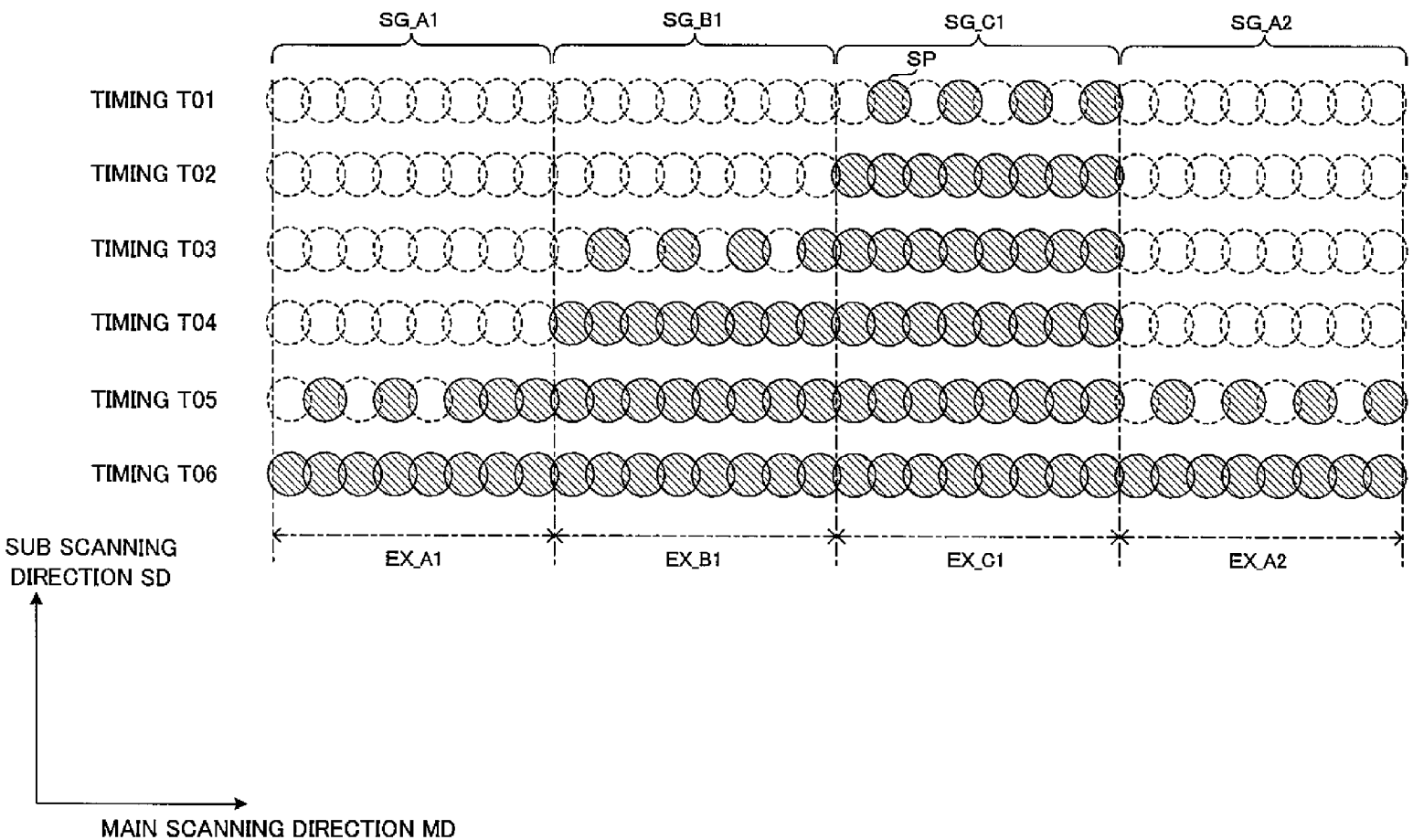

FIGS. 11 and 12 are diagrams showing the positions of spots formed on the photosensitive member surface by the line head. A state where spots are formed by four light emitting element groups, for instance, the light emitting element groups 295_A1, 295_B1, 295_C1 and 295_A2 in FIG. 10 is diagrammatically shown. In FIGS. 11 and 12, a spot group SG_A1 represents a group of spots SP formed by the light emitting element group 295_A1; a spot group SG_B1 represents a group of spots SP formed by the light emitting element group 295_B1; a spot group SG_C1 represents a group of spots SP formed by the light emitting element group 295_C1; and a spot group SG_A2 represents a group of spots SP formed by the light emitting element group 295_A2. In other words, the spot groups SG_A1, SG_A2 are formed by the chip CP_A; the spot group SG_B1 is formed by the chip CP_B; and the spot group SG_C1 is formed by the chip CP_C. When the light emitting elements 2951 are simultaneously turned on as shown in FIG. 11, the spot groups SG_A1, SG_B1, SG_C1 and SG_A2 formed on the photosensitive member surface are also two-dimensionally arranged.

Accordingly, as shown in FIG. 12, each light emitting element row 2951R is constructed such that the light emitting elements 2951 thereof are turned on at timings in conformity with a rotational movement of the photosensitive drum 21, that is, at timings in conformity with a movement of the photosensitive member surface in the sub scanning direction SD. Specifically, the turn-on timings of the light emitting element rows 2951R constituting the light emitting element groups 295_A1, 295_B1, 295_C1 and 295_A2 are differentiated as follows in conformity with the rotational movement of the photosensitive drum 21.

The light emitting element rows 2951R are controlled to be turned on based on:

(a) Timing T01: Turn-on timing of the upper light emitting element row 2951R of the light emitting element group 295_C1,
(b) Timing T02: Turn-on timing of the lower light emitting element row 2951R of the light emitting element group 295_C1,
(c) Timing T03: Turn-on timing of the upper light emitting element row 2951R of the light emitting element group 295_B1,
(d) Timing T04: Turn-on timing of the lower light emitting element row 2951R of the light emitting element group 295_B1,
(e) Timing T05: Turn-on timing of the upper light emitting element rows 2951R of the light emitting element groups 295_A1, 295_A2, and
(f) Timing T06: Turn-on timing of the lower light emitting element rows 2951R of the light emitting element groups 295_A1, 295_A2.

Thus, the spots SP formed by the upper light emitting element rows and those formed by the lower light emitting element rows can be aligned in the main scanning direction MD only by this timing adjustment. In this way, the spots SP can be aligned in a line in the main scanning direction MD by a simple emission timing adjustment.

As shown in FIGS. 11 and 12, each of the plurality of chips CP provided on the head substrate 293 can expose a corresponding exposure region by forming the spots in this area. In other words, each chip CP includes the light emitting element groups 295 and can expose the exposure regions, which are exposed by the light emitting element groups 295 of this chip CP. Further, each chip CP includes the plurality of (three in FIG. 10) light emitting element groups 295, which can expose mutually different exposure regions. Thus, in the line head 29 shown in FIG. 10, each chip CP can expose three mutually different exposure regions. Specifically, the chip CP_A can expose corresponding exposure regions EX_A1, EX_A2 by forming the spot groups SG_A1, SG_A2 in these exposure regions EX_A1, EX_A2. Similarly, the chip CP_B can expose a corresponding exposure region EX_B1 by forming the spot groups SG_B1 in this exposure region EX_B1. Further, the chip CP_C can expose a corresponding exposure region EX_C1 by forming the spot groups SG_C1 in this exposure region EX_C1.

As described above, the line head 29 according to the first embodiment includes the chips CP each formed with a plurality of light emitting elements 2951 for emitting light beams, the head substrate 293 (substrate) to which a plurality of chips CP are bonded, and the microlens array 299 (optical system) in which a plurality of microlenses ML (lenses) are arranged to face each chip CP. Each chip CP includes the light emitting element groups 295 at the facing positions FP that the microlenses ML are facing, and the microlenses ML focus the light beams emitted from the light emitting element groups 295 at the facing positions FP toward the photosensitive member surface (image plane, latent image carrier surface).

As described above, in the line head 29 according to the first embodiment, a plurality of microlenses ML are arranged to face one chip CP. Thus, as compared with the case where one microlens ML is arranged to face one chip CP, the number of the chips CP required by the line head 29 according to the first embodiment is smaller. This is because the line head, in which one microlens ML is arranged to face one chip CP, requires as many chips CP as the microlenses ML, but the plurality of microlenses ML are arranged to face one chip CP in the line head 29 and the number of the necessary chips CP is suppressed to substantially half or smaller than the number of the microlenses ML according to the first embodiment. Therefore, with the line head 29 according to the first embodiment, it is possible to reduce time and cost required for assembling by suppressing the bonding number of the chips in assembling the line head 29.

Further, in the microlens array 299 (optical system) of the above embodiment, a plurality of lens rows MLR, in each of which a plurality of microlenses ML are arranged in the longitudinal direction LGD (second direction), are arranged in the width direction LTD (first direction). With such a construction, the plurality of microlenses ML are two-dimensionally arranged as shown in FIG. 5 and other figures. As compared with the case where the microlenses ML are linearly arranged in the longitudinal direction LGD, an interval between two microlenses adjacent in the longitudinal direction LGD can be larger in the case of such a two-dimensional arrangement. Thus, the diameter of the microlenses ML can be relatively easily increased, with the result that more light can be introduced to the lenses, thereby enabling good exposure.

The chip CP (first substrate) is formed with the light emitting element group (a plurality of light emitting elements 2951 provided at the facing position FP) at each facing position FP, that the microlens ML is facing. In other words, the light emitting element group 295 is arranged for each microlens ML, and light beams from the light emitting element groups 295 are imaged by the corresponding microlenses ML. Accordingly, as compared with the case where light beams are imaged by a lens array formed by arranging refractive index distribution type rod lenses such as a SELFOC lens (registered trade mark of Nippon Sheet Glass Co., Ltd.) in a zigzag manner, the light beams can be imaged with less aberration, thereby enabling good exposure.

On the chip CP (first substrate), a plurality of light emitting element groups 295 are arranged in the longitudinal direction LGD (second direction). In other words, the light emitting element groups 295 arranged in the longitudinal direction LGD are formed on the same chip CR Thus, these light emitting element groups 295 can be arranged in the longitudinal direction LGD with high positional accuracy, thereby enabling good exposure.

Further, in each light emitting element group 295, a plurality of light emitting elements 2951 are aligned in the longitudinal direction LGD to form the light emitting element row 2951R. Therefore, the light emitting element group 295 can be easily formed by aligning the plurality of light emitting elements 2951 in the longitudinal direction LGD.

Further, in each light emitting element group 295, a plurality of light emitting element rows 2951R are arranged at mutually different positions in the width direction LTD. Therefore, the light emitting element group, in which the light emitting elements 2951 are two-dimensionally arranged, can be easily formed.

In the above embodiment, LEDs are employed as the light emitting elements 2951 and the chips CP are LED array chips formed with the LEDs. Since the LEDs having relatively high luminance are employed as the light emitting elements 2951, good exposure is possible.

Second Embodiment

Figure 13:
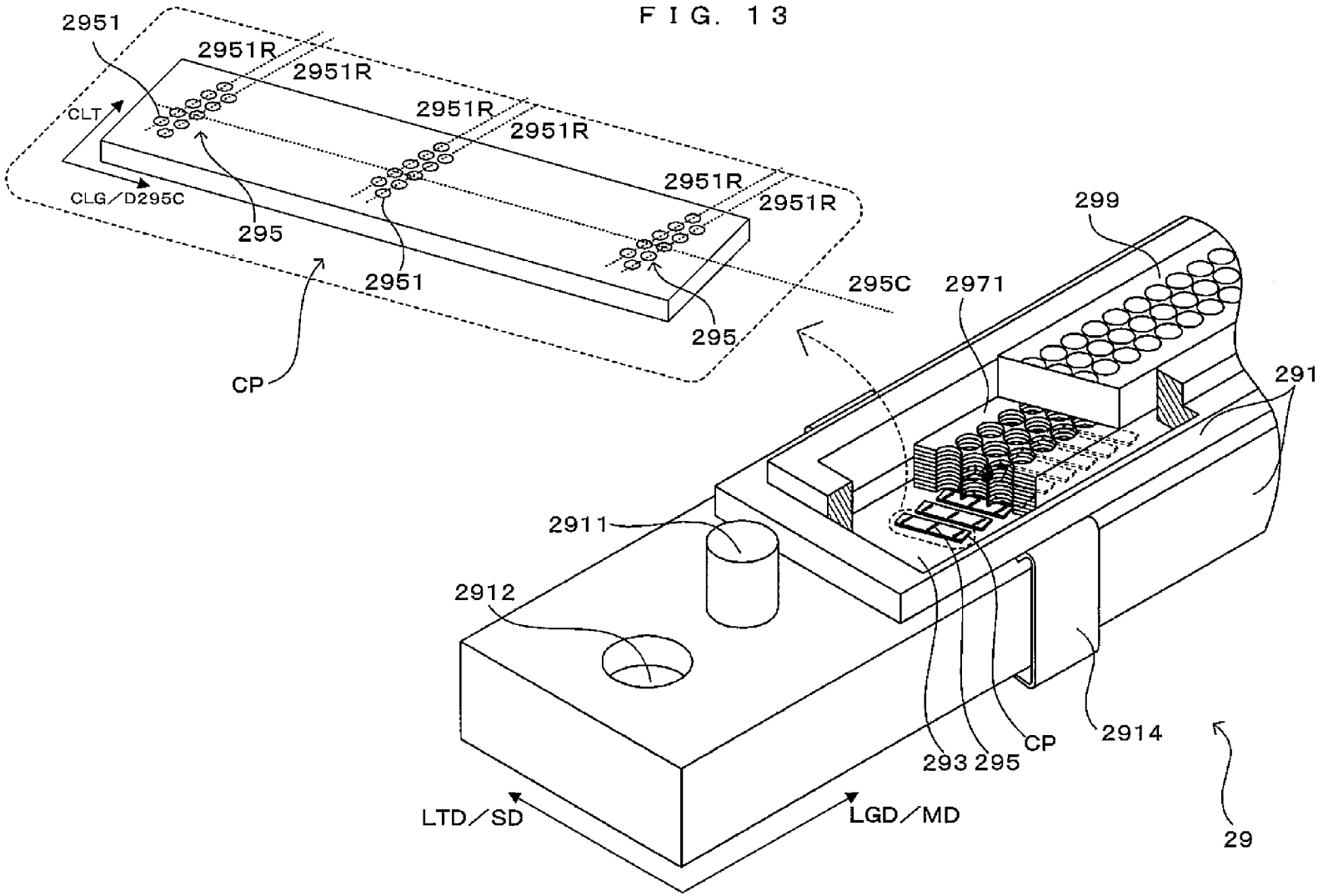
FIG. 13 is a perspective view schematically showing a line head according to a second embodiment.
Figure 14:
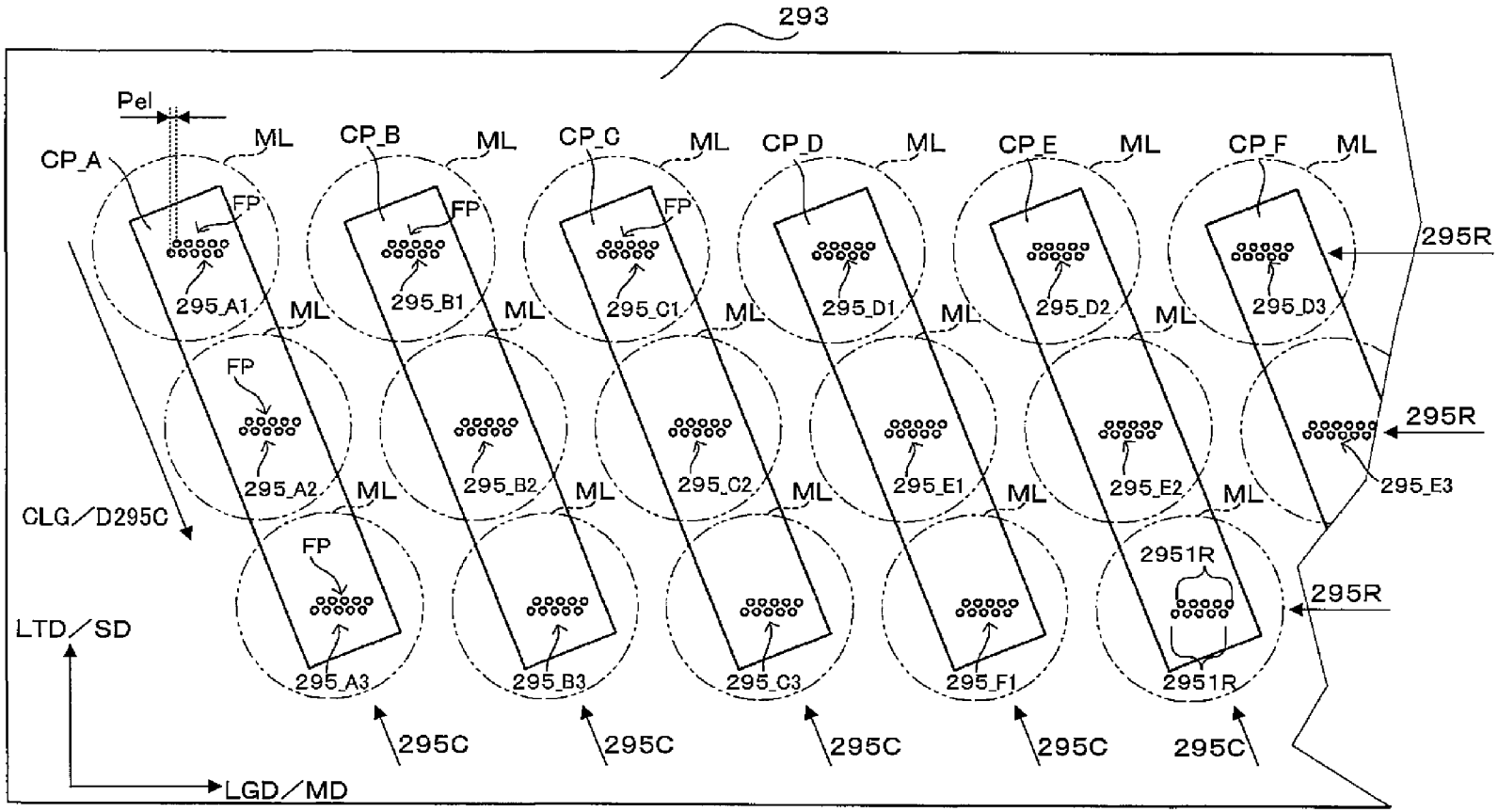
FIG. 14 is a diagram showing the arrangement of chips on a head substrate in the second embodiment.

FIG. 13 is a perspective view schematically showing a line head according to a second embodiment, and FIG. 14 is a diagram showing the arrangement of chips on a head substrate in the second embodiment. In the following description of the second embodiment, points of difference from the above first embodiment are mainly described and common parts are not described by being identified by suitable reference numerals.

The second embodiment is similar to the first embodiment in using so-called LED arrays each including a plurality of LEDs (light emitting diodes) as light emitting elements 2951, but differs therefrom in the following points. Specifically, points of difference between a line head 29 of the second embodiment and the line head 29 of the first embodiment are the construction of chips CP and the arrangement mode of the chips CP on the head substrate 293. More specifically, the chip CP of the second embodiment is formed with a light emitting element group column 295C comprised of three light emitting element groups 295. At this time, the light emitting element group column 295C is formed on the chip CP such that an extending direction D295C of the light emitting element group column 295C (that is, arrangement direction D295C of the light emitting element groups 295 in the light emitting element group column 295C) is parallel to the chip longitudinal axis CLG of the chip CP.

A plurality of chips CP are arranged on the head substrate 293 in the longitudinal direction LGD. At this time, the respective chips CP are bonded to the top surface of the head substrate 293 such that the chip longitudinal axes CLG are parallel to the direction D295C. Therefore, the chip longitudinal axes CLG of the chips CP are inclined with respect to the longitudinal direction LGD of the line head 29 and the chip lateral axes CLT thereof are inclined with respect to the width direction LTD of the line head 29.

A plurality of microlenses ML are arranged to face each chip CP. In other words, in a microlens array 299, the plurality (three in FIG. 14) of microlenses ML are arranged to face one chip CP. Each chip CP includes the light emitting element groups 295 at positions FP that the microlenses ML are facing (that is, the plurality of microlenses ML are arranged in a one-to-one correspondence with the plurality of light emitting element groups 295). Since three microlenses M face one chip CP in FIG. 14, three light emitting elements 295 are formed on one chip CP. For example, the light emitting element groups 295_A1 to 295_A3 are formed on the chip CP_A; the light emitting element groups 295_B1 to 295_B3 on the chip CP_B; and the light emitting element groups 295_C1 to 295_C3 on the chip CP_C.

As shown in FIG. 14, a specified number of light emitting element groups 295 are aligned on the top surface of the head substrate 293 while being spaced apart from each other in the longitudinal direction LGD, thereby forming a light emitting element group row 295R. A plurality of ("three" in the second embodiment) light emitting element group rows 295R are arranged in the width direction LTD. Such three light emitting element group rows 295R are arranged at specified pitches in the longitudinal direction LGD. As a result, the plurality of light emitting element groups 295 are two-dimensionally arranged and the positions thereof in the longitudinal direction mutually differ.

In the second embodiment, the three light emitting element groups 295 constituting each light emitting element group column 295C are respectively formed as follows. Each light emitting element group 295 includes ten light emitting elements 2951, which are arranged as follows. Specifically, in each light emitting element group 295, five light emitting elements 2951 are aligned at specified pitches (=twice the element pitch Pel) in the longitudinal direction LGD to form a light emitting element row 2951R. Two light emitting element rows 2951R are arranged in the width direction LTD. Further, the light emitting element rows 2951R are displaced by the element pitch Pel in the longitudinal direction LGD. Thus, in each light emitting element group 295, all the light emitting elements 2951 are arranged at mutually different longitudinal positions displaced at the element pitches Pel. Accordingly, when light beams are emitted from all the ten light emitting elements 2951 of each light emitting element group 295, these light beams are imaged on a photosensitive member surface at mutually different positions in the main scanning direction MD by the microlens ML. In other words, by turning all the ten light emitting elements 2951 of the light emitting element group 295 on, a spot group can be formed in which ten spots are aligned in the main scanning direction MD. An area of the photosensitive member surface where the spot groups are formed is exposed.

Figure 15:
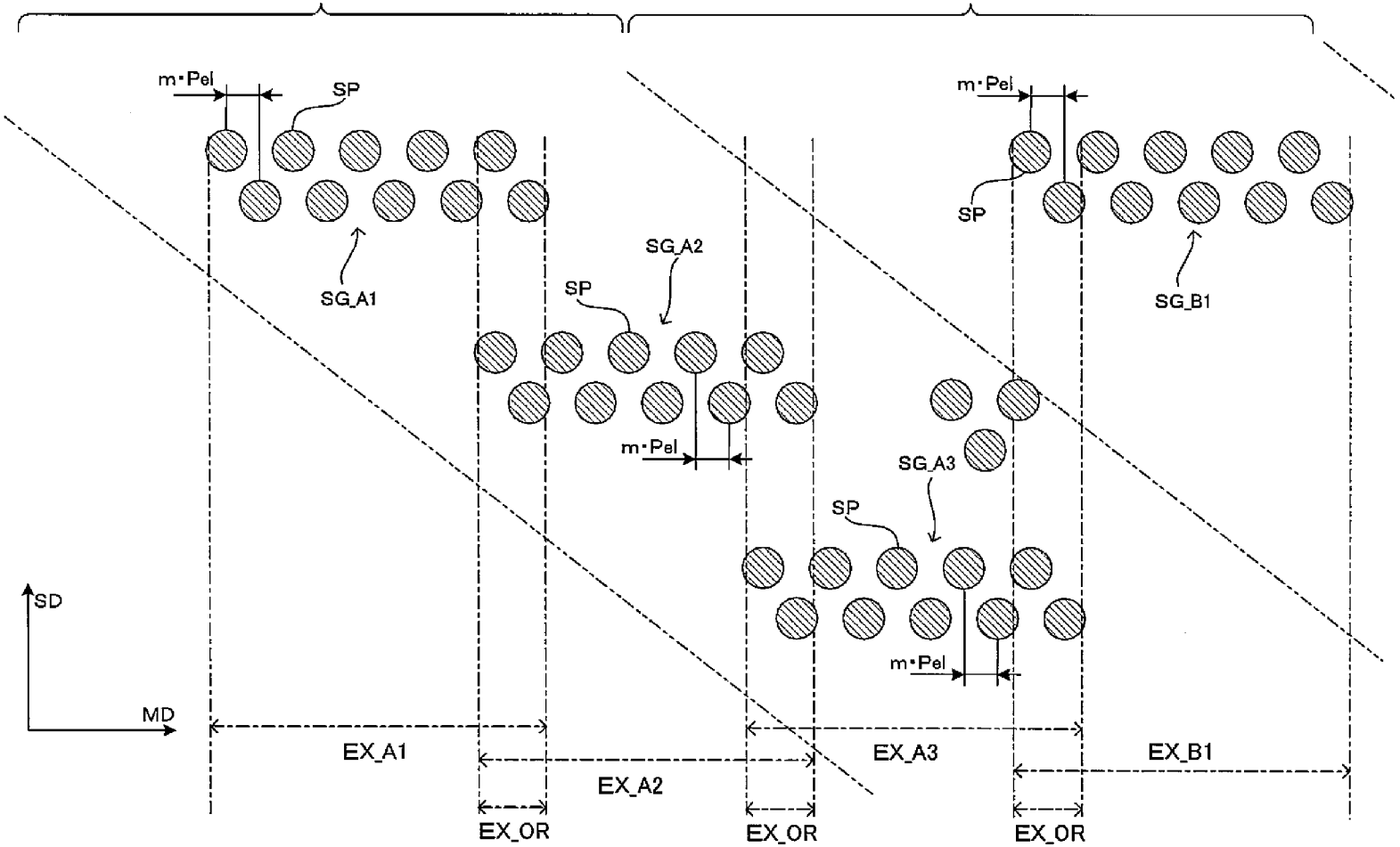
FIGS. 15 and 16 are diagrams showing the positions of spots formed on the photosensitive member surface by the line head.
Figure 16:
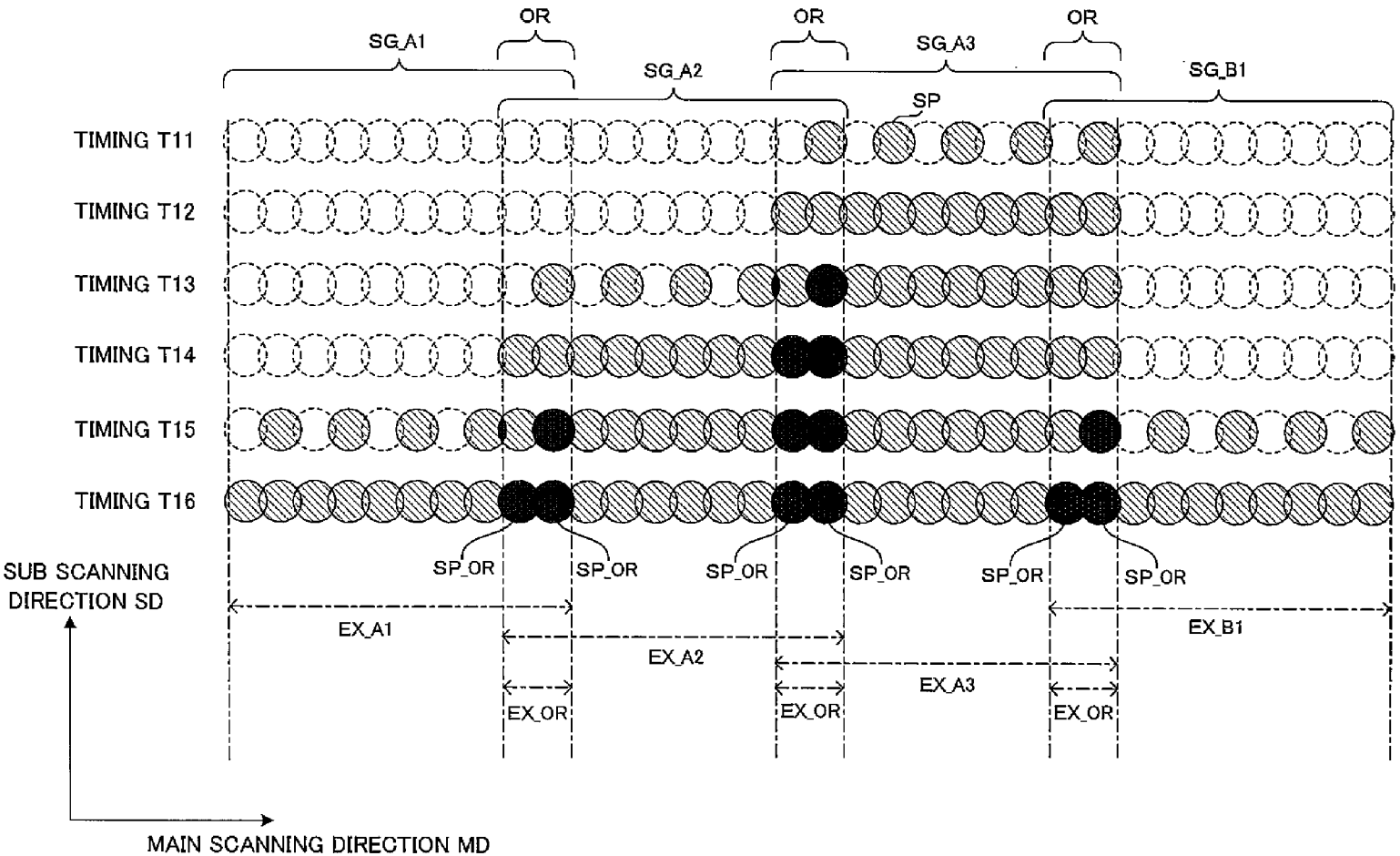

FIGS. 15 and 16 are diagrams showing the positions of spots formed on the photosensitive member surface by the line head. A state where spots are formed by four light emitting element groups, for instance the light emitting element groups 295_A1, 295_A2, 295_A3 and 295_B1 in FIG. 14 is diagrammatically shown. A spot group SG_A1 in FIGS. 15 and 16 represents a group of spots SP formed by the light emitting element group 295_A1; a spot group SG_A2 represents a group of spots SP formed by the light emitting element group 295_A2; a spot group SG_A3 represents a group of spots SP formed by the light emitting element group 295_A3; and a spot group SG_B1 represents a group of spots SP formed by the light emitting element group 295_B1. Such correspondence between the light emitting element groups 295 and the spot groups SG holds true for FIGS. 19 to 22 to be described later. In this way, the spot groups SG_A1 to SG_A3 are formed by the chip CP_A, and the spot group SG_B1 is formed by the chip CP_B. Further, as shown in FIG. 15, exposure regions corresponding to the same chip CP are adjacent to each other. In other words, three exposure regions EX_A1, EX_A2 and EX_A3 corresponding to the chip CP_A are adjacent to each other.

Incidentally, when the light emitting elements 2951 are simultaneously turned on as shown in FIG. 15, the spot groups SG_A1, SG_A2, SG_A3 and SG_B1 formed on the photosensitive member surface are also two-dimensionally arranged Accordingly, in the second embodiment, as shown in FIG. 16, each light emitting element row 2951R is constructed such that the light emitting elements 2951 thereof are turned on at timings in conformity with a rotational movement of the photosensitive drum 21, that is, at timings in conformity with a movement of the photosensitive member surface in the sub scanning direction SD. Specifically, the turn-on timings of the light emitting element rows 2951R constituting the light emitting element groups 295_A1, 295_A2, 295_A3 and 295_B1 are differentiated as follows in conformity with the rotational movement of the photosensitive drum 21.

The light emitting element rows 2951R are controlled to be turned on based on:

(a) Timing T11: Turn-on timing of the upper light emitting element row 2951R of the light emitting element group 295_A3, (b) Timing T12: Turn-on timing of the lower light emitting element row 2951R of the light emitting element group 295_A3, (c) Timing T13: Turn-on timing of the upper light emitting element row 2951R of the light emitting element group 295_A2, (d) Timing T14: Turn-on timing of the lower light emitting element row 2951R of the light emitting element group 295_A2, (e) Timing T15: Turn-on timing of the upper light emitting element rows 2951R of the light emitting element groups 295_A1, 295_B1, and (f) Timing T16: Turn-on timing of the lower light emitting element rows 2951R of the light emitting element groups 295_A1, 295_B1.

By the timing adjustment in this way, the spots SP can be aligned in a line in the main scanning direction MD.

As shown in FIGS. 15 and 16, the exposure regions adjacent in the main scanning direction MD partly overlap in the main scanning direction MD to form overlapping exposure regions EX_OR in the second embodiment. For example, exposure regions EX_A1, EX_A2 adjacent in the main scanning direction MD partly overlap to form the overlapping exposure region EX_OR. In the second embodiment, the width of the overlapping exposure regions EX_OR in the main scanning direction MD is equal to or larger than the spot pitch (Psp=m·Pel) in the main scanning direction MD (twice the spot pitch (2·Psp=2·m·Pel) in FIGS. 15 and 16).

As described above, similar to the first embodiment, the plurality of microlenses ML are arranged to face one chip CP in the line head 29 in the second embodiment as well. Thus, as compared with the case where one microlens ML is arranged to face one chip CP, the number of the chips CP required by the line head 29 according to the second embodiment is smaller. This is because the line head, in which one microlens ML is arranged to face one chip CP, requires as many chips CP as the microlenses ML, but the plurality of microlenses ML are arranged to face each chip CP in the line head 29 and the number of the necessary chips CP is suppressed to substantially half or smaller than the number of the microlenses ML according to the second embodiment. Therefore, with the line head 29 according to the second embodiment, it is possible to reduce time and cost required for assembling by suppressing the bonding number of the chips CP in the assembling of the line head 29.

Further, in the line head 29 of the second embodiment, the exposure regions adjacent in the main scanning direction MD partly overlap in the main scanning direction MD to form the overlapping exposure regions EX_OR. Thus, the line head 29 of the second embodiment has additional function and effect of enabling a good exposure operation even if the characteristics of the microlenses ML are deviated from the desired ones. This is described in detail below.

In the above line head 29, the respective microlenses ML can expose the corresponding exposure regions by focusing light beams from the light emitting element groups 295 that the microlenses ML are facing. However, in such a line head 29, there are cases where the characteristics of the microlenses ML deviate from the desired ones (an occurrence of a characteristic deviation).

The cause of such a characteristic deviation of the microlens ML may, for example, include a deviation of the relative positional relationship of the microlens ML and the light emitting element group 295 facing the microlens ML from the desired one. Upon the deviation of the relative positional relationship of the microlens ML and the light emitting element group 295, the positions of the exposure region exposed by focusing the light beams from the light emitting element group 295 by the microlens ML also deviate. As shown in FIG. 6, the microlens ML includes two lenses 2993A, 2993B opposed to each other, and these two lenses 2993A, 2993B have a common optical axis OA. However, there are cases where the optical axes OA of the two lenses 2993A, 2993B deviate from each other, with the result that the characteristic of the microlens ML may possibly deviate from the desired one. If the characteristic of the microlens ML deviates, the position of the exposure region exposed by the microlens ML also deviates.

In the above line head 29, light beams are emitted from the light emitting elements 2951 at the facing positions FP of the respective plurality of chips CP in conformity with a movement of the photosensitive member surface in a sub scanning direction SD (first direction). The light beams emitted from the facing positions FP are focused by the microlenses ML facing the facing positions FP, whereby the line head 29 can expose the exposure regions. Since exposure regions adjacent in the sub scanning direction SD can be exposed by the same microlens ML in such a line head 29, almost no positional deviation occurs between the exposure regions adjacent in the sub scanning direction SD. However, in the main scanning direction MD (second direction) orthogonal to the sub scanning direction SD, adjacent exposure regions are exposed by mutually different microlenses ML. Thus, in the line head to which the invention is not applied, there is a possibility of forming clearances between exposure regions adjacent in the main scanning direction MD due to the characteristic deviations of the microlenses ML. If the exposure operation is performed while the photosensitive member surface is moved in the sub scanning direction SD in such a condition where the clearances are formed in the main scanning direction MD, such clearances may be possibly connected one after another in the sub scanning direction SD to induce so-called vertical lines.

In view of such a problem, the line head 29 of the second embodiment forms the overlapping exposure regions EX_OR. Mutually different microlenses ML can form spots SP in an overlapping manner in such overlapping exposure regions EX_OR. Accordingly, in the second embodiment, overlapping spot regions OR are formed in the overlapping exposure regions EX_OR by forming spots in the overlapping exposure regions EX_OR in an overlapping manner by mutually different microlenses ML.

FIG. 17 is a diagram showing a two-dimensional latent image obtained in the case of forming the overlapping spot regions in the overlapping exposure regions. Specifically, in the case of forming the overlapping spot regions OR in the overlapping exposure regions EX_OR, a two-dimensional latent image L1 as shown in FIG. 17 can be obtained. Since the width of the overlapping exposure regions EX_OR in the main scanning direction MD is twice the spot pitch in the second embodiment, each overlapping spot region OR can be formed by arranging two spots SP side by side in the main scanning direction MD (see spots SP_OR of FIG. 16). Thus, the formation of clearances between the spot groups SG can be prevented not only in the absence of the characteristic deviation of the microlenses ML (FIG. 17A), but also even upon the occurrence of deviations of the exposure regions due to the characteristic deviation of the microlenses ML (FIG. 17B). Therefore, spots can be satisfactorily formed. By performing image formation using such a line head 29, high-quality toner images can be formed without causing any vertical line.

In the above second embodiment, the overlapping spot regions OR are formed by actually forming all the spots, which can form the overlapping exposure regions EX_OR, in the overlapping exposure regions EX_OR. However, it is not essential to form the overlapping spot regions OR in the overlapping exposure regions EX_OR in this way, and the line head 29 may be constructed as described in the following third embodiment.

Third Embodiment

Figure 18:
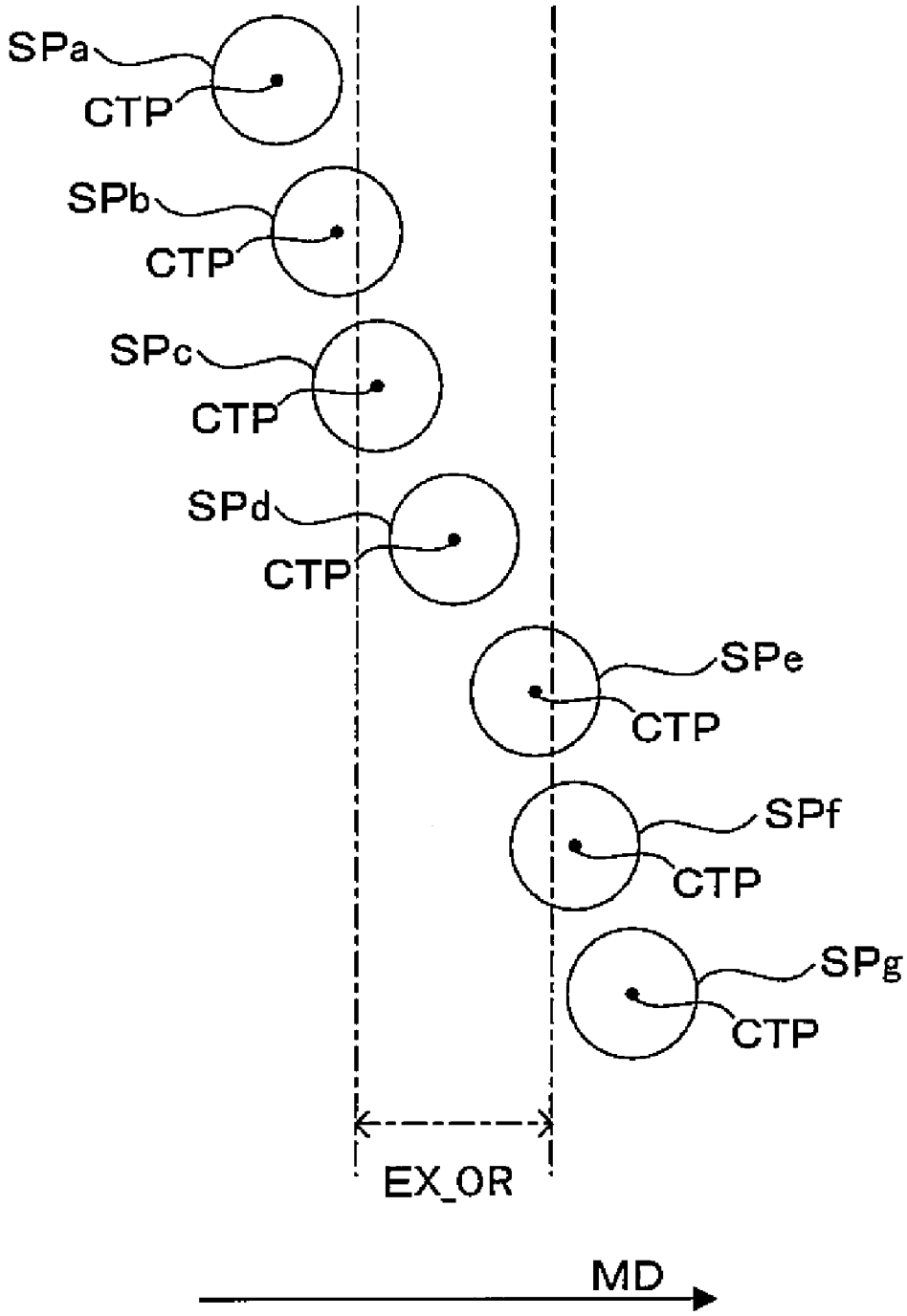
FIG. 18 is a diagram showing spots which can be formed in an overlapping exposure region EX_OR.

FIG. 18 is a diagram showing spots which can be formed in an overlapping exposure region EX_OR. Before describing the specific content of the third embodiment, the spots that can be formed in the overlapping exposure region EX_OR are described. In other words, the spots that can be formed in the overlapping exposure region EX_OR are defined as shown in FIG. 18. Specifically, when a center CTP of a spot SP is located in the overlapping exposure region EX_OR in a main scanning direction MD, the spot is located in the overlapping exposure region EX_OR. On the other hand, when the center CTP of the spot SP is located outside the overlapping exposure region EX_OR, the spot SP is located outside the overlapping exposure region EX_OR. More specifically, with reference to FIG. 18, spots SPc, SPd, SPe are located in the overlapping exposure region EX_OR and spots SPa, SPb, SPf, SPg are located outside the overlapping exposure region EX_OR.

FIGS. 19, 20, 21 and 22 are diagrams showing an exposure operation in the third embodiment. The third embodiment is similar to the second embodiment in that exposure regions adjacent in the main scanning direction MD partly overlap in the main scanning direction MD to form overlapping exposure regions EX_OR, but differs therefrom in spot forming operation in the overlapping exposure regions EX_OR. In other words, as described below, a line head 29 of the third embodiment performs an exposure operation by selecting spots SP to be actually formed from a plurality of spots SP which can be formed in the overlapping exposure regions EX_OR.

Figure 19:
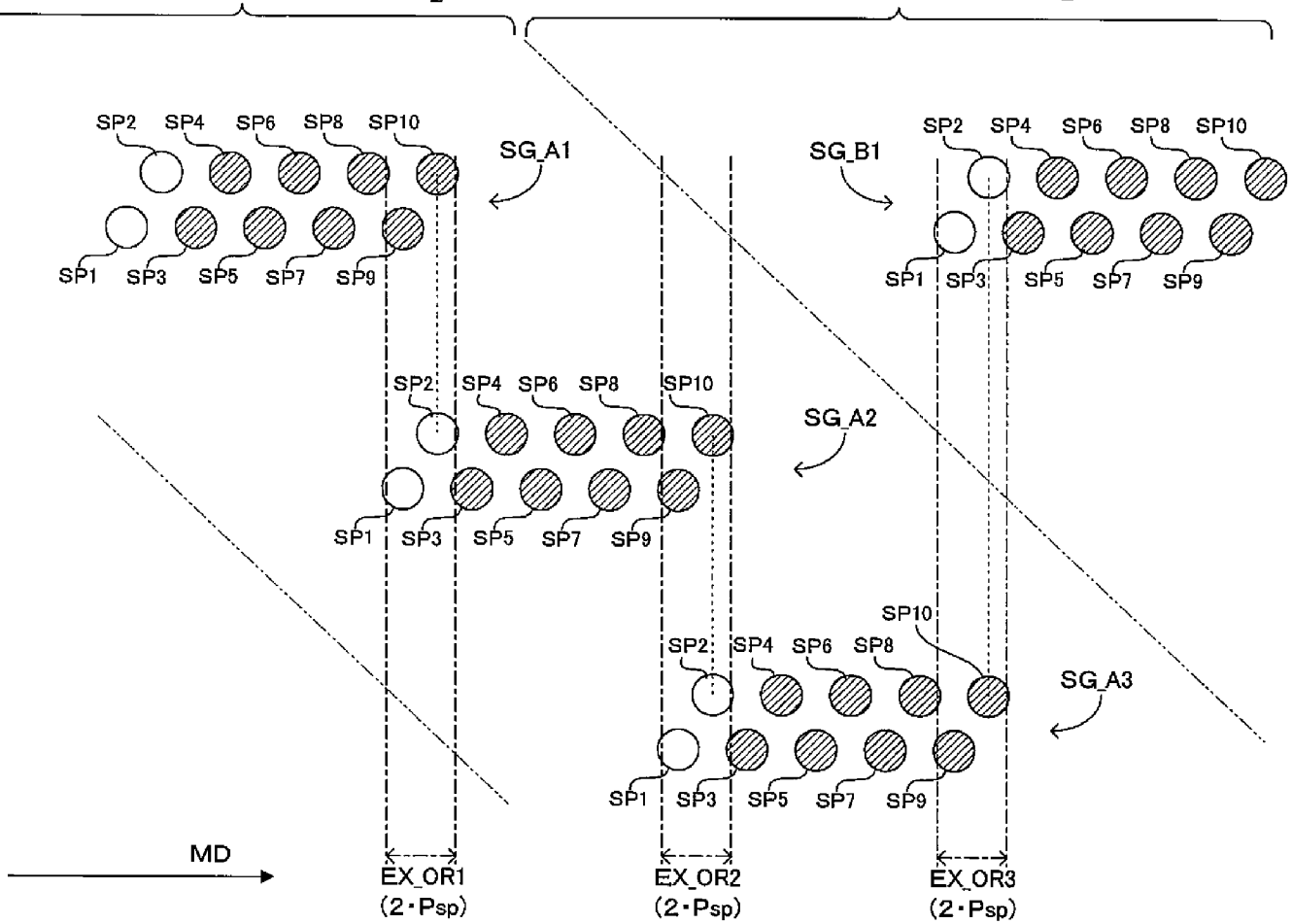
FIGS. 19, 20, 21 and 22 are diagrams showing an exposure operation in the third embodiment.

FIG. 19 corresponds to the case where there is neither the characteristic deviation of microlenses ML, nor the positional deviation of the exposure regions. In this case, the width in the main scanning direction MD of an overlapping exposure region EX_OR1 formed by overlapping an exposure region that can be exposed by a light emitting element group 295_A1 and the one that can be exposed by a light emitting element group 295_A2 is twice the spot pitch Psp (2·Psp). Four spots, that is, spots SP9, SP10 of a spot group SG_A1 and spots SP1, SP2 of a spot group SG_A2 can be formed in the overlapping exposure region EX_OR1. In FIG. 19, out of these four spots that can be formed in the overlapping exposure region EX_OR1, only the spots SP9, SP10 of the spot group SG_A1 are actually formed in the overlapping exposure region EX_OR1, and the spots SP1, SP2 of the spot group SG_A2 are not formed. Here, solid-line circles in FIG. 19 represent the spots SP that can be formed. Out of these solid-line circles, those having the insides hatched represent the spots to be actually formed, and those having blank insides represent the spots not to be actually formed. The meanings of the solid-line circles are the same also in FIGS. 20 to 22. In this way, in FIG. 19, the exposure operation is performed by selecting the spots SP to be actually formed from the plurality of spots SP that can be formed in the overlapping exposure region EX_OR1.

For overlapping exposure regions EX_OR2, EX_OR3 also, exposure operations are performed by selecting spots SP to be actually formed from a plurality of spots that can be formed in these overlapping exposure regions. Specifically, out of the plurality of spots that can be formed in the overlapping exposure region EX_OR2, only spots SP9, S10 of the spot group SG_A2 are formed in the overlapping exposure region EX_OR2, and spots SP1, SP2 of a spot group SG_A3 are not formed. Further, out of the plurality of spots that can be formed in the overlapping exposure region EX_OR3, only spots SP9, S10 of the spot group SG_A3 are formed in the overlapping exposure region EX_OR3, and spots SP1, SP2 of a spot group SG_B1 are not formed.

Figure 20:
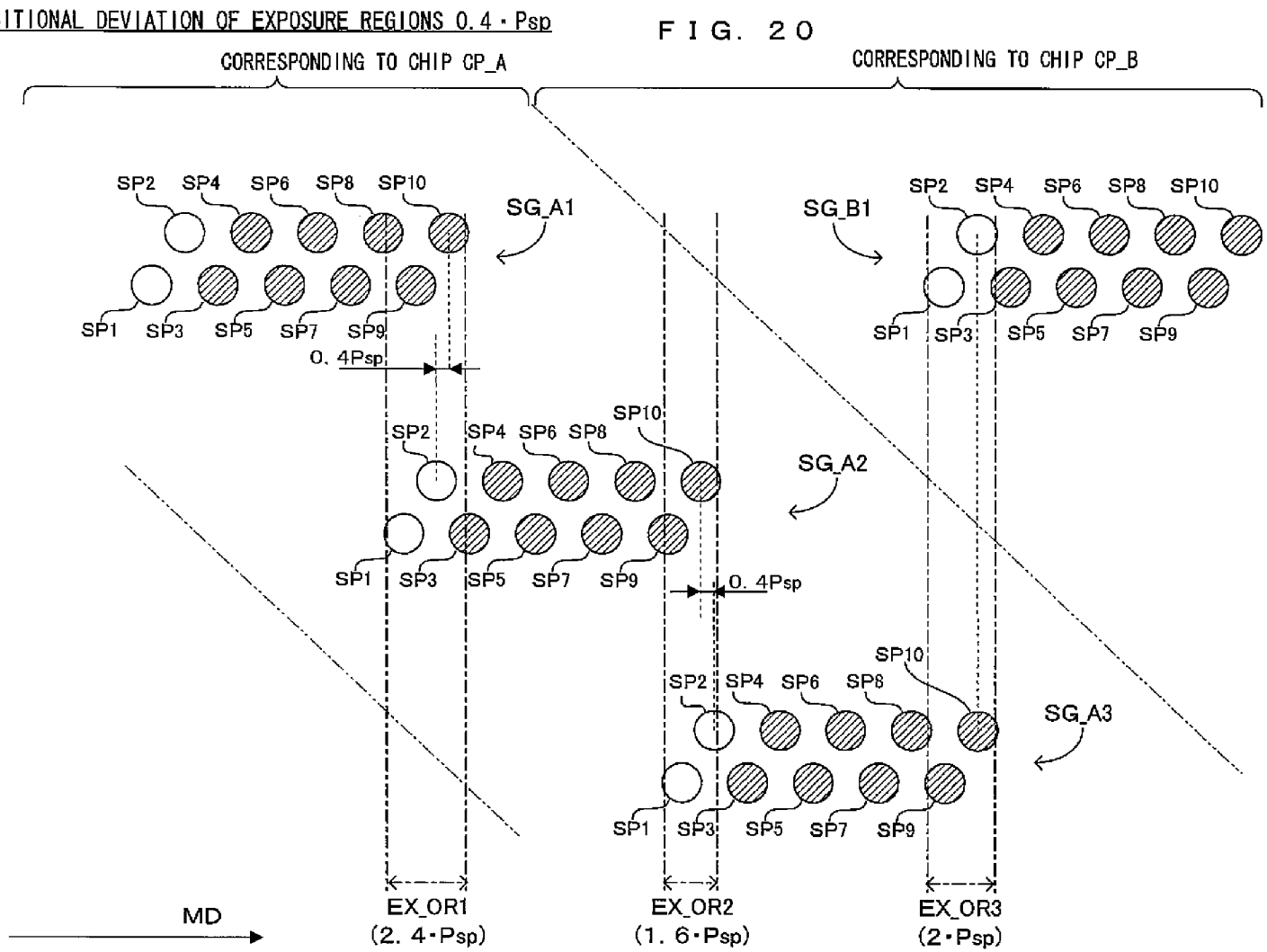

FIG. 20 corresponds to the case where the characteristic of the microlens ML facing the light emitting element group 295_A2 deviates, with the result that the exposure region corresponding to the light emitting element group 295_A2 is displaced by 0.4-fold of the spot pitch Psp (0.4·Psp) in the main scanning direction MD. In this case, the width of the overlapping exposure region EX_OR1 of the exposure region corresponding to the light emitting element group 295_A1 and the one corresponding to the light emitting element group 295_A2 in the main scanning direction MD is 2.4-fold of the spot pitch Psp (2.4·Psp). Four spots, that is, the spots SP9, SP10 of the spot group SG_A1 and the spots SP1, SP2 of the spot group SG_A2 can be formed in this overlapping exposure region EX_OR1. In FIG. 20, out of these four spots that can be formed in the overlapping exposure region EX_OR1, the spots SP9, SP10 of the spot group SG_A1 are actually formed in the overlapping exposure region EX_OR1, but the spots SP1, SP2 of the spot group SG_A2 are not formed.

In FIG. 20, the width of the overlapping exposure region EX_OR2 of the exposure region corresponding to the light emitting element group 295_A2 and the one corresponding to the light emitting element group 295_A3 in the main scanning direction MD is 1.6-fold of the spot pitch Psp (1.6·Psp). Four spots, that is, the spots SP9, SP10 of the spot group SG_A2 and the spots SP1, SP2 of the spot group SG_A3 can be formed in this overlapping exposure region EX_OR2. In FIG. 20, out of these four spots that can be formed in the overlapping exposure region EX_OR2, the spots SP9, SP10 of the spot group SG_A2 are actually formed in the overlapping exposure region EX_OR2, but the spots SP1, SP2 of the spot group SG_A3 are not formed.

In FIG. 20, the width of the overlapping exposure region EX_OR3 of the exposure region corresponding to the light emitting element group 295_A3 and the one corresponding to the light emitting element group 295_B1 in the main scanning direction MD is 2-fold of the spot pitch Psp (2·Psp). Four spots, that is, the spots SP9, SP10 of the spot group SG_A3 and the spots SP1, SP2 of the spot group SG_B1 can be formed in this overlapping exposure region EX_OR3. In FIG. 20, out of these four spots that can be formed in the overlapping exposure region EX_OR3, the spots SP9, SP10 of the spot group SG_A3 are actually formed in the overlapping exposure region EX_OR3, but the spots SP1, SP2 of the spot group SG_B1 are not formed.

Figure 21:
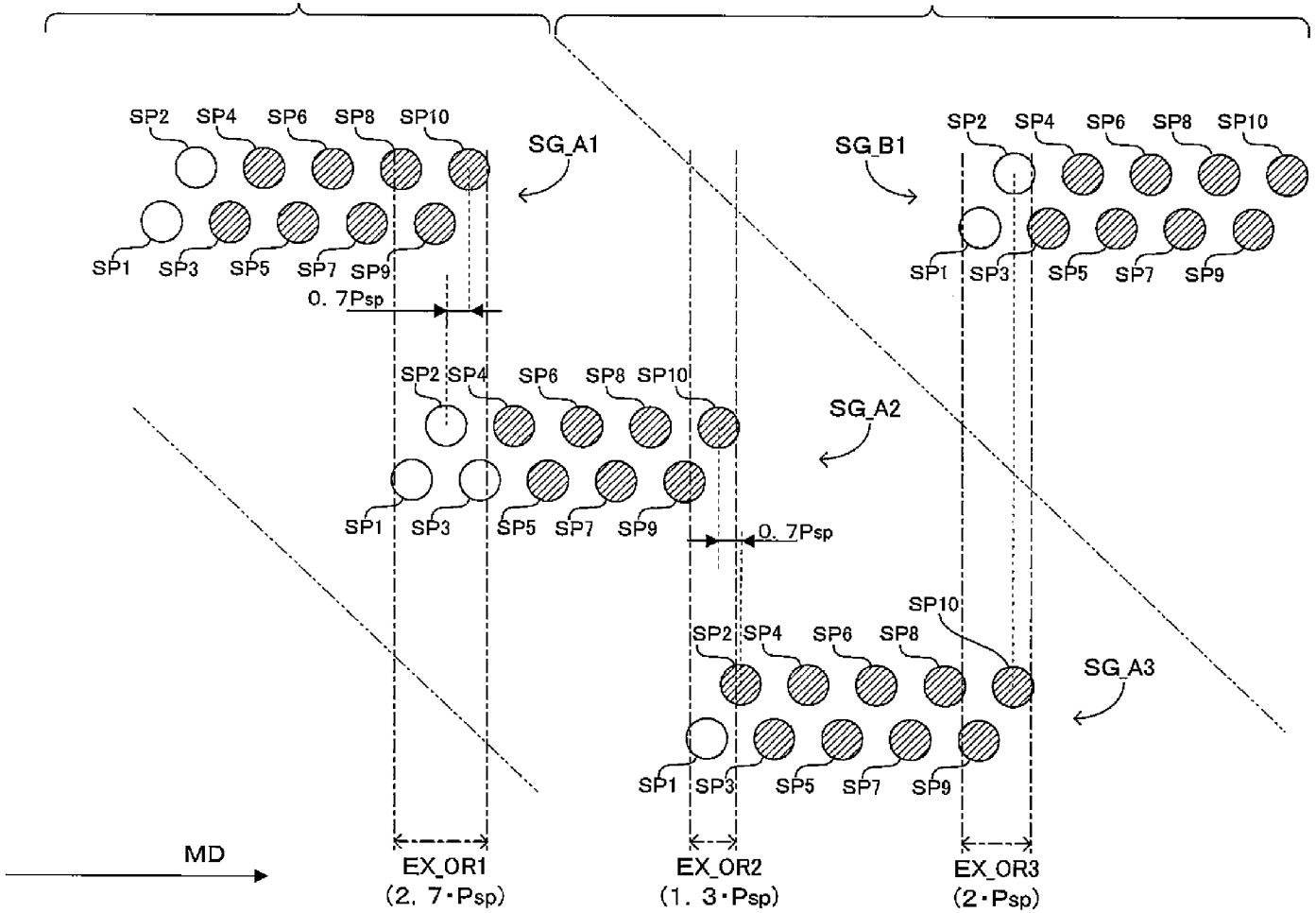

FIG. 21 corresponds to the case where the characteristic of the microlens ML facing the light emitting element group 295_A2 deviates, with the result that the exposure region corresponding to the light emitting element group 295_A2 is displaced by 0.7-fold of the spot pitch Psp (0.7·Psp) in the main scanning direction MD. In this case, the width of the overlapping exposure region EX_OR1 of the exposure region corresponding to the light emitting element group 295_A1 and the one corresponding to the light emitting element group 295_A2 in the main scanning direction MD is 2.7-fold of the spot pitch Psp (2.7·Psp). Six spots, that is, the spots SP8, SP9, SP10 of the spot group SG_A1 and the spots SP1, SP2, SP3 of the spot group SG_A2 can be formed in this overlapping exposure region EX_OR1. In FIG. 21, out of these six spots that can be formed in the overlapping exposure region EX_OR1, the spots SP8, SP9, SP10 of the spot group SG_A1 are actually formed in the overlapping exposure region EX_OR1, but the spots SP1, SP2, SP3 of the spot group SG_A2 are not formed.

Further, in FIG. 21, the width of the overlapping exposure region EX_OR2 of the exposure region corresponding to the light emitting element group 295_A2 and the one corresponding to the light emitting element group 295_A3 in the main scanning direction MD is 1.3-fold of the spot pitch Psp (1.3·Psp). Two spots, that is, the spot SP10 of the spot group SG_A2 and the spot SP1 of the spot group SG_A3 can be formed in this overlapping exposure region EX_OR2. In FIG. 21, out of these two spots that can be formed in the overlapping exposure region EX_OR2, the spot SP10 of the spot group SG_A2 is actually formed in the overlapping exposure region EX_OR2, but the spot SP1 of the spot group SG_A3 is not formed.

Furthermore, in FIG. 21, the width of the overlapping exposure region EX_OR3 of the exposure region corresponding to the light emitting element group 295_A3 and the one corresponding to the light emitting element group 295_B1 in the main scanning direction MD is 2-fold of the spot pitch Psp (2·Psp). Four spots, that is, the spots SP9, SP10 of the spot group SG_A3 and the spots SP1, SP2 of the spot group SG_B1 can be formed in this overlapping exposure region EX_OR3. In FIG. 21, out of these four spots that can be formed in the overlapping exposure region EX_OR3, the spots SP9, SP10 of the spot group SG_A3 are actually formed in the overlapping exposure region EX_OR3, but the spots SP1, SP2 of the spot group SG_B1 are not formed.

Figure 22:
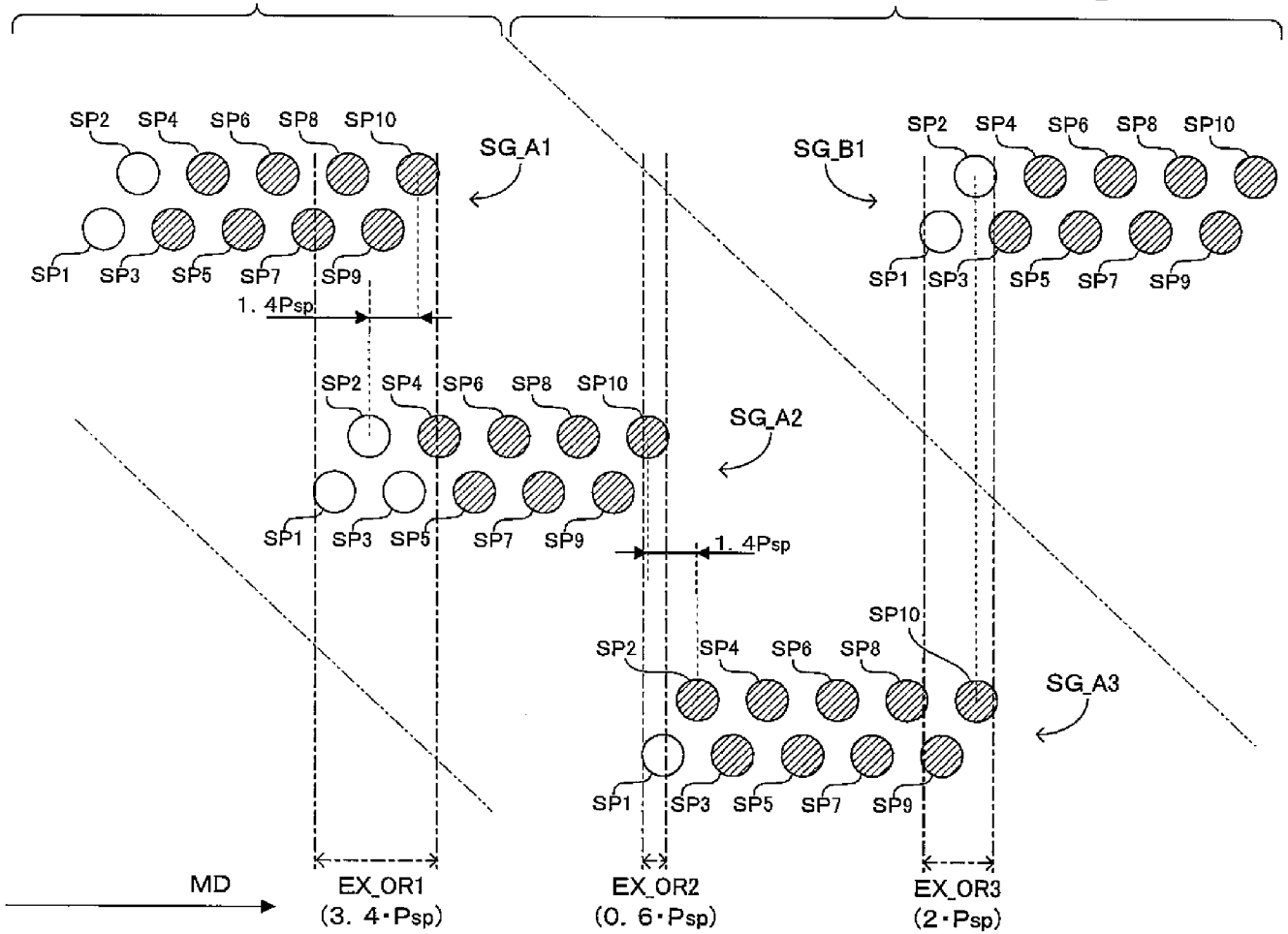

FIG. 22 corresponds to the case where the characteristic of the microlens ML facing the light emitting element group 295_A2 deviates, with the result that the exposure region corresponding to the light emitting element group 295_A2 is displaced by 1.4-fold of the spot pitch Psp (1.4·Psp) in the main scanning direction MD. In this case, the width of the overlapping exposure region EX_OR1 of the exposure region corresponding to the light emitting element group 295_A1 and the one corresponding to the light emitting element group 295_A2 in the main scanning direction MD is 3.4-fold of the spot pitch Psp (3.4·Psp). Six spots, that is, the spots SP8, SP9, SP10 of the spot group SG_A1 and the spots SP1, SP2, SP3 of the spot group SG_A2 can be formed in this overlapping exposure region EX_OR1. In FIG. 22, out of these six spots that can be formed in the overlapping exposure region EX_OR1, the spots SP8, SP9, SP10 of the spot group SG_A1 are actually formed in the overlapping exposure region EX_OR1, but the spots SP1, SP2, SP3 of the spot group SG_A2 are not formed.

Further, in FIG. 22, the width of the overlapping exposure region EX_OR2 of the exposure region corresponding to the light emitting element group 295_A2 and the one corresponding to the light emitting element group 295_A3 in the main scanning direction MD is 0.6-fold of the spot pitch Psp (0.6·Psp). Two spots, that is, the spot SP10 of the spot group SG_A2 and the spot SP1 of the spot group SG_A3 can be formed in this overlapping exposure region EX_OR2. In FIG. 22, out of these two spots that can be formed in the overlapping exposure region EX_OR2, the spot SP10 of the spot group SG_A2 is actually formed in the overlapping exposure region EX_OR2, but the spot SP1 of the spot group SG_A3 is not formed.

Furthermore, in FIG. 22, the width of the overlapping exposure region EX_OR3 of the exposure region corresponding to the light emitting element group 295_A3 and the one corresponding to the light emitting element group 295_B1 in the main scanning direction MD is 2-fold of the spot pitch Psp (2·Psp). Four spots, that is, the spots SP9, SP10 of the spot group SG_A3 and the spots SP1, SP2 of the spot group SG_B1 can be formed in this overlapping exposure region EX_OR3. In FIG. 22, out of these four spots that can be formed in the overlapping exposure region EX_OR3, the spots SP9, SP10 of the spot group SG_A3 are actually formed in the overlapping exposure region EX_OR3, but the spots SP1, SP2 of the spot group SG_B1 are not formed.

As described above, similar to the second embodiment, the exposure regions adjacent in the main scanning direction MD partly overlap in the main scanning direction MD to form the overlapping exposure regions EX_OR in the third embodiment as well. Thus, even if the characteristics of the microlenses ML deviate to slightly displace the positions of the exposure regions, the formation of clearances between adjacent exposure regions is suppressed. The line head 29 according to the third embodiment can suppress the formation of vertical lines resulting from such clearances between the exposure regions.

Further, the line head 29 according to the third embodiment performs the exposure operation by selecting the spots SP to be actually formed out of the plurality of spots SP that can be formed in the overlapping exposure regions EX_OR. In other words, the light emitting elements 2951 are selected from the plurality of light emitting elements 2951 that can expose the overlapping exposure regions EX_OR and spots are formed (that is, the exposure operation is performed) in the overlapping exposure regions EX_OR by emitting light beams only from the selected light emitting elements upon exposing the overlapping exposure regions EX_OR. This brings about the following effect. Specifically, an occurrence of a situation where the overlapping exposure regions EX_OR are excessively exposed is suppressed by suitably adjusting the number of spots contributing to the exposure of the overlapping exposure regions EX_OR. By forming images using such a line head 29, satisfactory image formation is possible.

Fourth Embodiment

Figure 23:
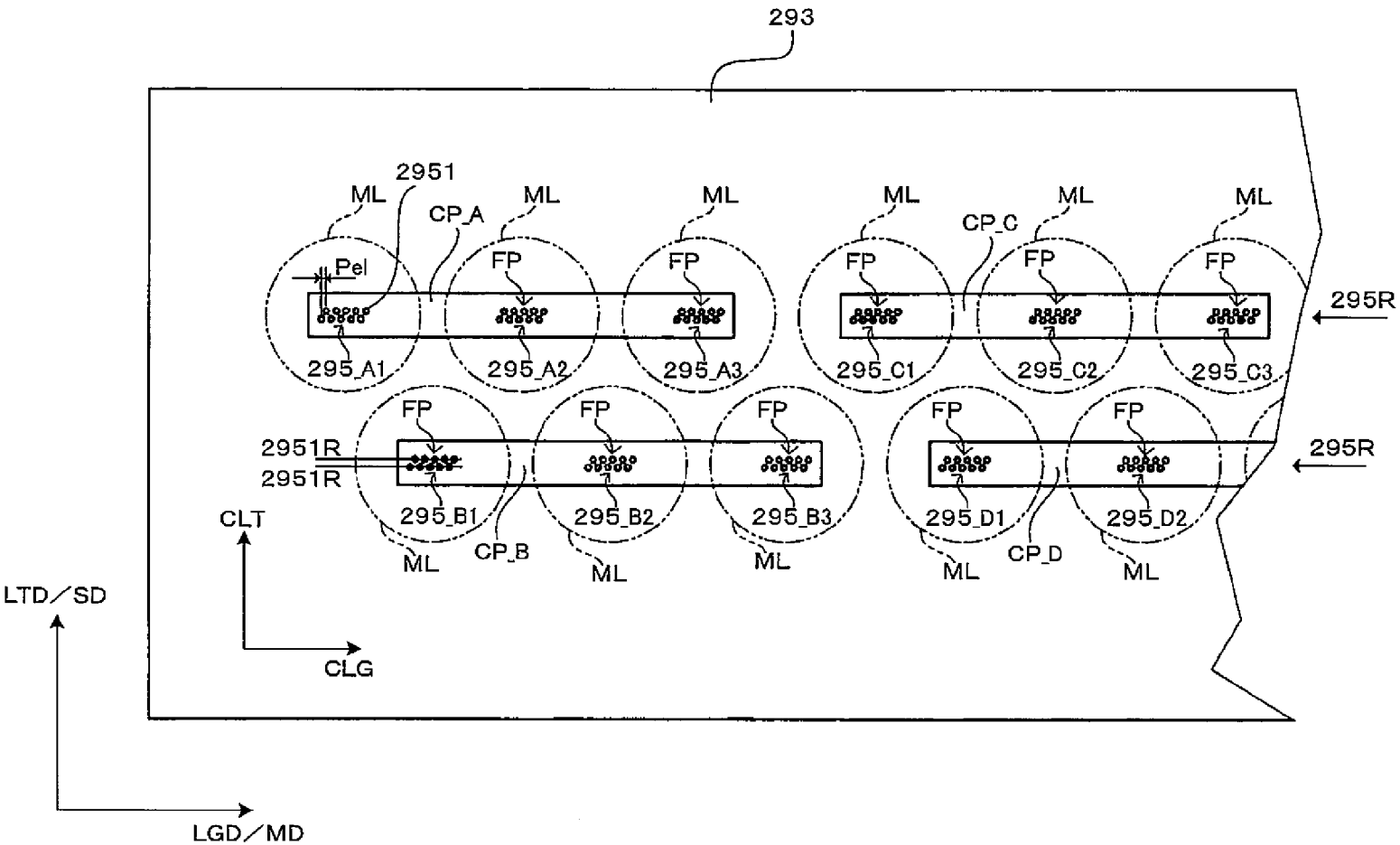
FIG. 23 is a diagram showing the arrangement of chips in a fourth embodiment.

FIG. 23 is a diagram showing the arrangement of chips in a fourth embodiment. In the following description, points of difference from the above embodiments are mainly described and similar parts are not described by being identified by suitable reference numerals. As shown in FIG. 23, a plurality of chips CP_A, CP_B, CP_C, . . . are arranged on the top surface of a head substrate 293. The respective chips CP are arranged such that the longitudinal axes CLG thereof are parallel to the longitudinal direction LGD and the lateral axes CLT thereof are parallel to the width direction LTD. A plurality of microlenses ML are arranged to face each chip CP. In other words, a plurality of (three in FIG. 23) microlenses ML of the microlens array 299 face one chip CP. Each chip CP includes light emitting element groups 295 at facing positions FP that the microlenses ML are facing. Since three microlenses ML face one chip CP in FIG. 23, three light emitting element groups 295 are formed on one chip CP. For example, the light emitting element groups 295_A1 to 295_A3 are formed side by side in the longitudinal direction LGD on the chip CP_A; the light emitting element groups 295_B1 to 295_B3 on the chip CP_B; and the light emitting element groups 295_C1 to 295_C3 on the chip CP_C. In each light emitting element group 295, five light emitting elements 2951 are aligned in the longitudinal direction LGD to form a light emitting element row 2951R, and two light emitting element rows 2951R are arranged in the width direction LTD.

Unlike the first to third embodiments, the two light emitting element group rows 295R are arranged in the width direction LTD in the fourth embodiment. Specifically, the chips CP_A, CP_C, . . . are aligned at specified pitches in the longitudinal direction LGD to form one light emitting element group row 295R, and the chips CP_B, CP_D, . . . are arranged at specified pitches in the longitudinal direction LGD to form one light emitting element group row 295R. The light emitting element group rows 295R thus formed are arranged at mutually different positions in the width direction LTD.

Figure 24:
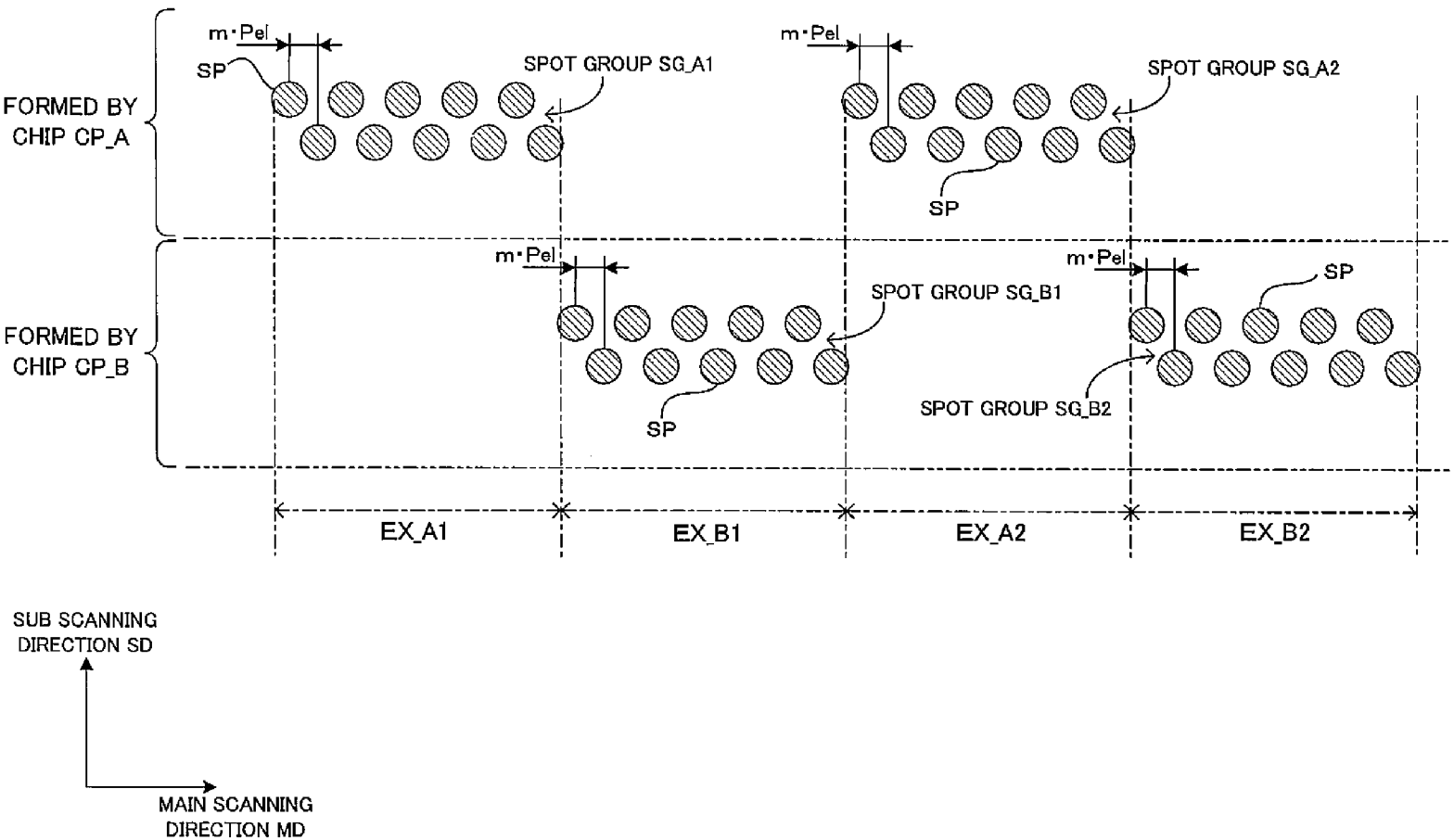
FIG. 24 is a diagram showing the positions of spots formed on a photosensitive member surface by the line head according to the fourth embodiment.

FIG. 24 is a diagram showing the positions of spots formed on a photosensitive member surface by the line head according to the fourth embodiment. A state where spots are formed by four light emitting element groups, that is, the light emitting element groups 295_A1, 295_B1, 295_A2 and 295_B2 in FIG. 23 for instance is diagrammatically shown. A spot group SG_A1 in FIG. 24 represents a group of spots SP formed by the light emitting element group 295_A1; a spot group SG_B1 represents a group of spots SP formed by the light emitting element group 295_B1; a spot group SG_A2 represents a group of spots SP formed by the light emitting element group 295_A2; and a spot group SG_B2 represents a group of spots SP formed by the light emitting element group 295_B2. In other words, the spot groups SG_A1, SG_A2 are formed by the chip CP_A; and the spot groups SG_B1, SG_B2 are formed by the chip CP_B. If the light emitting elements 2951 are simultaneously turned on as shown in FIG. 24, the spot groups SG_A1, SG_B1, SG_A2 and SG_B2 formed on the photosensitive member surface are also two-dimensionally arranged. Accordingly, similar to the first to third embodiments, the turn-on timings of the light emitting element rows 2951R are controlled in the fourth embodiment as well. Such a timing control is not described since being similar to the above.

As described above, in the line head 29 according to the fourth embodiment as well, the plurality of microlenses ML are arranged to face one chip CP. Therefore, it is possible to reduce time and cost required for assembling by suppressing the bonding number of the chips CP in the assembling of the line head 29.

Further, on the chip CP (first substrate), a plurality of light emitting element groups 295 are arranged in the longitudinal direction LGD (second direction). In other words, the light emitting element groups 295 arranged in the longitudinal direction LGD are formed on the same chip CP. Thus, these light emitting element groups 295 can be arranged in the longitudinal direction LGD with high positional accuracy, thereby enabling good exposure.

Fifth Embodiment

Figure 25A:
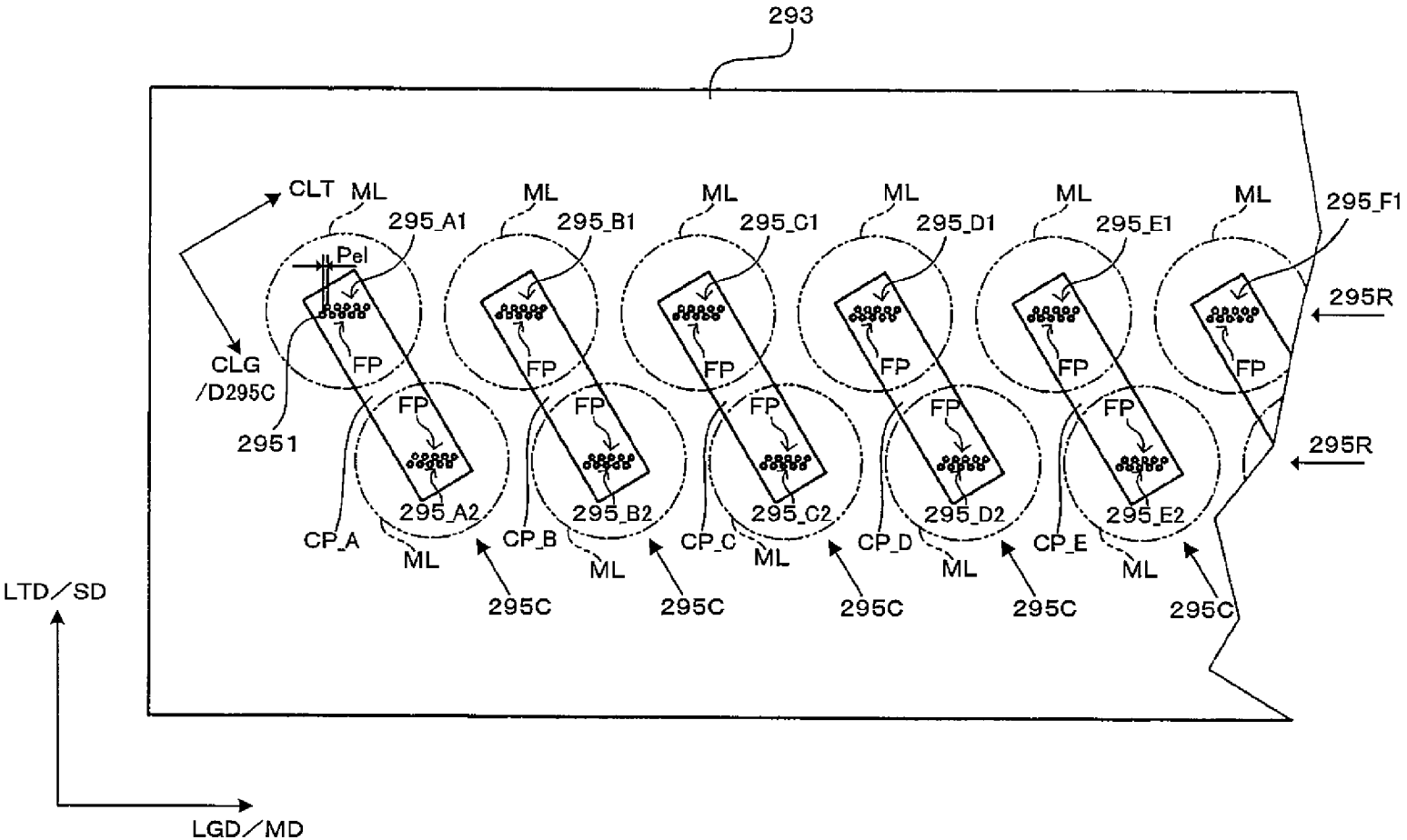
FIGS. 25A and 25B are diagrams showing the arrangement of chips in a fifth embodiment.
Figure 25B:
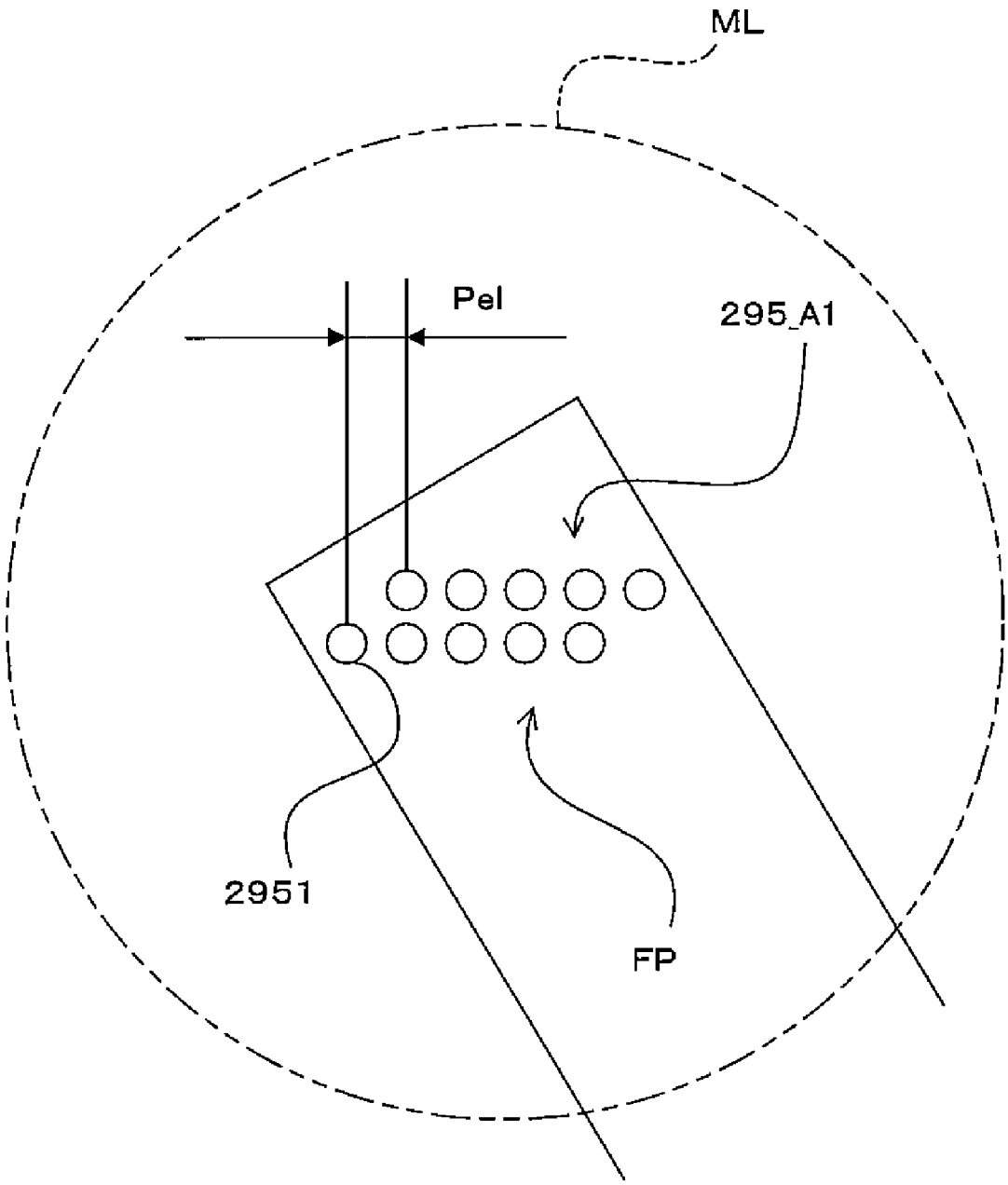

FIGS. 25A and 25B are diagrams showing the arrangement of chips in a fifth embodiment. FIG. 25B is a partial enlarged view of FIG. 25A. In the following description, points of difference from the above embodiments are mainly described and similar parts are not described by being identified by suitable reference numerals. As shown in FIG. 25, the fifth embodiment is similar to the fourth embodiment in that the number of the light emitting element group rows 295R is two, but differs therefrom in the following point. Specifically, a line head 29 of the fifth embodiment and the line head 29 of the fourth embodiment differ in the construction of the chips CP and the arrangement mode of the chips CP on the head substrate 293. More specifically, each chip CP of the fifth embodiment is formed with a light emitting element group column 295C comprised of two light emitting element groups 295. At this time, the light emitting element group column 295C is formed on the chip CP such that an extending direction D295C of the light emitting element group column 295C (that is, arrangement direction D295C of the light emitting element groups 295 in the light emitting element group column 295C) is parallel to the chip longitudinal axis CLG of the chip CP.

A plurality of chips CP are arranged on the head substrate 293 in the longitudinal direction LGD. At this time, the respective chips CP are bonded to the top surface of the head substrate 293 such that the chip longitudinal axes CLG are parallel to the direction D295C. Therefore, the chip longitudinal axes CLG of the chips CP are inclined with respect to the longitudinal direction LGD of the line head 29 and the chip lateral axes CLT thereof are inclined with respect to the width direction LTD of the line head 29.

A plurality of microlenses ML are arranged to face each chip CP. In other words, in a microlens array 299, the plurality (two in FIG. 25) of microlenses ML are arranged to face one chip CP. Each chip CP includes the light emitting element groups 295 at positions FP that the microlenses ML are facing (that is, the plurality of microlenses ML are arranged in a one-to-one correspondence with the plurality of light emitting element groups 295). Since two microlenses ML face one chip CP in FIG. 25, two light emitting element groups 295 are formed on one chip CP. For example, the light emitting element groups 295_A1, 295_A2 are formed on the chip CP_A; the light emitting element groups 295_B1, 295_B2 on the chip CP_B; and the light emitting element groups 295_C1, 295_C2 on the chip CP_C.

As described above, in the line head 29 according to the fifth embodiment as well, the plurality of microlenses ML are arranged to face one chip CP. Therefore, it is possible to reduce time and cost required for assembling by suppressing the bonding number of the chips CP in the assembling of the line head 29.

Sixth Embodiment

Figure 26:
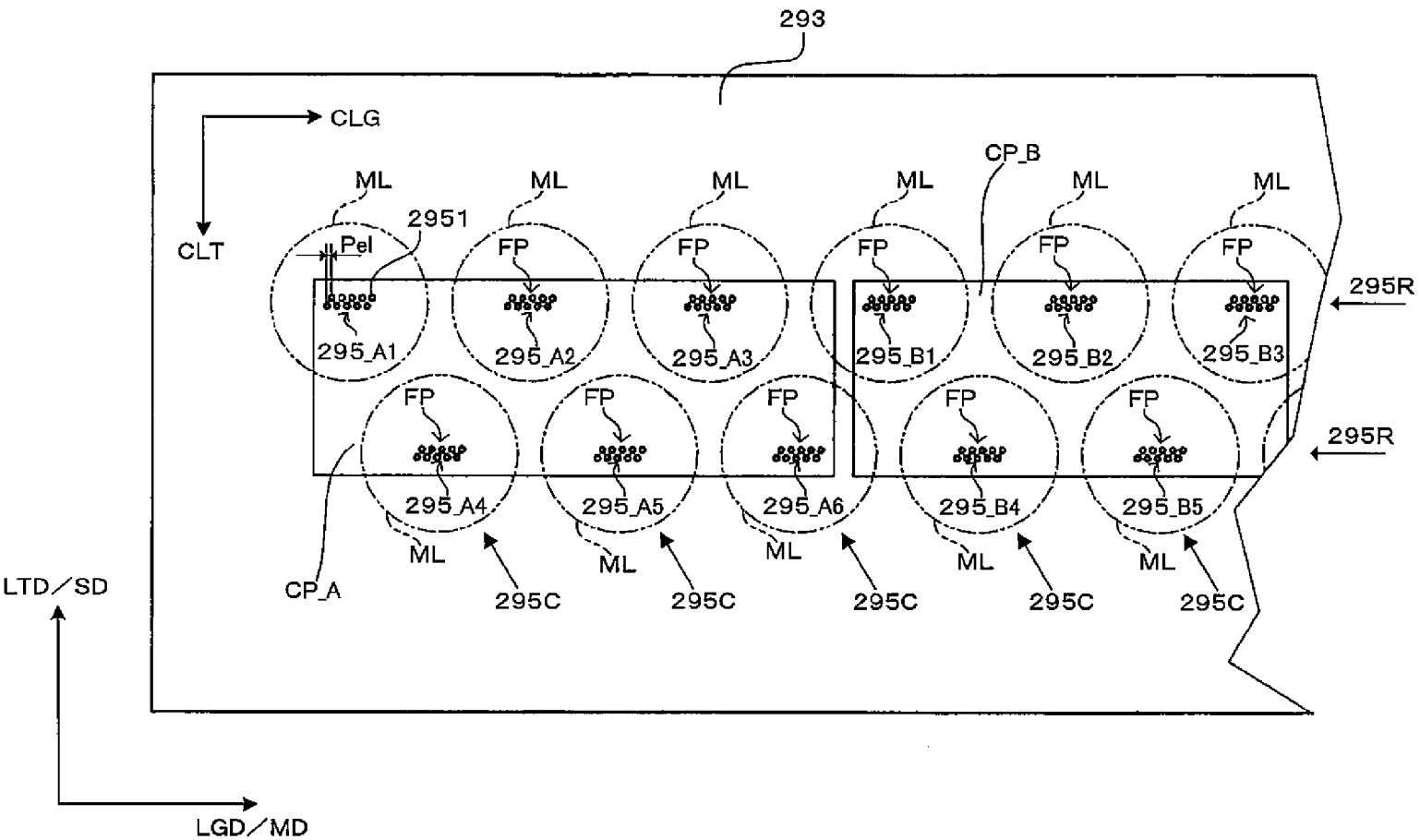
FIG. 26 is a diagram showing the arrangement of chips in a sixth embodiment.

FIG. 26 is a diagram showing the arrangement of chips in a sixth embodiment. In the following description, points of difference from the above embodiments are mainly described and similar parts are not described by being identified by suitable reference numerals. As shown in FIG. 26, the sixth embodiment is similar to the fourth and fifth embodiments in that the number of the light emitting element group rows 295R is two, but differs therefrom in the following point. Specifically, a line head 29 of the sixth embodiment and the line heads 29 of the fourth and fifth embodiments differ in the construction of the chips CP and the arrangement mode of the chips CP on the head substrate 293. More specifically, a plurality of (three in FIG. 26) light emitting element group columns 295C, each comprised of two light emitting element groups 295, are arranged in a chip longitudinal axis CLG on each chip CP of the sixth embodiment. For example, on a chip CP_A, one light emitting element group column 295C includes light emitting element groups 295_A1, 295_A4; one light emitting element group column 295C includes light emitting element groups 295_A2, 295_A5; and one light emitting element group column 295C includes light emitting element groups 295_A3, 295_A6. Three light emitting element group columns 295C thus formed are arranged in a chip longitudinal axis CLG.

A plurality of chips CP thus formed are arranged in the longitudinal direction LGD. At this time, the respective chips CP are bonded to the top surface of a head substrate 293 such that the chip longitudinal axes CLG are parallel to the longitudinal direction LGD and chip lateral axes CLT are parallel to the width direction LTD. Specifically, on each of the chips CP_A, . . . , a plurality of light emitting element groups 295_A1, 295_A2, 295_A3, . . . are arranged in the longitudinal direction LGD and a plurality of light emitting element groups 295_A1, 295_A4, . . . are arranged at different positions in the width direction LTD. Microlenses ML are arranged to face the respective light emitting element groups 295. As a result, a plurality of (six in FIG. 26) microlenses ML are arranged to face each chip CP.

As described above, in the line head 29 according to the sixth embodiment as well, the plurality of microlenses ML are arranged to face one chip CP. Therefore, it is possible to reduce time and cost required for assembling by suppressing the bonding number of the chips CP in the assembling of the line head 29.

Further, on the chip CP (first substrate), a plurality of light emitting element groups 295 (light emitting element groups 295_A1, 295_A2, 295_A3 for instance) are arranged in the longitudinal direction LGD (second direction). In other words, the light emitting element groups 295 arranged in the longitudinal direction LGD are formed on the same chip CP. Thus, these light emitting element groups 295 can be arranged in the longitudinal direction LGD with high positional accuracy, thereby enabling good exposure. Further, on the chip CP (first substrate), a plurality of light emitting element groups 295 (light emitting element groups 295_A1, 295_A4 for instance) are arranged at mutually different positions in the width direction LTD (first direction). Accordingly, a plurality of light emitting element groups 295 arranged at mutually different positions in the width direction LTD are provided on the same chip CP. Thus, these light emitting element groups 295 can be arranged at mutually different positions in the width direction LTD with high positional accuracy, thereby enabling good exposure.

Seventh Embodiment

Figure 27:
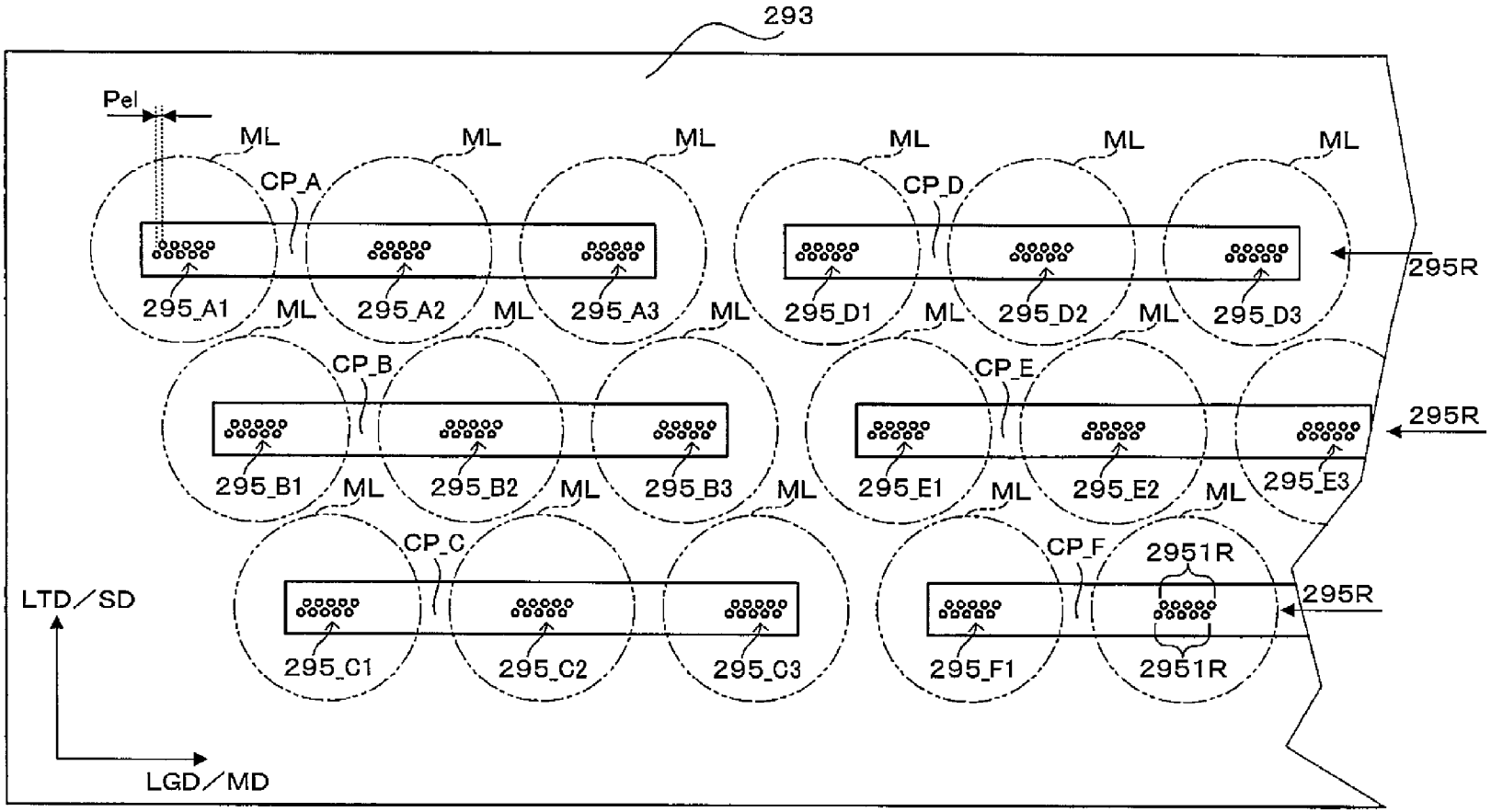
FIG. 27 is a diagram showing the arrangement of chips on a head substrate in a seventh embodiment.

FIG. 27 is a diagram showing the arrangement of chips on a head substrate in a seventh embodiment. As shown in FIG. 27, a plurality of chips CP_A, CP_B, CP_C, . . . are arranged on the top surface of a head substrate 293. The respective chips CP are arranged such that the longitudinal axes thereof are parallel to the longitudinal direction LGD and the lateral axes thereof are parallel to the width direction LTD. Each chip CP includes a plurality of (three in the seventh embodiment) light emitting element groups 295 arranged at specified pitches in the longitudinal direction LGD of a line head 29. Specifically, for example, light emitting element groups 295_A1 to 295_A3 are formed on the chip CP_A; light emitting element groups 295_B1 to 295_B3 on the chip CP_B; and light emitting element groups 295_C1 to 295_C3 on the chip CP_C.

On such a head substrate 293 having a plurality of chips CP bonded thereto, a plurality of light emitting element groups 295 are arranged in the longitudinal direction LGD while being spaced part from each other, thereby forming a light emitting element group row 295R. Further, a plurality of ("three" in the seventh embodiment) light emitting element group rows 295R are arranged in the width direction LTD. These three light emitting element group rows 295R are mutually displaced at specified pitches in the longitudinal direction LGD. As a result, the light emitting element groups 295 are two-dimensionally arranged and the positions thereof in the longitudinal direction LGD mutually differ. A plurality of microlenses ML are arranged in a one-to-one correspondence with these light emitting element groups 295.

Each light emitting element group 295 includes ten light emitting elements 2951, which are arranged as follows. Specifically, in each light emitting element group 295, five light emitting elements 2951 are aligned at specified pitches (=twice the element pitch Pel) in the longitudinal direction LGD to form a light emitting element row 2951R. Two light emitting element rows 2951R are arranged in the width direction LTD. Further, the light emitting element rows 2951R are displaced by the element pitches Pel in the longitudinal direction LGD. Thus, in each light emitting element group 295, all the light emitting elements 2951 are arranged at mutually different longitudinal positions displaced at the element pitches Pel. Accordingly, when light beams are emitted from all the ten light emitting elements 2951 of each light emitting element group 295, these light beams are imaged on a photosensitive member surface at mutually different positions in a main scanning direction MD by the microlens ML. In other words, by turning all the ten light emitting elements 2951 of the light emitting element group 295 on, a spot group can be formed in which ten spots are aligned in the main scanning direction MD. An area of the photosensitive member surface where the spot groups are formed is exposed.

Figure 28:
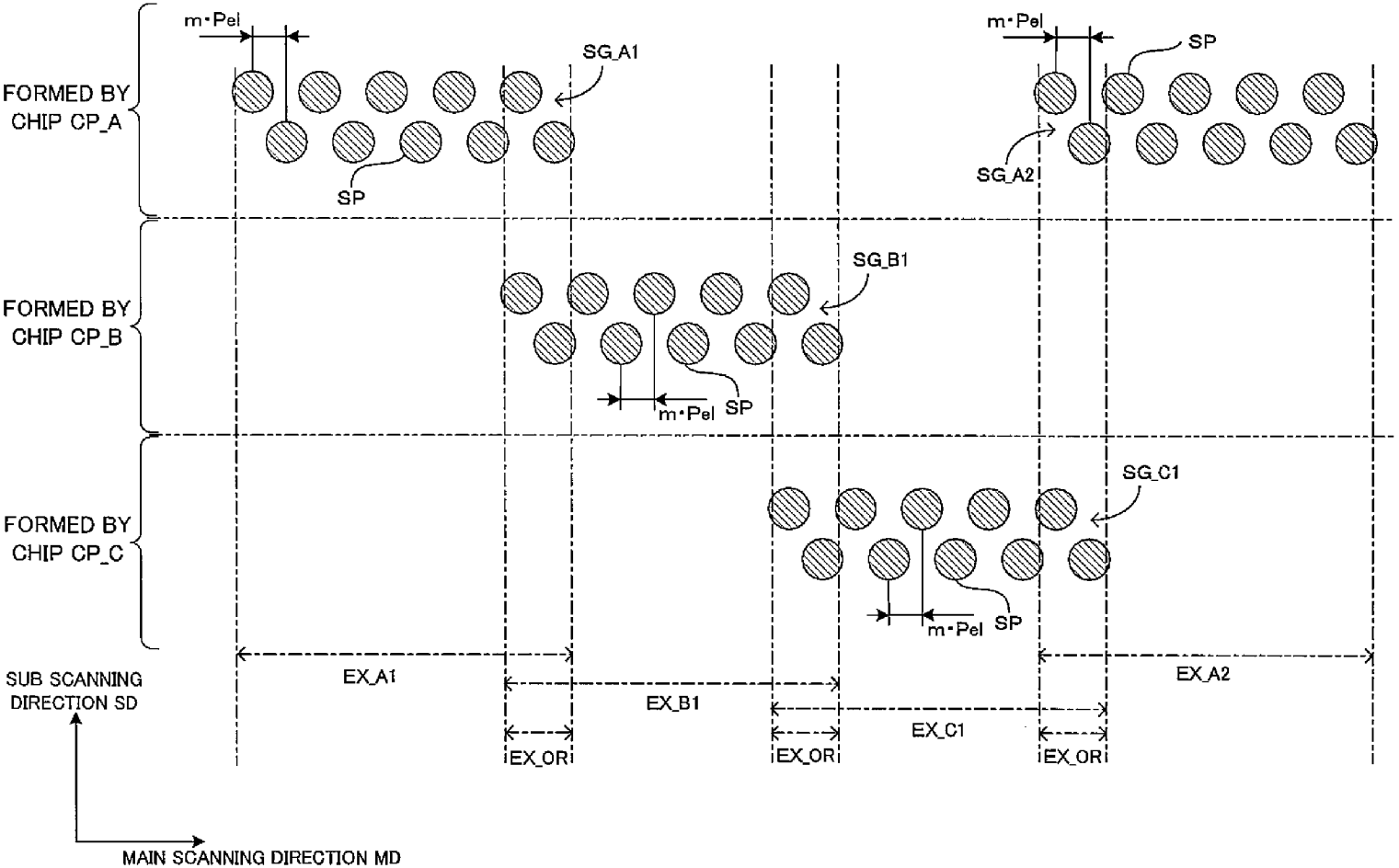
FIG. 28 is a diagram showing the positions of spots formed on the photosensitive member surface by the line head according to the seventh embodiment.

FIG. 28 is a diagram showing the positions of spots formed on the photosensitive member surface by the line head according to the seventh embodiment. A state where spots are formed by four light emitting element groups, that is, the light emitting element groups 295_A1, 295_B1, 295_C1 and 295_A2 in FIG. 27 for example is diagrammatically shown. In FIG. 28, a spot group SG_A1 represents a group of spots SP formed by the light emitting element group 295_A1; a spot group SG_B1 represents a group of spots SP formed by the light emitting element group 295_B1; a spot group SG_C1 represents a group of spots SP formed by the light emitting element group 295_C1; and a spot group SG_A2 represents a group of spots SP formed by the light emitting element group 295_A2. In other words, the spot groups SG_A1, SG_A2 are formed by the chip CP_A; the spot group SG_B1 is formed by the chip CP_B; and the spot group SG_C1 is formed by the chip CP_C. If the light emitting elements 2951 are simultaneously turned on as shown in FIG. 28, the spot groups SG_A1, SG_B1, SG_C1 and SG_A2 formed on the photosensitive member surface are also two-dimensionally arranged. Accordingly, in the seventh embodiment as well, the turn-on timings of the light emitting element rows 2951R are controlled similar to the first to third embodiments. Such a timing control is not described since being similar to the above.

As shown in FIG. 28, in the seventh embodiment, exposure regions corresponding to mutually different chips CP and adjacent in the main scanning direction MD partly overlap in the main scanning direction MD to form overlapping exposure regions EX_OR. Specifically, an exposure region EX_A1 corresponds to the chip CP_A, and an exposure region EX_B1 to the chip CP_B. Thus, the exposure regions EX_A1, EX_B1 correspond to the mutually different chips CP. The exposure regions EX_A1, EX_B1 are adjacent in the main scanning direction MD. In the seventh embodiment, the exposure regions EX_A1, EX_B1 having such a relationship partly overlap in the main scanning direction MD to form the overlapping exposure region EX_OR. In the seventh embodiment, the width of the overlapping exposure regions EX_OR in the main scanning direction MD is equal to or larger than the spot pitch (Psp=m·Pel) in the main scanning direction MD (twice the spot pitch (2·Psp=2·m·Pel) in FIG. 28).

Further, the exposure regions EX_B1, EX_C1 corresponding to the mutually different chips CP and adjacent in the main scanning direction MD partly overlap in the main scanning direction MD to form the overlapping exposure region EX_OR. Furthermore, the exposure regions EX_C1, EX_A2 corresponding to the mutually different chips CP and adjacent in the main scanning direction MD partly overlap in the main scanning direction MD to form the overlapping exposure region EX_OR.

In the example shown in FIG. 28, all the spots SP that can expose the overlapping exposure regions EX_OR are formed. However, as described in the third embodiment, an exposure operation may be performed by selecting spots SP to be actually formed out of a plurality of spots SP that can be formed in the overlapping exposure regions EX_OR.

As described above, in the line head 29 according to the seventh embodiment as well, the plurality of microlenses ML are arranged to face one chip CP. Therefore, it is possible to reduce time and cost required for assembling by suppressing the bonding number of the chips CP in the assembling of the line head 29.

Eighth Embodiment

Figure 29:
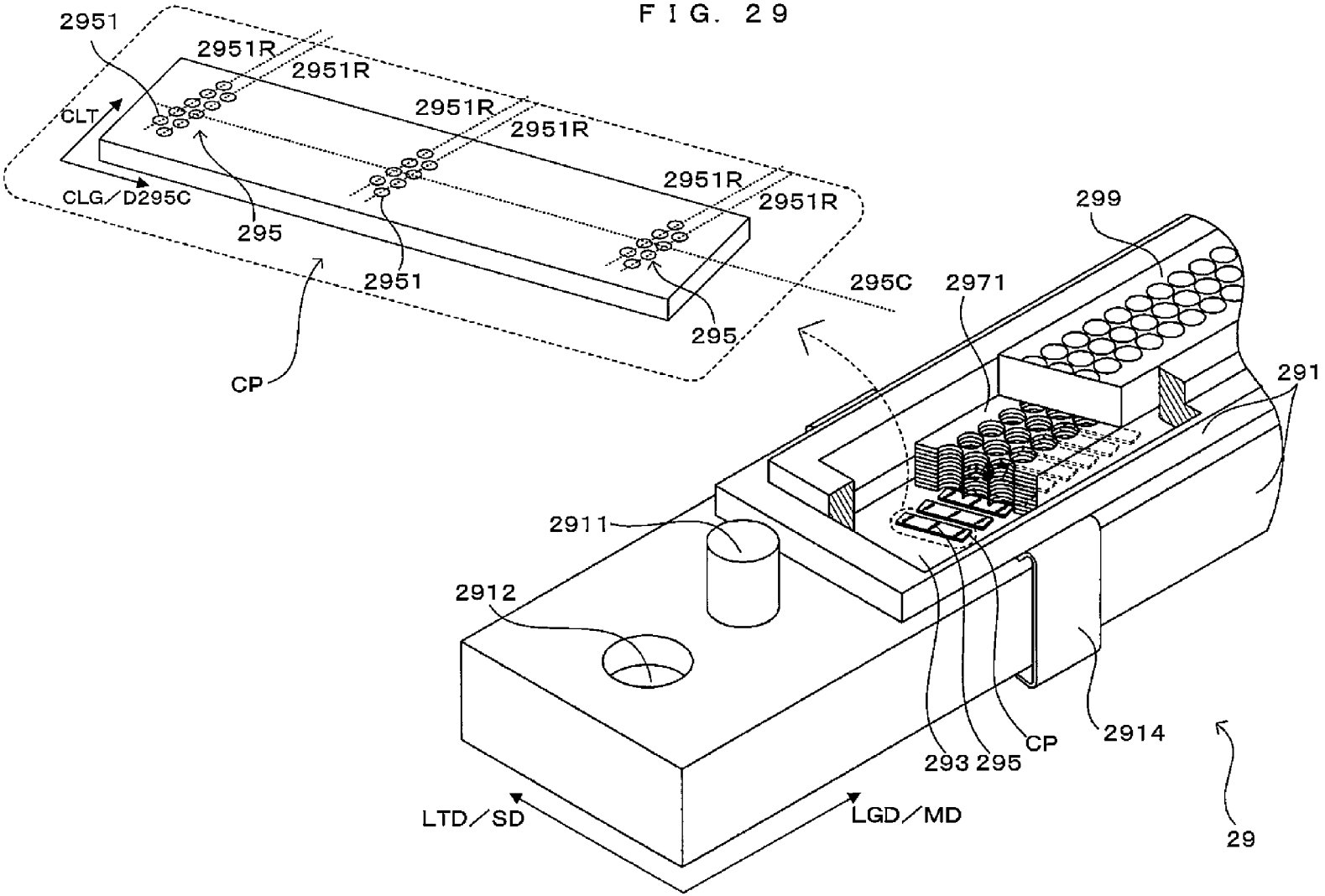
FIG. 29 is a perspective view schematically showing a line head according to an eighth embodiment.
Figure 30:
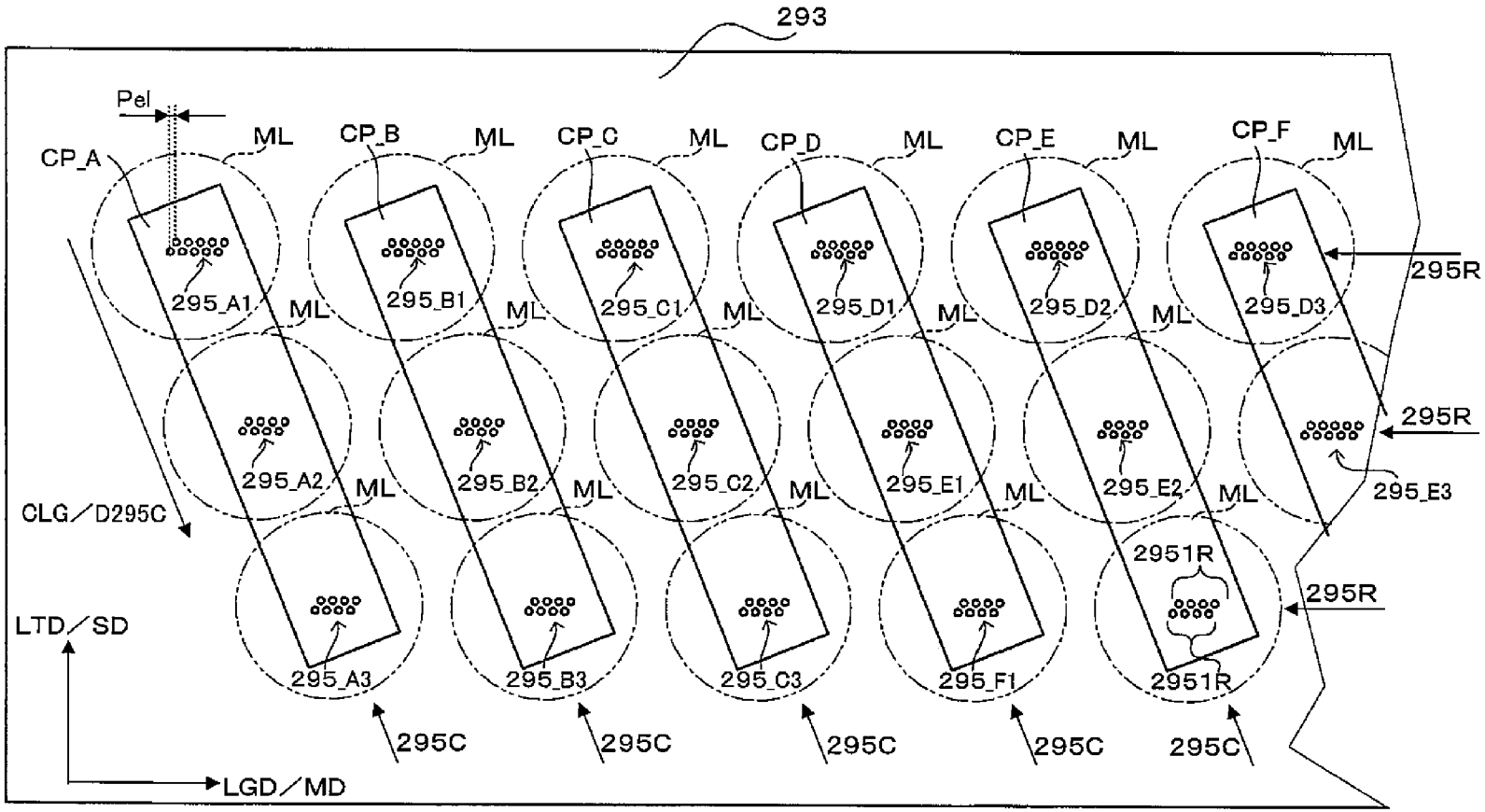
FIG. 30 is a diagram showing the arrangement of chips on a head substrate in the eighth embodiment.

FIG. 29 is a perspective view schematically showing a line head according to an eighth embodiment, and FIG. 30 is a diagram showing the arrangement of chips on a head substrate in the eighth embodiment. In the following description of the eighth embodiment, points of difference from the above embodiments are mainly described and common parts are not described by being identified by suitable reference numerals.

A light emitting element group column 295C comprised of three light emitting element groups 295 is formed on a chip CP of the eighth embodiment. At this time, the light emitting element group column 295C is formed on the chip CP such that an extending direction D295C (that is, arrangement direction D295C of the light emitting element groups 295 in the light emitting element group column 295C) of the light emitting element group column 295C is parallel to the chip longitudinal axis CLG of the chip CP.

A plurality of chips CP are arranged on a head substrate 293 in the longitudinal direction LGD. At this time, the respective chips CP are bonded to the top surface of the head substrate 293 such that the chip longitudinal axes CLG are parallel to the direction D295C. Therefore, the chip longitudinal axes CLG of the chips CP are inclined with respect to the longitudinal direction LGD of the line head 29 and the chip lateral axes CLT thereof are inclined with respect to the width direction LTD of the line head 29.

As shown in FIG. 30, a specified number of light emitting element groups 295 are arranged on the top surface of the head substrate 293 while being spaced apart from each other in the longitudinal direction LGD, thereby forming a light emitting element group row 295R. A plurality of (three in the eighth embodiment) light emitting element group rows 295R are arranged in the width direction LTD. The three light emitting element group rows 295R are arranged at specified pitches displaced in the longitudinal direction LGD. As a result, the plurality of light emitting element groups 295 are two-dimensionally arranged and the positions thereof in the longitudinal direction mutually differ. A plurality of microlenses ML are arranged in a one-to-one correspondence with a plurality of light emitting element groups 295 arranged as shown in FIG. 30.

In the eighth embodiment, the three light emitting element groups 295 constituting each light emitting element group column 295C are respectively constituted as follows. The most upstream light emitting element group 295 located at the most upstream position in the direction D295C in each light emitting element group column 295C includes ten light emitting elements 2951, which are arranged as follows. Specifically, in the most upstream light emitting element group 295, five light emitting elements 2951 are aligned at specified pitches (=twice the element pitch Pel) in the longitudinal direction LGD to form a light emitting element row 2951R, and two light emitting element rows 2951R are arranged in the width direction LTD. Further, the light emitting element rows 2951R are displaced by the element pitch Pel in the longitudinal direction LGD. Thus, in the most upstream light emitting element group 295, all the light emitting elements 2951 are arranged at mutually different longitudinal positions displaced at the element pitches Pel. Accordingly, when light beams are emitted from all the ten light emitting elements 2951 of the most upstream light emitting element group 295, these light beams are imaged on a photosensitive member surface at mutually different positions in a main scanning direction MD by the microlens ML. In other words, by turning all the ten light emitting elements 2951 of the most upstream light emitting element group 295 on, a spot group can be formed in which ten spots are aligned in the main scanning direction MD. An area of the photosensitive member surface where the spot groups are formed is exposed.

On the other hand, each of the light emitting element groups 295 located at positions other than the most upstream position in the direction D295C in each light emitting element group column 295C includes eight light emitting elements 2951, which are arranged as follows. Specifically, in these light emitting element groups 295, four light emitting elements 2951 are aligned at specified pitches (=twice the element pitch Pel) in the longitudinal direction LGD to form a light emitting element row 2951R, and two light emitting element rows 2951R are arranged in the width direction LTD. Further, the light emitting element rows 2951R are displaced by the element pitch Pel in the longitudinal direction LGD. Thus, in these light emitting element groups 295, all the light emitting elements 2951 are arranged at mutually different longitudinal positions displaced at the element pitches Pel. Accordingly, when light beams are emitted from all the eight light emitting elements 2951 of the light emitting element group 295, these light beams are imaged on the photosensitive member surface at mutually different positions in the main scanning direction MD by the microlens ML. In other words, by turning all the eight light emitting elements 2951 of the light emitting element group 295 on, a spot group can be formed in which eight spots are aligned in the main scanning direction MD. An area of the photosensitive member surface where the spot groups are formed is exposed.

Figure 31:
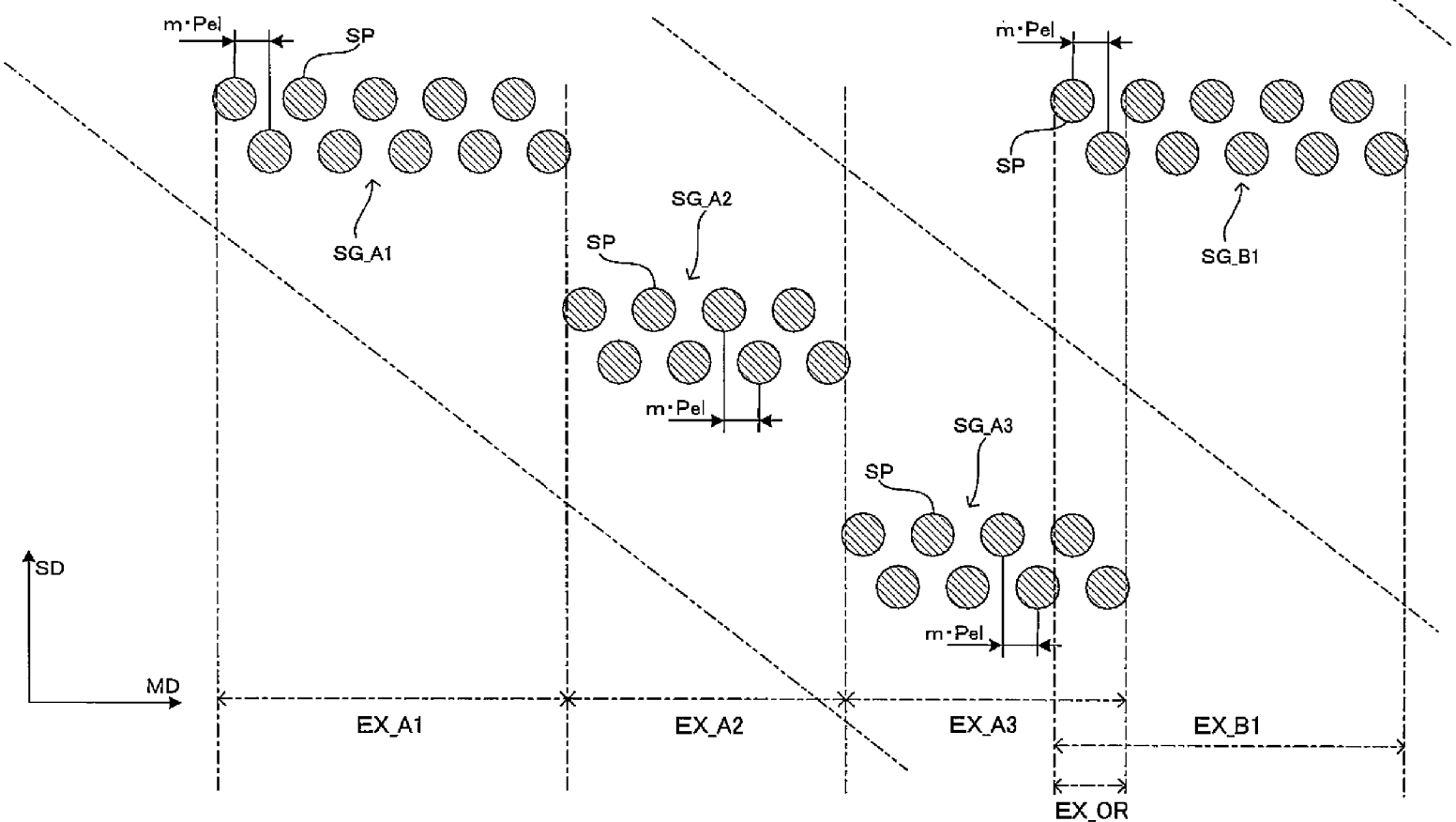
FIG. 31 is a diagram showing the positions of spots formed on the photosensitive member surface by the line head according to the eighth embodiment.

FIG. 31 is a diagram showing the positions of spots formed on the photosensitive member surface by the line head according to the eighth embodiment. A state where spots are formed by four light emitting element groups, for example, light emitting element groups 295_A1, 295_A2, 295_A3 and 295_B1 in FIG. 30 is diagrammatically shown. In FIG. 31, a spot group SG_A1 represents a group of spots SP formed by the light emitting element group 295_A1; a spot group SG_A2 represents a group of spots SP formed by the light emitting element group 295_A2; a spot group SG_A3 represents a group of spots SP formed by the light emitting element group 295_A3; and a spot group SG_B1 represents a group of spots SP formed by the light emitting element group 295_B1. In other words, the spot groups SG_A1 to SG_A3 are formed by the chip CP_A; and the spot group SG_B1 is formed by the chip CP_B. When the light emitting elements 2951 are simultaneously turned on as shown in FIG. 31, the spot groups SG_A1, SG_A2, SG_A3 and SG_B1 formed on the photosensitive member surface are also two-dimensionally arranged. Accordingly, similar to the first to third embodiments, the turn-on timings of the light emitting element rows 2951R are controlled in the eighth embodiment as well. Such a timing control is not described since being similar to the above.

As shown in FIG. 31, in the eighth embodiment, exposure regions corresponding to mutually different chips CP and adjacent in the main scanning direction MD partly overlap in the main scanning direction MD to form overlapping exposure regions EX_OR. Specifically, an exposure region EX_A3 corresponds to the chip CP_A, and an exposure region EX_B1 to the chip CP_B. Thus, the exposure regions EX_A3, EX_B1 correspond to the mutually different chips CR The exposure regions EX_A3, EX_B1 are adjacent in the main scanning direction MD. The exposure regions EX_A3, EX_B1 having such a relationship partly overlap in the main scanning direction MD to form the overlapping exposure region EX_OR. In the eighth embodiment, the width of the overlapping exposure regions EX_OR in the main scanning direction MD is equal to or larger than the spot pitch (Psp=m·Pel) in the main scanning direction MD. The width is twice the spot pitch (2·Psp=2·m·Pel) in FIG. 31.

As described above, in the line head 29 according to the eighth embodiment as well, the plurality of microlenses ML are arranged to face one chip CP. Therefore, it is possible to reduce time and cost required for assembling by suppressing the bonding number of the chips CP in the assembling of the line head 29.

Ninth Embodiment

Figure 32:
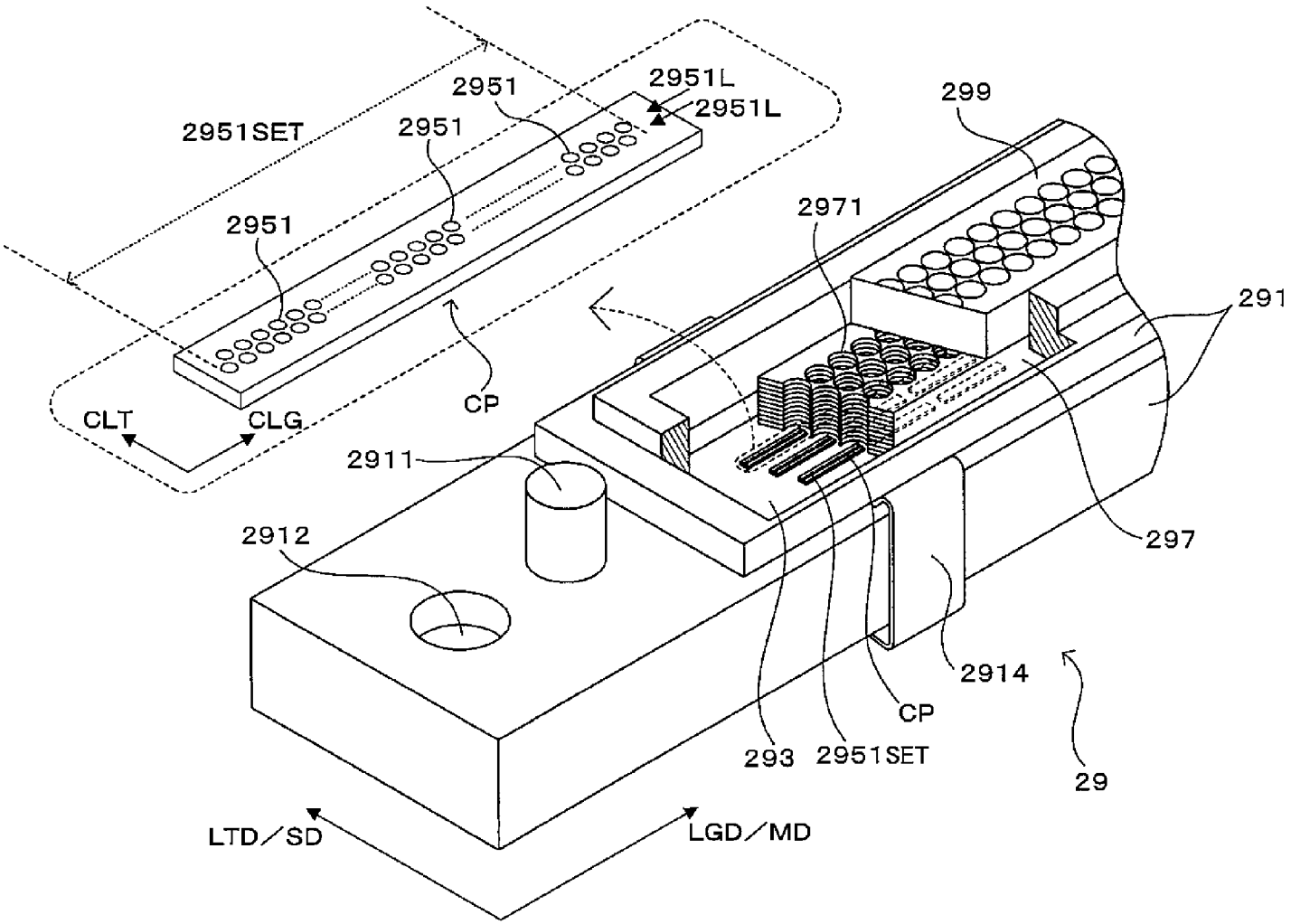
FIG. 32 is a perspective view showing a line head according to a ninth embodiment.
Figure 33:
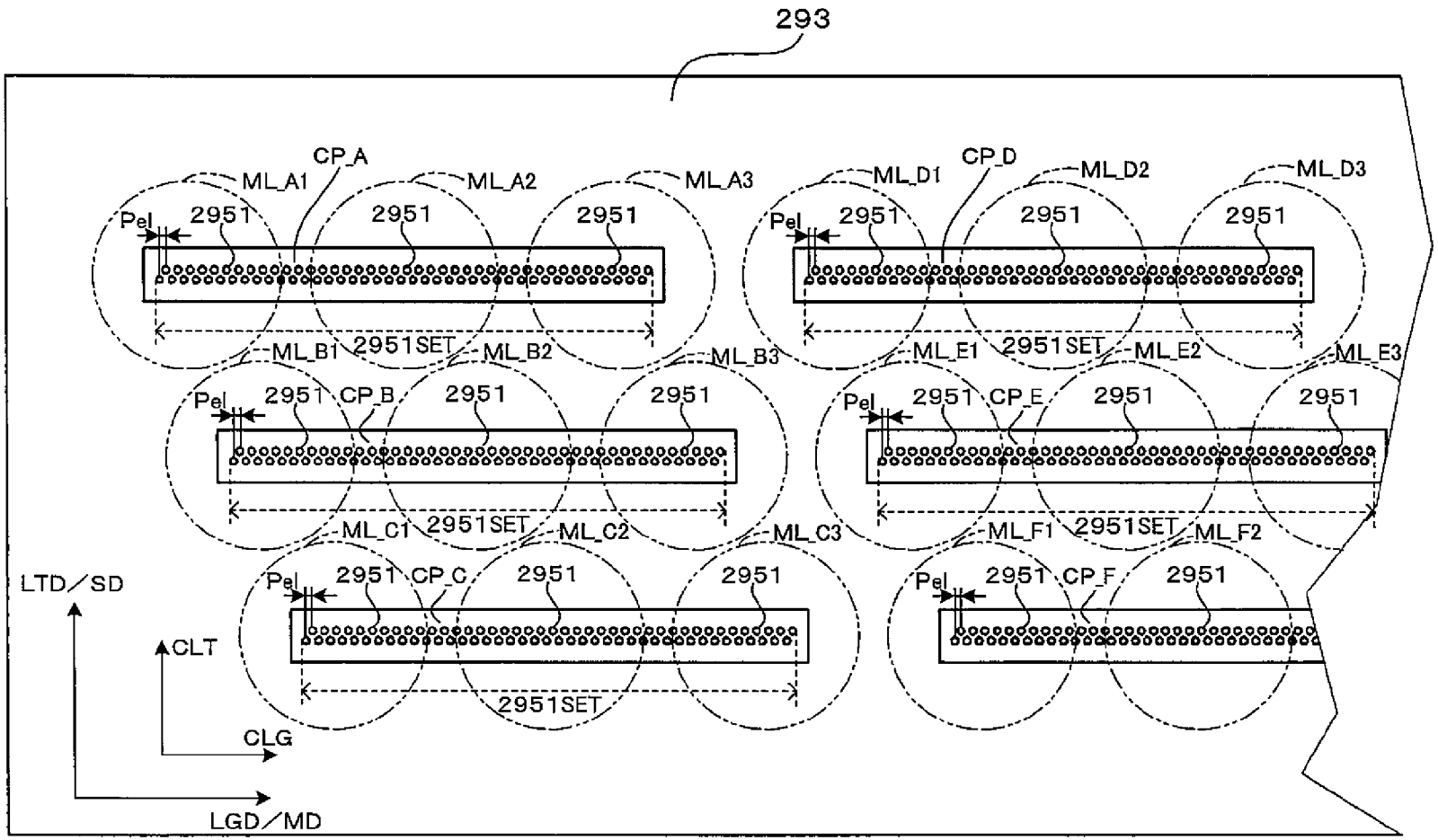
FIG. 33 is a diagram showing the arrangement of chips on a head substrate in the ninth embodiment.

FIG. 32 is a perspective view showing a line head according to a ninth embodiment, and FIG. 33 is a diagram showing the arrangement of chips on a head substrate in the ninth embodiment. As shown in FIGS. 32 and 33, a plurality of chips CP_A, CP_B, CP_C, CP_D, . . . are arranged on a top surface of a head substrate 293. The respective chips CP are arranged such that the longitudinal axes CLG thereof are parallel to the longitudinal direction LGD and the lateral axes CLT thereof are parallel to the width direction LTD. Each chip CP includes an element set 2951SET comprised of a plurality of light emitting elements 2951. As shown in FIGS. 32 and 33, a plurality of (three in this embodiment) chips CP (chips CP_A, CP_B, CP_C, for instance) are arranged in the width direction LTD and displaced from each other in the longitudinal direction LGD. Therefore, the element sets 2951SET of the chips (e.g. chips CP_A, CP_B) adjacent in the width direction LTD partly overlap in the longitudinal direction LGD.

In the element set 2951SET formed on each chip CP, a plurality of light emitting elements 2951 are arranged at light emitting element pitches Pel in the longitudinal direction LGD (chip longitudinal axis CLG) of the line head 29. More specifically, the element set 2951SET is formed by arranging two light emitting element lines 2951L, in each of which a specified number of light emitting elements 2951 are linearly aligned at specified pitches (=twice the element pitch Pel) in the longitudinal direction LGD, in the width direction LTD. Further, the light emitting element lines 2951L are displaced by the element pitch Pel in the longitudinal direction LGD. Thus, in the element set 2951SET, all the light emitting elements 2951 are arranged in an offset manner at mutually different positions in the chip longitudinal axis (longitudinal positions) displaced at the element pitches Pel. In this way, the element set 2951SET is paved with the plurality of light emitting elements 2951 arranged at the element pitches Pel in the longitudinal direction LGD.

A plurality of (three in this embodiment) microlenses ML are arranged to face such an element set 2951SET. Specifically, in this embodiment, three microlenses ML are arranged to face one chip CP. These three microlenses ML are arranged at specified pitches (three-fold of the lens pitch Pls) in the chip longitudinal axis CLG of the chip CP they are facing. Specifically, three microlenses ML_A1, ML_A2, ML_A3, for example, face a chip CP_A and are arranged at pitches, which are three times as large as the lens pitch Pls, in the chip longitudinal axis of the chip CP_A. The respective microlenses ML focus light beams emitted from the light emitting elements 2951 of the facing chip CP toward a photosensitive member surface to form a spot group SG on the photosensitive member surface.

A spot forming operation is described in detail later. In this embodiment, each spot group SG is comprised of eight spots. Specifically, each microlens ML focuses light beams emitted from eight light emitting elements 2951 to form one spot group SG. On the other hand, the element set 2951SET that the respective microlenses ML are facing is paved with the plurality of light emitting elements 2951 as described above. Accordingly, more light emitting elements 2951 than eight light emitting elements 2951, which are necessary to form the spot group SG, are arranged at the element pitches Pel in the longitudinal direction LGD (chip longitudinal axis) in a range of the element set 295SET that each microlens ML is facing. Thus, as described later, in the line head 29 of the ninth embodiment, eight light emitting elements 2951 suitable to form an irradiation region are selected and turned on from the plurality of light emitting elements 2951 of the element set 2951SET.

Figure 34:
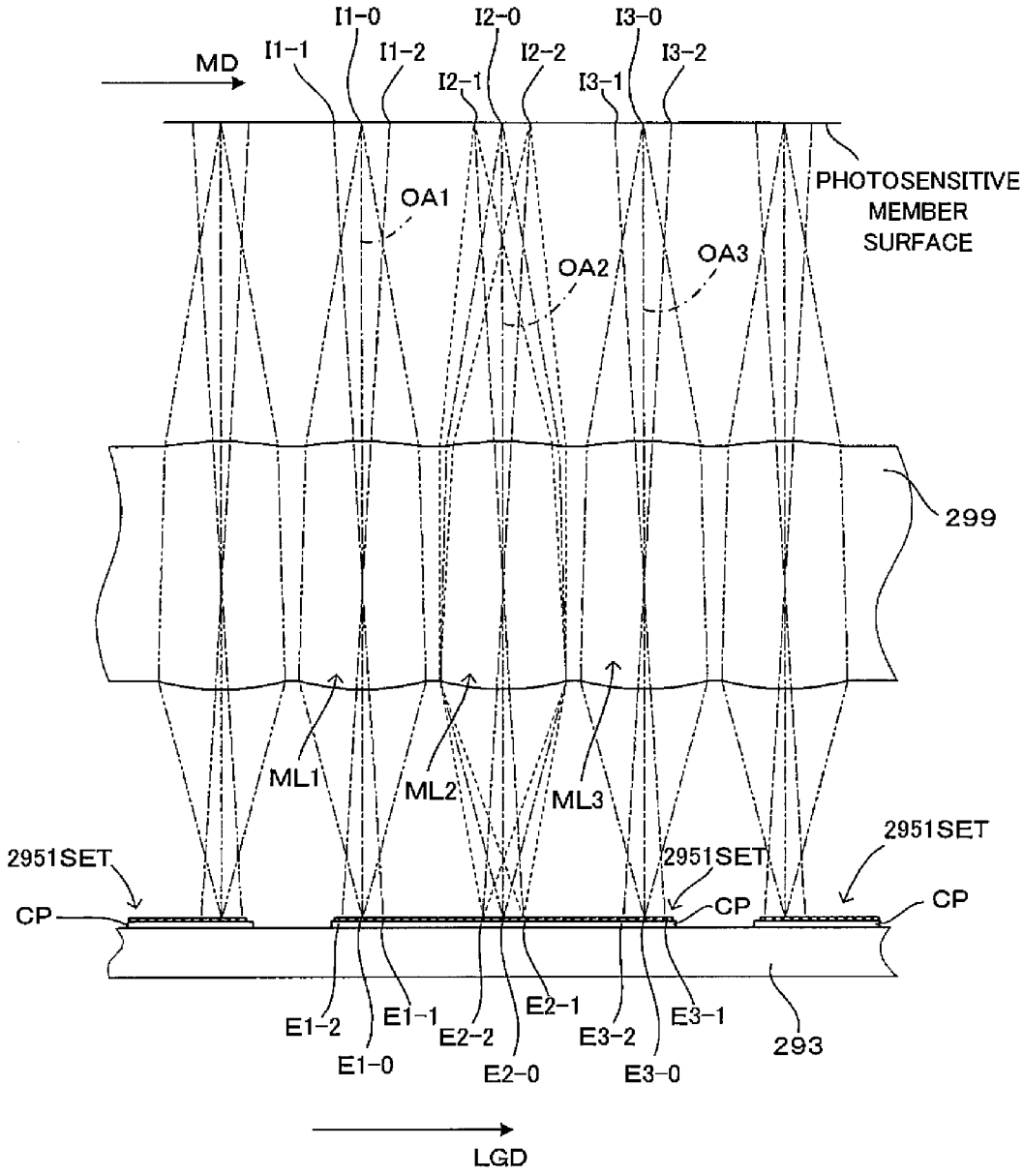
FIG. 34 is a diagram showing an imaging state of a microlens array.

FIG. 34 is a diagram showing an imaging state of a microlens array. The light shielding member 297 is not shown in FIG. 34. In order to facilitate the understanding of the imaging characteristic of the microlens array 299, paths of light beams emitted from positions (E1_0, E2_0, E3_0) located on optical axes OA (OA1 to OA3) of microlenses ML (ML1 to ML3), positions (E1_1, E2_1, E3_1) at a specified distance from the positions on the optical axes in the longitudinal direction LGD, and positions (E1_2, E2_2, E3_2) at a specified distance from the positions on the optical axes in a direction opposite to the longitudinal direction LGD are shown in FIG. 34. As shown by such beam paths, the light beams emitted from the respective positions reach a surface of a photosensitive drum 21 (photosensitive member surface) via the microlens array 299. In other words, the light beams emitted from the chips CP provided on the top surface of the head substrate 293 are imaged on the photosensitive member surface by the microlenses ML of the microlens array 299.

More specifically, the light beams emitted from the positions (positions E1_0, E1_1, E1_2, for instance) that the microlens ML1 is facing are imaged as follows by the microlens ML1. In other words, the light beam emitted from the position E1_0 is imaged at an intersection I1_0 of the photosensitive member surface and the optical axis OA1 of the microlens ML1. Further, the light beams emitted from the positions E1_1, E1_2 are respectively imaged at positions I1_1, I1_2 on the surface of the photosensitive drum 21. Specifically, the light beam emitted from the position E1_1 is imaged at the position I1_1 located at an opposite side of the optical axis OA of the microlens ML1 in the main scanning direction MD, and the light beam emitted from the position E1_2 is imaged at the position I1_2 located at an opposite side of the optical axis OA of the microlens ML1 in the main scanning direction MD. In this way, the microlens ML1 has an inverting property (in other words, the magnification m of the microlens ML has a negative value). As shown in FIG. 34, a distance between the imaged positions I1_1, I1_0 of the light beams is longer than the one between the positions E1_1, E1_0. In other words, the absolute value of the magnification of the microlens ML1 is larger than 1.

Similar to the imaging by the above microlens ML1, the light beams emitted from the positions (positions E2_0, E2_1, E2_2, for instance) that the microlens ML2 is facing are imaged on the positions (positions I2_0, I2_1, I2_2) of the photosensitive member surface by the microlens ML2, and the light beams emitted from the positions (positions E3_0, E3_1, E3_2, for instance) that the microlens ML3 is facing are imaged on the positions (positions I3_0, I3_1, I3_2) of the photosensitive member surface by the microlens ML3.

Figure 35:
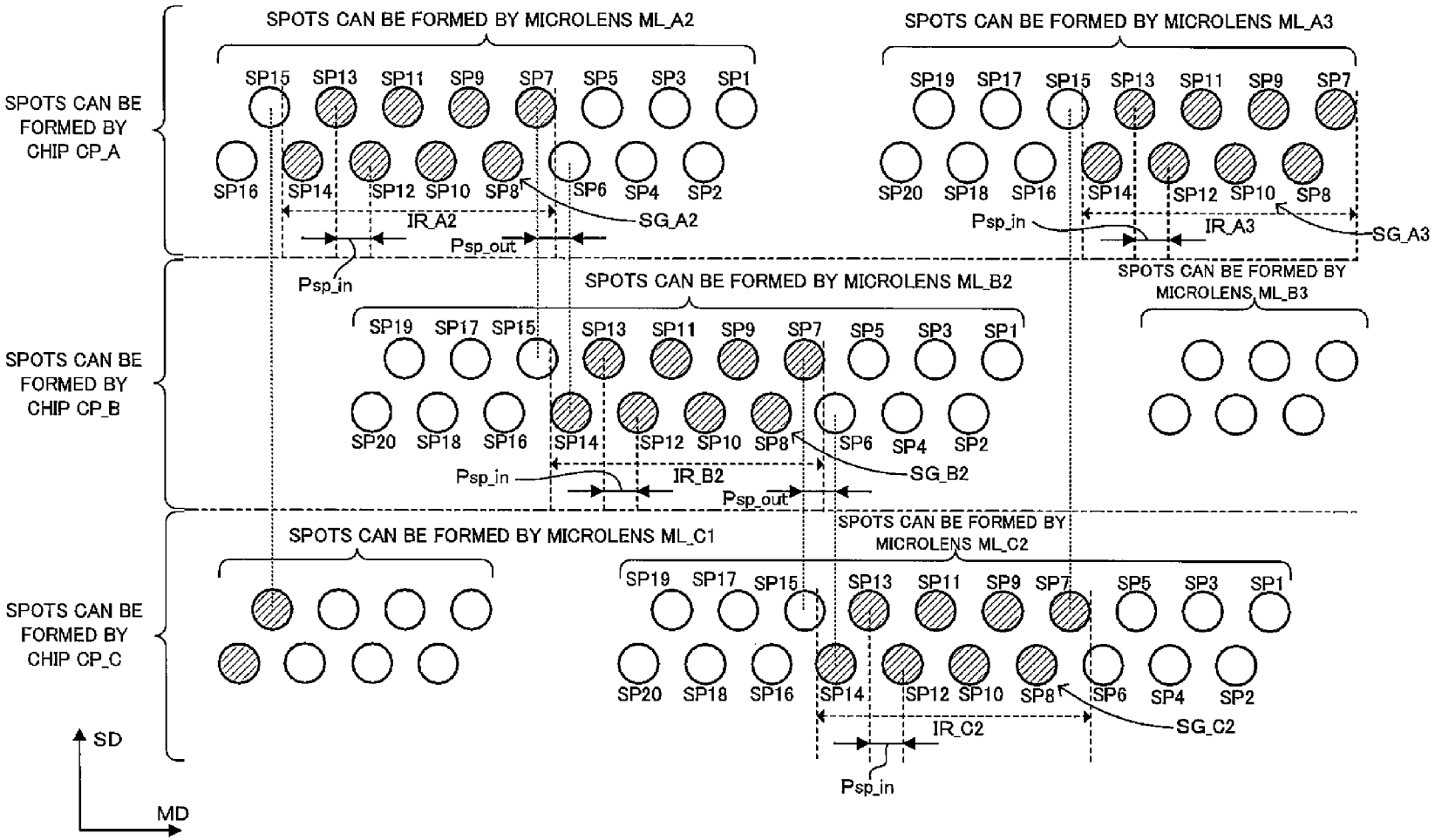
FIG. 35 is a diagram showing the positions of spots formed on the photosensitive member surface by the line head according to the ninth embodiment.

FIG. 35 is a diagram showing the positions of spots formed on the photosensitive member surface by the line head according to the ninth embodiment. Here, solid-line circles in FIG. 35 represent the spots SP that can be formed. Out of these solid-line circles, those having the insides hatched represent the spots to be actually formed, and those having blank insides represent the spots not to be actually formed. In order to facilitate the understanding of the invention, a case where the spots SP are formed in a stationary state of the photosensitive member surface is shown in FIG. 35. Accordingly, the spots SP in the spot groups SG are two-dimensionally arranged. However, as described with reference to FIG. 12, an actual spot forming operation is performed while the photosensitive member surface is moved in the sub scanning direction SD and the light emitting elements 2951 are turned on in conformity with the movement of the photosensitive member surface. As a result, the spots SP formed by the plurality of light emitting elements 2951 of the head substrate 293 are formed on a straight line substantially parallel to the main scanning direction MD. These contents described with reference to FIG. 35 also apply to FIGS. 36 to 39 described below.

The spots SP located at the upper one of three stages partitioned by chain double-dashed line are those that can be formed by the chip CP_A. Particularly in FIG. 35, out of the spots SP that can be formed by the chip CP_A, those that can be formed by the microlens ML_A2 facing the chip CP_A and those that can be formed by the microlens ML_A3 facing the chip CP_A are shown.

The spots SP located at the middle one of the plurality of stages partitioned by chain double-dashed line are those that can be formed by the chip CP_B. Particularly in FIG. 35, out of the spots SP that can be formed by the chip CP_B, those that can be formed by the microlens ML_B2 facing the chip CP_B and those that can be formed by the microlens ML_B3 facing the chip CP_B are shown.

The spots SP located at the lower one of the plurality of stages partitioned by chain double-dashed line are those that can be formed by the chip CP_C. Particularly in FIG. 35, out of the spots SP that can be formed by the chip CP_C, those that can be formed by the microlens ML_C1 facing the chip CP_C and those that can be formed by the microlens ML_C2 facing the chip CP_C are shown.

As shown in FIG. 35, the respective chips CP form only the spots (hatched spots in FIG. 35) selected out of the plurality of spots SP that can be formed. Specifically, in a range shown in FIG. 35, the chip CP_A forms only sixteen spots SP in the actual spot forming operation out of the plurality of spots SP that can be formed. In order to perform such a spot forming operation, the chip CP_A selects eight light emitting elements 2951 from the plurality of light emitting elements 2951 facing the microlens ML_A2 and turns them on to arrange eight spots SP7 to SP14 in the main scanning direction MD (that is, form a spot group SG_A2) out of a plurality of spots that can be formed by the microlens ML_A2, thereby forming an irradiation region IR_A2. Further, the chip CP_A selects eight light emitting elements 2951 from the plurality of light emitting elements 2951 facing the microlens ML_A3 and turns them on to arrange eight spots SP7 to SP14 in the main scanning direction MD (that is, form a spot group SG_A3) out of a plurality of spots that can be formed by the microlens ML_A3, thereby forming an irradiation region IR_A3.

In the range shown in FIG. 35, the chip CP_B forms only eight spots SP in the actual spot forming operation out of the plurality of spots SP that can be formed. In order to perform such a spot forming operation, the chip CP_B selects eight light emitting elements 2951 from the plurality of light emitting elements 2951 facing the microlens ML_B2 and turns them on to arrange eight spots SP7 to SP14 in the main scanning direction MD (that is, form a spot group SG_B2) out of a plurality of spots that can be formed by the microtens ML_B2, thereby forming an irradiation region IR_B2. Further, in the range shown in FIG. 35, the chip CP_C forms only eight spots SP in the actual spot forming operation out of the plurality of spots SP that can be formed. In order to perform such a spot forming operation, the chip CP_C selects eight light emitting elements 2951 from the plurality of light emitting elements 2951 facing the microlens ML_C2 and turns them on to arrange eight spots SP7 to SP14 in the main scanning direction MD (that is, form a spot group SG_C2) out of a plurality of spots that can be formed by the microlens ML_C2, thereby forming an irradiation region IR_C2.

In FIG. 35, only the two spot groups SG_A2, SG_A3 are shown as the spot groups SG formed by the chip CP_A; only the spot group SG_B2 is shown as the spot group SG formed by the chip CP_B; and only the spot group SG_C2 is shown as the spot group SG formed by the chip CP_C. However, each of the three microlenses ML facing the corresponding chip CP can form the spot groups SG. Therefore, three spot groups SG can be actually formed by one chip CP.

What should be noted here is that the light emitting elements 2951 of the element set 2951SET of the respective chips CP_A, CP_B are turned on to connect the irradiation region IR_A2 formed by the chip CP_A and the irradiation region IR_B2 formed by the chip CP_B. Specifically, the chip CP_A turns on only the eight light emitting elements 2951 corresponding to the spots SP7 to SP14 irradiating the irradiation region IR_A2 out of the plurality of light emitting elements 2951 belonging to the element set 2951SET. Further, the chip CP_B turns on only the eight light emitting elements 2951 corresponding to the spots SP7 to SP14 irradiating the irradiation region IR_B2 out of the plurality of light emitting elements 2951 belonging to the element set 2951SET. In this way, the irradiation regions IR_A2, IR_B2 adjacent in the main scanning direction MD can be connected.

Similarly, the light emitting elements 2951 of the element set 2951SET of the respective chips CP_B, CP_C are turned on to connect the irradiation region IR_B2 formed by the chip CP_B and the irradiation region IR_C2 formed by the chip CP_C. Specifically, the chip CP_B turns on only the eight light emitting elements 2951 corresponding to the spots SP7 to SP14 irradiating the irradiation region IR_B2 out of the plurality of light emitting elements 2951 belonging to the element set 2951SET. Further, the chip CP_C turns on only the eight light emitting elements 2951 corresponding to the spots SP7 to SP14 irradiating the irradiation region IR_C2 out of the plurality of light emitting elements 2951 belonging to the element set 2951SET. In this way, the irradiation regions IR_B2, IR_C2 adjacent in the main scanning direction MD can be connected.

As described above, in the ninth embodiment, the light emission of the light emitting elements 2951 of the element set 2951SET is controlled to connect the irradiation regions formed by mutually different chips CP and adjacent in the main scanning direction MD. Particularly, in the ninth embodiment, in order to satisfactorily connect the irradiation regions, the light emission of the light emitting elements 2951 is controlled such that the pitch between the adjacent spots SP formed by the mutually different chips CP are equal to or smaller than the maximum pitch and equal to or larger than the minimum pitch. Specifically, the spot pitch between the spots SP formed by the same chip and adjacent in the main scanning direction MD is defined as an in-chip spot pitch Psp_in. The spot pitch between the spots SP formed by the mutually different chips PC and adjacent in the main scanning direction MD is defined as an out-chip spot pitch Psp_out. And, the light emission of the light emitting elements 2951 of the element set 2951SET is controlled to satisfy the following Equation (1):

$$0.5\times Psp_in \leqq Psp_out \leqq 1.5\times Psp_in \quad (1)$$

The above control of the light emitting elements 2951 can be executed, for example, by the head control module 54 (controller) of the head controller HC.

In FIG. 35, the out-chip spot pitch Psp_out between the irradiation regions IR_A2, IR_B2 is equal to the in-chip spot pitch Psp_in. The out-chip spot pitch Psp_out between the irradiation regions IR_B2, IR_C2 is also equal to the in-chip spot pitch Psp_in.

As described above, in the line head 29 according to the ninth embodiment as well, the plurality of microlenses ML are arranged to face one chip CP. Therefore, it is possible to reduce time and cost required for assembling by suppressing the bonding number of the chips CP in the assembling of the line head 29.

Tenth Embodiment

There are cases where the positions of the spot groups SG on the image plane deviate from the desired ones due to a bonding error of bonding the chips CP at positions deviated from the desired ones or a like error. Accordingly, the spot groups SG may be formed as described below.

Figure 36:
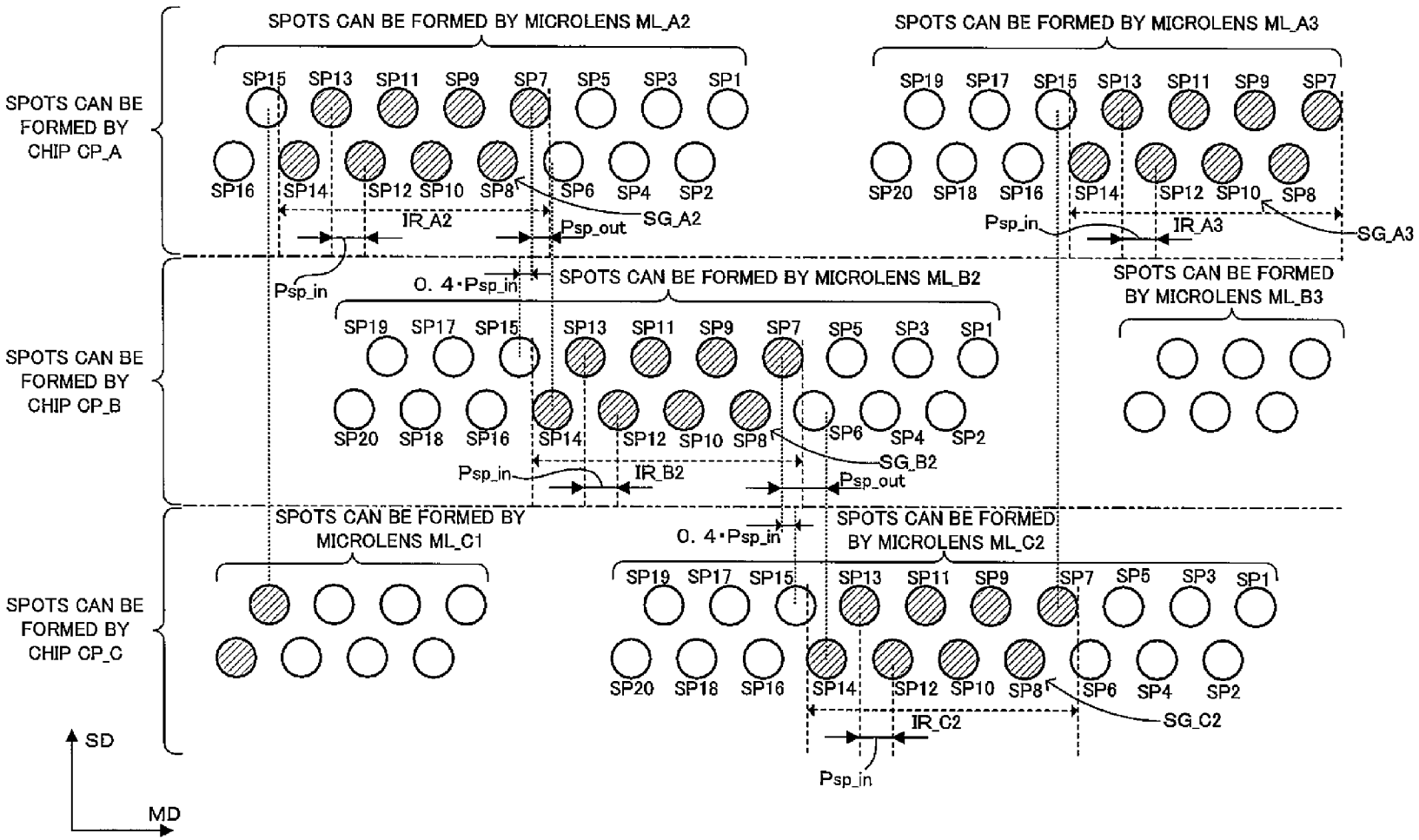
FIG. 36 is a diagram showing the positions of spots formed on a photosensitive member surface by a line head according to a tenth embodiment.

FIG. 36 is a diagram showing the positions of spots formed on a photosensitive member surface by a line head according to a tenth embodiment. In the following description on FIG. 36, differences from FIG. 35 are mainly described and common parts to FIG. 35 are not described by being identified by the suitable reference numerals. FIG. 36 corresponds to a case where the position of a chip CP_B deviates from the desired one in the longitudinal direction LGD, with the result that the positions of spots that can be formed by the chip CP_B are displaced toward the upstream side in the main scanning direction MD by 0.4-fold of the in-chip spot pitch Psp_in (that is, 0.4·Psp_in). By such a positional deviation of a chip, spots SP7, SP15 that can be respectively formed by a microlens ML_A2 and a microlens ML_B2 and have the same position in the main scanning direction MD in the absence of the positional deviation (FIG. 35) are displaced in the main scanning direction MD by 0.4-fold of the in-chip spot pitch Psp_in. Further, spots SP7, SP15 that can be respectively formed by a microlens ML_B2 and a microlens ML_C2 and have the same position in the main scanning direction MD in the absence of the positional deviation (FIG. 35) are displaced in the main scanning direction MD by 0.4-fold of the in-chip spot pitch Psp_in.

In FIG. 36, the out-chip spot pitch Psp_out between the irradiation regions IR_A2 and IR_B2 is 0.6-fold of the in-chip spot pitch Psp_in (that is, Psp_out=0.6·Psp_in). Further, the out-chip spot pitch Psp_out between the irradiation regions IR_B2 and IR_C2 is 1.4-fold of the in-chip spot pitch Psp_in (that is, Psp_out=1.4·Psp_in). In this way, the light emission of the light emitting elements of the element set 2951SET is controlled such that both the out-chip spot pitch Psp_out between the irradiation regions IR_A2, IR_B2 and the out-chip spot pitch Psp_out between the irradiation regions IR_B2, IR_C2 satisfy the condition of the above Equation (1). Thus, the irradiation regions adjacent in the main scanning direction MD are connected.

As described above, in the line head 29 according to the tenth embodiment as well, the plurality of microlenses ML are arranged to face one chip CP. Therefore, it is possible to reduce time and cost required for assembling by suppressing the bonding number of the chips CP in the assembling of the line head 29.

Eleventh Embodiment

Figure 37:
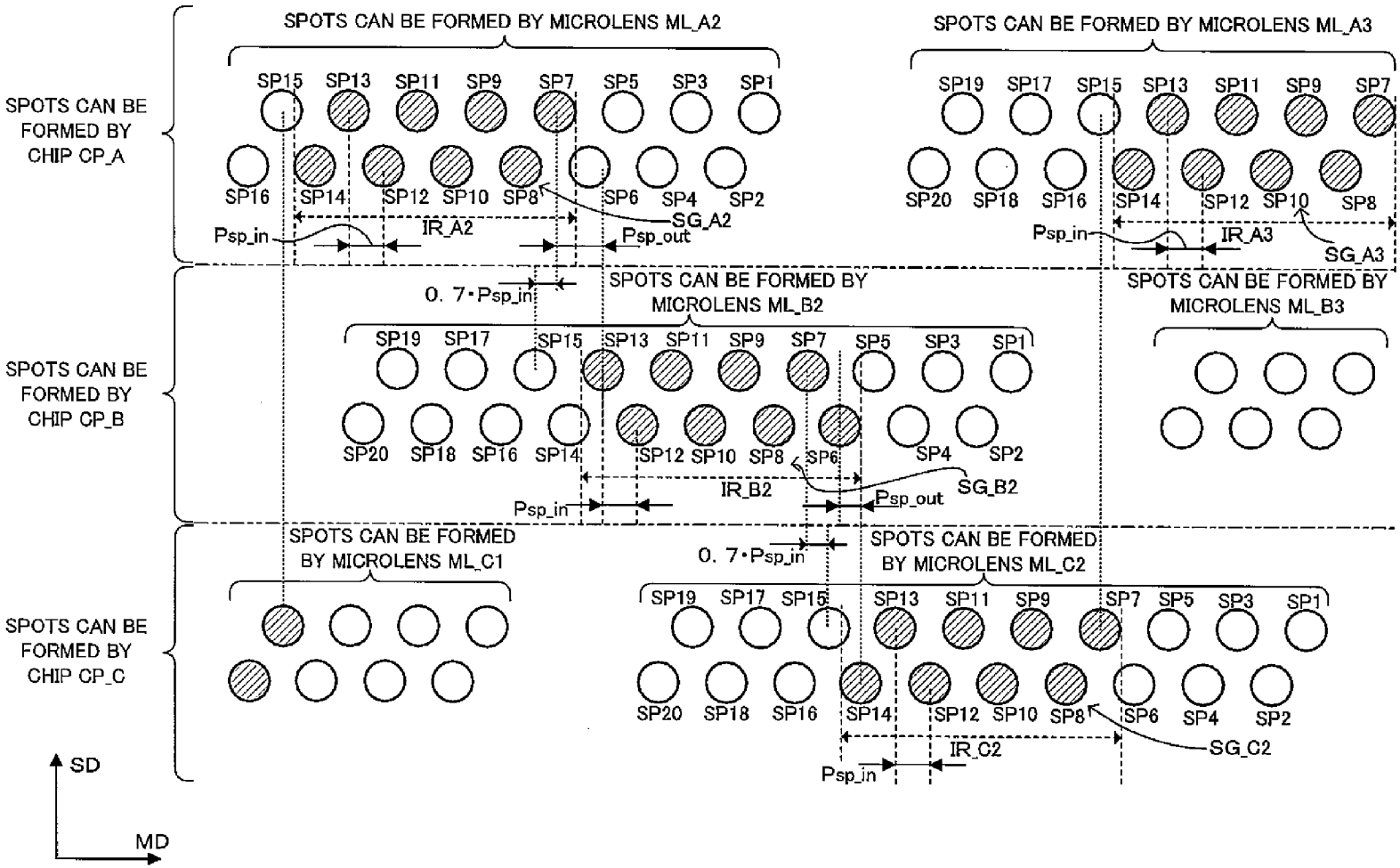
FIG. 37 is a diagram showing the positions of spots formed on a photosensitive member surface by a line head according to a eleventh embodiment.

FIG. 37 is a diagram showing the positions of spots formed on a photosensitive member surface by a line head according to a eleventh embodiment. In the following description on FIG. 37, differences from FIG. 35 are mainly described and common parts to FIG. 35 are not described by being identified by the suitable reference numerals. FIG. 37 corresponds to a case where the position of a chip CP_B deviates from the desired one in the longitudinal direction LGD, with the result that the positions of spots that can be formed by the chip CP_B are displaced toward the upstream side in the main scanning direction MD by 0.7-fold of the in-chip spot pitch Psp_in (that is, 0.7·Psp_in). By such a positional deviation of a chip, spots SP7, SP15 that can be respectively formed by a microlens ML_A2 and a microlens ML_B2 and have the same position in the main scanning direction MD in the absence of the positional deviation (FIG. 35) are displaced in the main scanning direction MD by 0.7-fold of the in-chip spot pitch Psp_in. Further, spots SP7, SP15 that can be respectively formed by a microlens ML_B2 and a microlens ML_C2 and have the same position in the main scanning direction MD in the absence of the positional deviation (FIG. 35) are displaced in the main scanning direction MD by 0.7-fold of the in-chip spot pitch Psp_in.

In FIG. 37, the chip CP_B does not form the spot SP14 formed in FIGS. 35, 36 to connect the irradiation region IR_B2 thereof with the irradiation region IR_A2 of the chip CP_A. In other words, in order to connect the irradiation regions IR_A2, IR_B2, the light emission of the element set 2951SET is controlled so that the light emitting element 2951 corresponding to this spot SP14 out of the plurality of light emitting elements 2951 belonging to the element set 2951SET of the chip CP_B is not turned on. In other words, in FIG. 37, the light emission of the light emitting elements of the element set 2951SET of the chip CP_B is controlled in accordance with the positional deviation of the chip CP_B. Thus, regardless of a positional deviation of the chip CP_B, the irradiation regions IR_A2, IR_B2 adjacent in the main scanning direction MD are connected.

Further, in FIG. 37, the chip CP_B forms the spot SP6 that is not formed in FIGS. 35 and 36 to connect the irradiation region IR_B2 thereof with the irradiation region IR_C2 of the chip CP_C. In other words, in order to connect the irradiation regions IR_B2, IR_C2, the light emission of the element set 2951SET is controlled so that the light emitting element 2951 corresponding to this spot SP6 out of the plurality of light emitting elements 2951 belonging to the element set 2951SET of the chip CP_B is turned on. That is, in FIG. 37, the light emission of the light emitting elements of the element set 2951SET of the chip CP_B is controlled in accordance with the positional deviation of the chip CP_B. Thus, despite the positional deviation of the chip CP_B, the irradiation regions IR_B2, IR_C2 adjacent in the main scanning direction MD are connected.

Further, in FIG. 37, the out-chip spot pitch Psp_out between the irradiation regions IR_A2, IR_B2 is 1.3-fold of the in-chip spot pitch Psp_in (that is, Psp_out=1.3·Psp_in). Further, the out-chip spot pitch Psp_out between the irradiation regions IR_B2, IR_C2 is 0.7-fold of the in-chip spot pitch Psp_in (that is, Psp_out=0.7·Psp_in). In this way, the light emission of the light emitting elements of the element set 2951SET is controlled such that both the out-chip spot pitch Psp_out between the irradiation regions IR_A2, IR_B2 and the out-chip spot pitch Psp_out between the irradiation regions IR_B2, IR_C2 satisfy the condition of the above Equation (1). Thus, the irradiation regions adjacent in the main scanning direction MD are connected.

As described above, in the line head 29 according to the eleventh embodiment as well, the plurality of microlenses ML are arranged to face one chip CP. Therefore, it is possible to reduce time and cost required for assembling by suppressing the bonding number of the chips CP in the assembling of the line head 29.

Twelfth Embodiment

Figure 38:
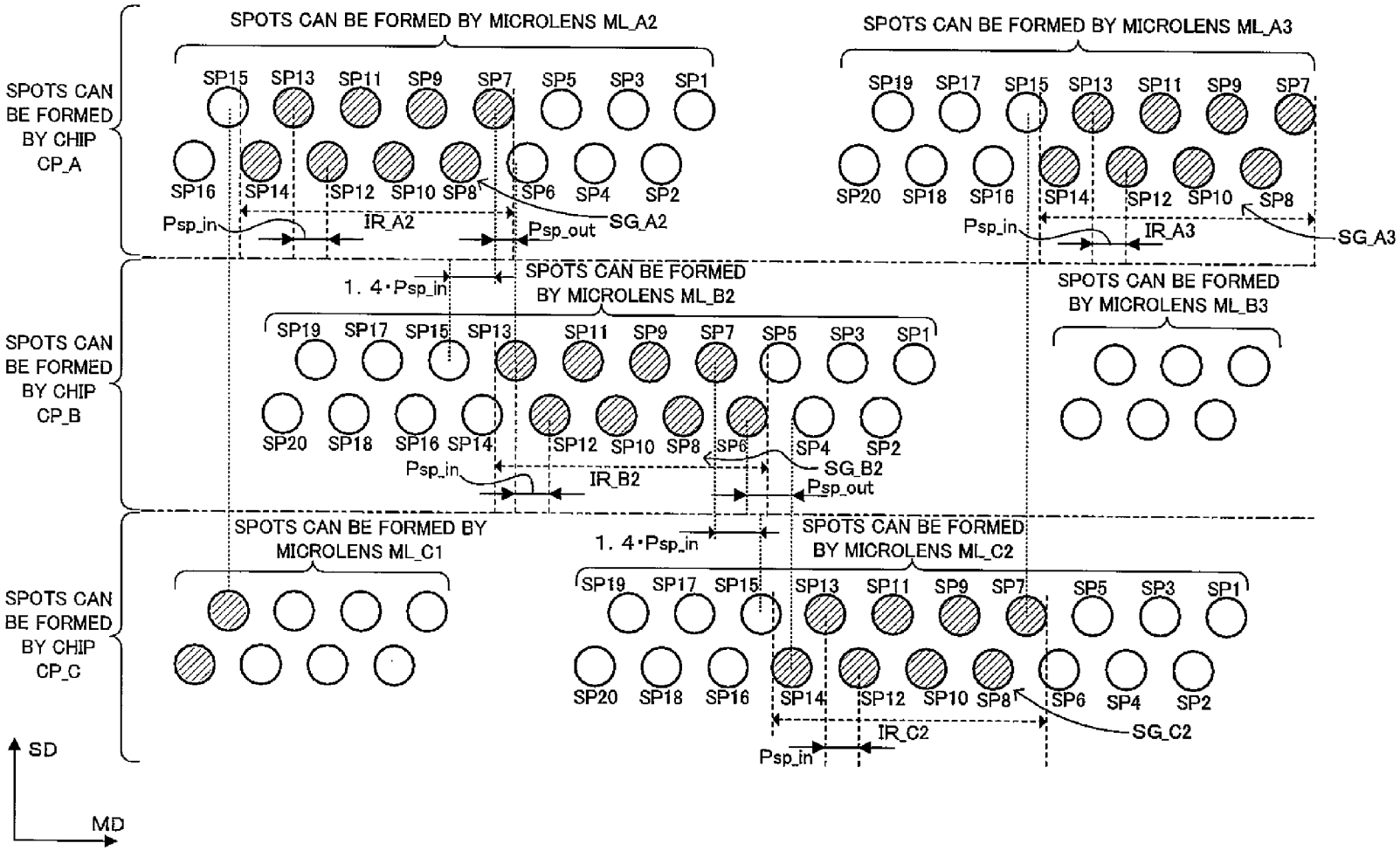
FIG. 38 is a diagram showing the positions of spots formed on a photosensitive member surface by a line head according to a twelfth embodiment.

FIG. 38 is a diagram showing the positions of spots formed on a photosensitive member surface by a line head according to a twelfth embodiment. In the following description on FIG. 38, differences from FIG. 35 are mainly described and common parts to FIG. 35 are not described by being identified by the suitable reference numerals. FIG. 38 corresponds to a case where the position of a chip CP_B deviates from the desired one in the longitudinal direction LGD, with the result that the positions of spots that can be formed by the chip CP_B are displaced toward the upstream side in the main scanning direction MD by 1.4-fold of the in-chip spot pitch Psp_in (that is, 1.4·Psp_in). By such a positional deviation of a chip, spots SP7, SP15 that can be respectively formed by a microlens ML_A2 and a microlens ML_B2 and have the same position in the main scanning direction MD in the absence of the positional deviation (FIG. 35) are displaced in the main scanning direction MD by 1.4-fold of the in-chip spot pitch Psp_in. Further, spots SP7, SP15 that can be respectively formed by a microlens ML_B2 and a microlens ML_C2 and have the same position in the main scanning direction MD in the absence of the positional deviation (FIG. 35) are displaced in the main scanning direction MD by 1.4-fold of the in-chip spot pitch Psp_in.

In FIG. 38, the chip CP_B does not form the spot SP14 formed in FIGS. 35, 36 to connect the irradiation region IR_B2 thereof with the irradiation region IR_A2 of the chip CP_A. In other words, in order to connect the irradiation regions IR_A2, IR_B2, the light emission of the element set 2951SET is controlled so that the light emitting element 2951 corresponding to this spot SP14 out of the plurality of light emitting elements 2951 belonging to the element set 2951SET of the chip CP_B is not turned on. In other words, in FIG. 38, the light emission of the light emitting elements of the element set 2951SET of the chip CP_B is controlled in accordance with the positional deviation of the chip CP_B. Thus, regardless of a positional deviation of the chip CP_B, the irradiation regions IR_A2, IR_B2 adjacent in the main scanning direction MD are connected.

Further, in FIG. 38, the chip CP_B forms the spot SP6 that is not formed in FIGS. 35 and 36 to connect the irradiation region IR_B2 thereof with the irradiation region IR_C2 of the chip CP_C. In other words, in order to connect the irradiation regions IR_B2, IR_C2, the light emission of the element set 2951SET is controlled so that the light emitting element 2951 corresponding to this spot SP6 out of the plurality of light emitting elements 2951 belonging to the element set 2951SET of the chip CP_B is turned on. That is, in FIG. 38, the light emission of the light emitting elements of the element set 2951SET of the chip CP_B is controlled in accordance with the positional deviation of the chip CP_B. Thus, despite the positional deviation of the chip CP_B, the irradiation regions IR_B2, IR_C2 adjacent in the main scanning direction MD are connected.

Further, in FIG. 38, the out-chip spot pitch Psp_out between the irradiation regions IR_A2, IR_B2 is 0.6-fold of the in-chip spot pitch Psp_in (that is, Psp_out=0.6·Psp_in). Further, the out-chip spot pitch Psp_out between the irradiation regions IR_B2, IR_C2 is 1.4-fold of the in-chip spot pitch Psp_in (that is, Psp_out=1.4·Psp_in). In this way, the light emission of the light emitting elements of the element set 2951SET is controlled such that both the out-chip spot pitch Psp_out between the irradiation regions IR_A2, IR_B2 and the out-chip spot pitch Psp_out between the irradiation regions IR_B2, IR_C2 satisfy the condition of the above Equation (1). Thus, the irradiation regions adjacent in the main scanning direction MD are connected.

As described above, in the line head 29 according to the twelfth embodiment as well, the plurality of microlenses ML are arranged to face one chip CP. Therefore, it is possible to reduce time and cost required for assembling by suppressing the bonding number of the chips CP in the assembling of the line head 29.

Thirteenth Embodiment

Figure 39:
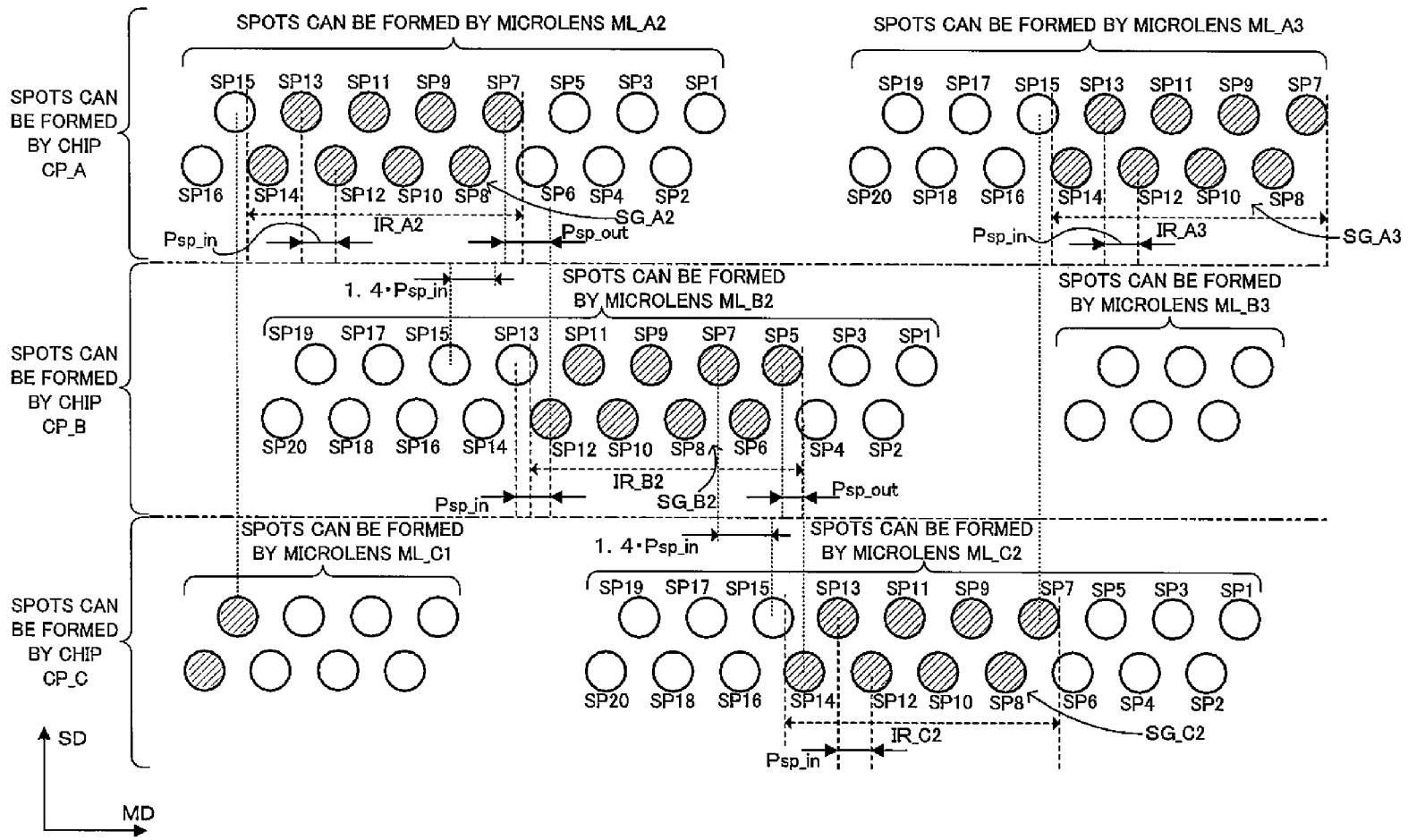
FIG. 39 is a diagram showing the positions of spots formed on a photosensitive member surface by a line head according to a thirteenth embodiment.

FIG. 39 is a diagram showing the positions of spots formed on a photosensitive member surface by a line head according to a thirteenth embodiment. In the following description on FIG. 39, differences from FIG. 35 are mainly described and common parts to FIG. 35 are not described by being identified by the suitable reference numerals. FIG. 39 corresponds to a case where the position of a chip CP_B deviates from the desired one in the longitudinal direction LGD, with the result that the positions of spots that can be formed by the chip CP_B are displaced toward the upstream side in the main scanning direction MD by 1.7-fold of the in-chip spot pitch Psp_in (that is, 1.7·Psp_in). By such a positional deviation of a chip, spots SP7, SP15 that can be respectively formed by a microlens ML_A2 and a microlens ML_B2 and have the same position in the main scanning direction MD in the absence of the positional deviation (FIG. 35) are displaced in the main scanning direction MD by 1.7-fold of the in-chip spot pitch Psp_in. Further, spots SP7, SP15 that can be respectively formed by a microlens ML_B2 and a microlens ML_C2 and have the same position in the main scanning direction MD in the absence of the positional deviation (FIG. 35) are displaced in the main scanning direction MD by 1.7-fold of the in-chip spot pitch Psp_in.

In FIG. 39, the chip CP_B does not form the spot SP14 formed in FIGS. 35, 36 to connect the irradiation region IR_B2 thereof with the irradiation region IR_A2 of the chip CP_A. Further, the chip CP_B does not form the spot SP13 formed in FIGS. 35 to 38, either. In other words, in order to connect the irradiation regions IR_A2, IR_B2, the light emission of the element set 2951SET is controlled so that the light emitting elements 2951 corresponding to these spots SP13, SP14 out of the plurality of light emitting elements 2951 belonging to the element set 2951SET of the chip CP_B are not turned on. In other words, in FIG. 39, the light emission of the light emitting elements of the element set 2951SET of the chip CP_B is controlled in accordance with the positional deviation of the chip CP_B. Thus, regardless of a positional deviation of the chip CP_B, the irradiation regions IR_A2, IR_B2 adjacent in the main scanning direction MD are connected.

Further, in FIG. 39, the chip CP_B forms the spot SP6 that is not formed in FIGS. 35 and 36 to connect the irradiation region IR_B2 thereof with the irradiation region IR_C2 of the chip CP_C. Furthermore, the chip CP_B also forms the spot SP5 that is not formed in FIGS. 35 to 38. In other words, in order to connect the irradiation regions IR_B2, IR_C2, the light emission of the element set 2951SET is controlled so that the light emitting elements 2951 corresponding to these spots SP5, SP6 out of the plurality of light emitting elements 2951 belonging to the element set 2951SET of the chip CP_B are turned on. That is, in FIG. 39, the light emission of the light emitting elements of the element set 2951SET of the chip CP_B is controlled in accordance with the positional deviation of the chip CP_B. Thus, despite the positional deviation of the chip CP_B, the irradiation regions IR_B2, IR_C2 adjacent in the main scanning direction MD are connected.

Further, in FIG. 39, the out-chip spot pitch Psp_out between the irradiation regions IR_A2, IR_B2 is 1.3-fold of the in-chip spot pitch Psp_in (that is, Psp_out=1.3·Psp_in). Further, the out-chip spot pitch Psp_out between the irradiation regions IR_B2, IR_C2 is 0.7-fold of the in-chip spot pitch Psp_in (that is, Psp_out=0.7·Psp_in). In this way, the light emission of the light emitting elements of the element set 2951SET is controlled such that both the out-chip spot pitch Psp_out between the irradiation regions IR_A2, IR_B2 and the out-chip spot pitch Psp_out between the irradiation regions IR_B2, IR_C2 satisfy the condition of the above Equation (1). Thus, the irradiation regions adjacent in the main scanning direction MD are connected.

As described above, in the line head 29 according to the thirteenth embodiment as well, the plurality of microlenses ML are arranged to face one chip CP. Therefore, it is possible to reduce time and cost required for assembling by suppressing the bonding number of the chips CP in the assembling of the line head 29.

Miscellaneous

As described above, in the above embodiments, the longitudinal direction LGD and the main scanning direction MD correspond to a "second direction" of the invention; the width direction LTD and the sub scanning direction SD correspond to a "first direction" of the invention; the chips CP correspond to "first substrates" of the invention; the head substrate 293 corresponds to a "second substrate" of the invention; the microlens array 299 corresponds to an "optical system" of the invention; the photosensitive drum 21 corresponds to a "latent image carrier" of the invention; and the surface of the photosensitive drum 21 corresponds to an "image plane" of the invention.

The invention is not limited to the above embodiments, and various other changes can be made without departing from the gist of the invention. For example, each chip CP in the above embodiments is a so-called LED array including a plurality of LEDs (light emitting diodes) as the light emitting elements 2951, but the chip CP is not limited to this. Specifically, chips CP including surface emitting lasers called VCSELs (vertical cavity surface emitting lasers) may be used. A two-dimensional surface emitting laser array disclosed in JP-A-2001-358411 is, for example, known as a chip including such surface emitting lasers. Since such surface emitting laser diodes also have relatively high luminance, good exposure is possible.

In the above embodiments, three microlenses ML face one chip CP. However, the number of the microlenses ML arranged to face one chip CP is not limited to three. In short, the number of the microlenses ML is sufficient to be two or larger. In other words, it is sufficient to form a plurality of spot groups SG with one chip CP.

Although the exposure regions corresponding to the same chip CP are adjacent to each other in the second and third embodiments, such a construction is not essential to the invention. However, the construction in which the exposure regions corresponding to the same chip CP are adjacent to each other is preferable in the following point. Clearances or vertical lines as described above may be possibly formed due to the deviations of the chips CP from the desired positions on the head substrate. Specifically, in the case of considering two chips CP capable of exposing exposure regions adjacent to each other, a clearance may be possibly formed between the exposure regions that can be exposed by these two chips CP if a relative relationship of the two chips CP on the head substrate deviates. In other words, clearances may be possibly formed between adjacent exposure regions that can be exposed by mutually different chips due to the positional deviations of the chips CP. Accordingly, in light of eliminating the cause of forming the clearances, it is preferable that the adjacent exposure regions can be exposed by the same chips CP as much as possible. Thus, the line head 29 may be constructed such that the exposure regions corresponding to the same chip CP are adjacent to each other.

Although the absolute value of the magnification of the microlenses ML is larger than 1 in the above embodiments, the magnification of the microlenses ML is not limited to this. However, in the line head 29 in which the absolute value of the magnification of the microlenses ML is larger than 1, even if the relative positions of the microlens ML and the chip CP only slightly deviate, such a positional deviation leads to a magnified deviation of the exposure region on the photosensitive member surface. Accordingly, the problem of the above clearances is likely to occur in the line head 29 including such microlenses ML. Therefore, such a line head 29 is particularly preferably constructed such that the exposure regions mutually adjacent to each other partly overlap to form the overlapping exposure regions EX_OR.

In the above embodiments, two light emitting element rows 2951R, in each of which four or five light emitting elements 2951 are aligned at the specified pitches in the longitudinal direction LGD, are arranged in the width direction LTD. However, the configuration and arrangement mode (that is, arrangement mode of the plurality of light emitting elements) of the light emitting element rows 2951R are not limited to this. In short, it is sufficient that the plurality of light emitting elements 2951 are arranged at mutually different positions in the longitudinal direction LGD.

In the above embodiments, the light emitting element group column 295C is comprised of two or three light emitting element groups 295. However, the number of the light emitting element groups 295 constituting the light emitting element group column 295C is not limited to these and is sufficient to be two or larger.

Although the invention is applied to the color image forming apparatus in the above embodiments, the application thereof is not limited to this and the invention is also applicable to monochromatic image forming apparatuses which form monochromatic images.

As described above, a line head according to an embodiment comprises first substrates each formed with a plurality of light emitting elements for emitting light beams, a second substrate to which a plurality of first substrates are bonded, and an optical system including a plurality of lenses facing one first substrate, wherein the lenses focus light beams emitted from the light emitting elements toward an image plane.

Further, an image forming apparatus according to an embodiment comprises a latent image carrier with a surface to be exposed to light to have a latent image formed in the exposed part, and a line head including first substrates each formed with a plurality of light emitting elements for emitting light beams, a second substrate to which a plurality of first substrates are bonded and an optical system including a plurality of lenses facing one first substrate, wherein the lenses focus light beams emitted from the light emitting elements toward the latent image carrier surface.

The embodiments (line head and image forming apparatus) constructed as above comprise the first substrates each formed with the plurality of light emitting elements for emitting light beams, the second substrate to which the plurality of first substrates are bonded, and the optical system including the plurality of lenses facing one first substrate. The lenses focus the light beams emitted from the light emitting elements toward the latent image carrier surface (image plane). In this way, a plurality of lenses are arranged to face each first substrate in the embodiments. Accordingly, the number of the first substrates required by the embodiments is smaller as compared with the case where one lens is arranged to face each first substrate. This is because the line head, in which one lens is arranged to face each first substrate, requires as many first substrates as the lenses, but the plurality of lenses are arranged to face each first substrate and the number of the necessary first substrates is suppressed to substantially half or smaller than the number of the lenses in the embodiments. Therefore, in the embodiments, it is possible to reduce time and cost required for assembling by suppressing the bonding number of the first substrates in the assembling of the line head.

Further, the construction of the optical system may be that, a plurality of lens rows, in each of which a plurality of lenses are aligned in a second direction orthogonal to a first direction, are arranged in the first direction. With such a construction, the diameter of the lenses can be relatively easily increased since the plurality of lenses are two-dimensionally arranged. As a result, more light can be introduced to the lenses, thereby enabling good exposure.

In the first substrates, it may be constructed that light emitting element groups as groups of a plurality of light emitting elements may be arranged at facing positions that the lenses are facing. With such a construction, the light emitting element groups are arranged in accordance with the respective lenses and lights from the light emitting element groups are imaged by the corresponding lenses. Since the lights can be imaged with relatively less aberration, good exposure is possible.

In the first substrates, a plurality of light emitting element groups may be arranged in the second direction. With such a construction, the light emitting element groups arranged in the second direction are provided on the same first substrates. Accordingly, these light emitting element groups can be arranged in the second direction with high positional accuracy, thereby enabling good exposure.

In the first substrates, a plurality of light emitting element groups may be arranged at mutually different positions in the first direction. With such a construction, the light emitting element groups arranged at the mutually different positions in the first direction are provided on the same first substrates. Accordingly, these light emitting element groups can be arranged at the mutually different positions in the first direction with high positional accuracy, thereby enabling good exposure.

In the light emitting element groups, a plurality of light emitting elements may be aligned in the second direction to form a light emitting element row. This is because the light emitting element group can be easily formed by aligning the plurality of light emitting elements in the second direction. Further, in the light emitting element groups, a plurality of light emitting element rows may be arranged at mutually different positions in the first direction. This is because the light emitting element group, in which the light emitting elements are two-dimensionally arranged, can be easily formed.

The light emitting elements may be LEDs. Further, the first substrates may be LED array chips formed with LEDs. This is because good exposure is possible since the LEDs have relatively high luminance.

The light emitting elements may be surface emitting laser diodes. Further, the first substrates may be two-dimensional surface emitting laser arrays formed with surface emitting laser diodes. This is because good exposure is possible since the surface emitting laser diodes have relatively high luminance.

Further, when the first substrates are so constructed as to be able to expose corresponding exposure regions of the latent image carrier surface by causing light beams to be emitted from the light emitting elements at facing positions, the exposure regions adjacent to each other may partly overlap to form overlapping exposure regions for the following reason.

In the line head of the embodiment, the plurality of first substrates are bonded to the second substrate. The respective first substrates can expose the corresponding exposure regions of the image plane by causing light beams to be emitted via the lenses from the light emitting elements at the facing positions facing the lenses. Since the plurality of lenses are arranged to face each first substrate, one first substrate can expose a plurality of exposure regions.

However, there are cases where the characteristics of the lenses deviate from the desired ones. Specifically, when, for example, the lens is deviated from the desired position (positional deviation occurs), the positional relationship of the lens and the first substrate facing the lens also deviates from the desired one. Due to such a positional deviation, the exposure region that can be exposed by the first substrate also deviates from the desired position (positional deviation occurs). As a result, a clearance may possibly be formed between the displaced exposure region and an exposure region adjacent to this displaced exposure region. Particularly, in an image forming apparatus for forming a latent image on a latent image carrier surface using a line head having such a problem, there have been cases where latent images could not be satisfactorily formed.

Accordingly, the line head is preferably constructed such that exposure regions adjacent to each other partly overlap to form overlapping exposure regions. This is because, with such a construction, the formation of clearances between the adjacent exposure regions can be suppressed even if the characteristics of the lenses slightly deviate.

Further, when the lenses focus light beams emitted from the light emitting elements at the facing positions toward the image plane moving in the first direction and each of the plurality of first substrates causes the light beams to be emitted from the light emitting elements at the facing positions at timings in conformity with a movement of the image plane, it is preferable to construct such that exposure regions adjacent in the second direction orthogonal to the first direction partly overlap in the second direction to form overlapping exposure regions.

With such a construction, each of the plurality of first substrates causes the light beams to be emitted from the light emitting elements at the facing position at the timings in conformity with the movement of the latent image carrier surface. The line head can expose the exposure regions by focusing the light beams emitted from the facing positions by the lenses facing the facing positions. Since the exposure regions adjacent in the first direction can be exposed by the same lenses in such a line head, there are almost no positional deviations between the exposure regions adjacent in the first direction. However, in the second direction orthogonal to the first direction, the adjacent exposure regions are exposed by mutually different lenses. Thus, if the embodiment is not applied, clearances may be possibly formed between the exposure regions adjacent in the second direction due to the characteristic deviations of the lenses In such a situation where the clearances are formed in the second direction, such clearances may be possibly connected one after another in the first direction to induce so-called vertical lines if an exposure operation is performed while the image plane is moved in the first direction.

On the contrary, in the above construction, the exposure regions adjacent in the second direction orthogonal to the first direction partly overlap to form the overlapping exposure regions. Therefore, the formation of clearances between the exposure regions adjacent in the second direction is suppressed, with the result that the formation of vertical lines can be suppressed.

Clearances or vertical lines as described above may be possibly formed due to the deviations of the first substrates from the desired positions on the second substrate. Specifically, in the case of considering two first substrates that can expose exposure regions adjacent to each other, a clearance may be possibly formed between the exposure regions that can be exposed by these two first substrates, when the relative relationship between the two first substrates deviates on the second substrate. In other words, clearances may be possibly formed between adjacent exposure regions that can be exposed by mutually different first substrates due to the positional deviations of the first substrates. Accordingly, in light of eliminating the cause of forming the clearances, it is preferable that the adjacent exposure regions can be exposed by the same first substrates as much as possible. Hence, the exposure regions corresponding to the same first substrates may be adjacent to each other.

The application of the above embodiment is particularly preferable when the absolute value of the magnification of the lenses is larger than 1. Specifically, when the absolute value of the magnification of the lenses is larger than 1, even a slight deviation of the relative positions of the lens and the first substrate leads to a magnified deviation of the exposure region on the latent image carrier surface. Thus, in a construction including such lenses, the problem of the above clearances is likely to occur. Therefore, it is particularly preferable that the exposure regions adjacent to each other partly overlap to form the overlapping exposure regions as in the above embodiment.

In the above construction having the overlapping exposure regions, there are cases where the formation of the above clearances can be suppressed even if light beams are not emitted from all the light emitting elements formed on the first substrates, that is, even if all the light emitting elements do not contribute to the exposure operation. Accordingly, light emitting elements may be selected from the plurality of light emitting elements that can expose the overlapping exposure regions and the exposure operation may be performed for the overlapping exposure regions by causing light beams to be emitted only from the selected light emitting elements upon exposing the overlapping exposure regions.

EXAMPLE

Next, an example of the invention is illustrated. The invention is not restricted by the following example and can be, of course, embodied while being suitably modified without departing from the gist described above and below, and any of such modifications is included in the technical scope of the invention.

Figure 40:
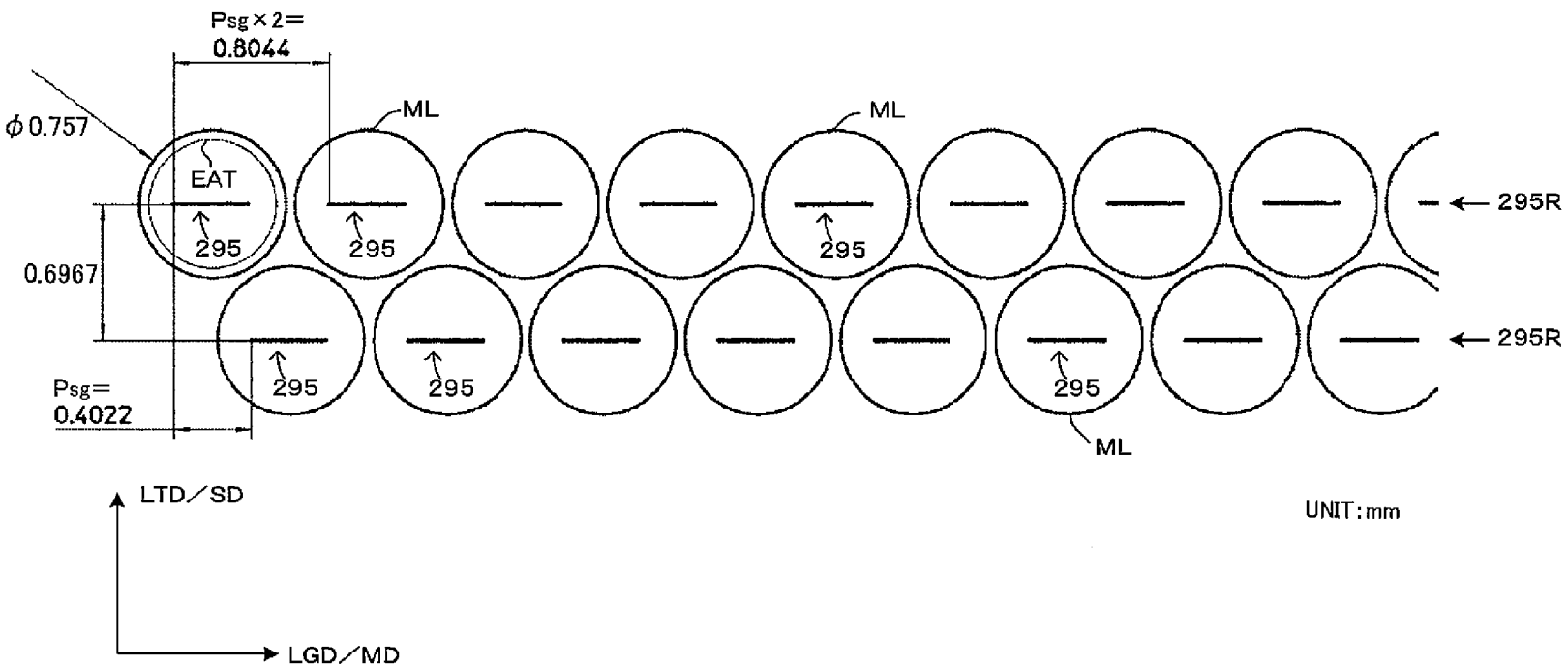
FIGS. 40 and 41 are diagrams showing a relationship between light emitting element groups and microlenses in this example.
Figure 41:
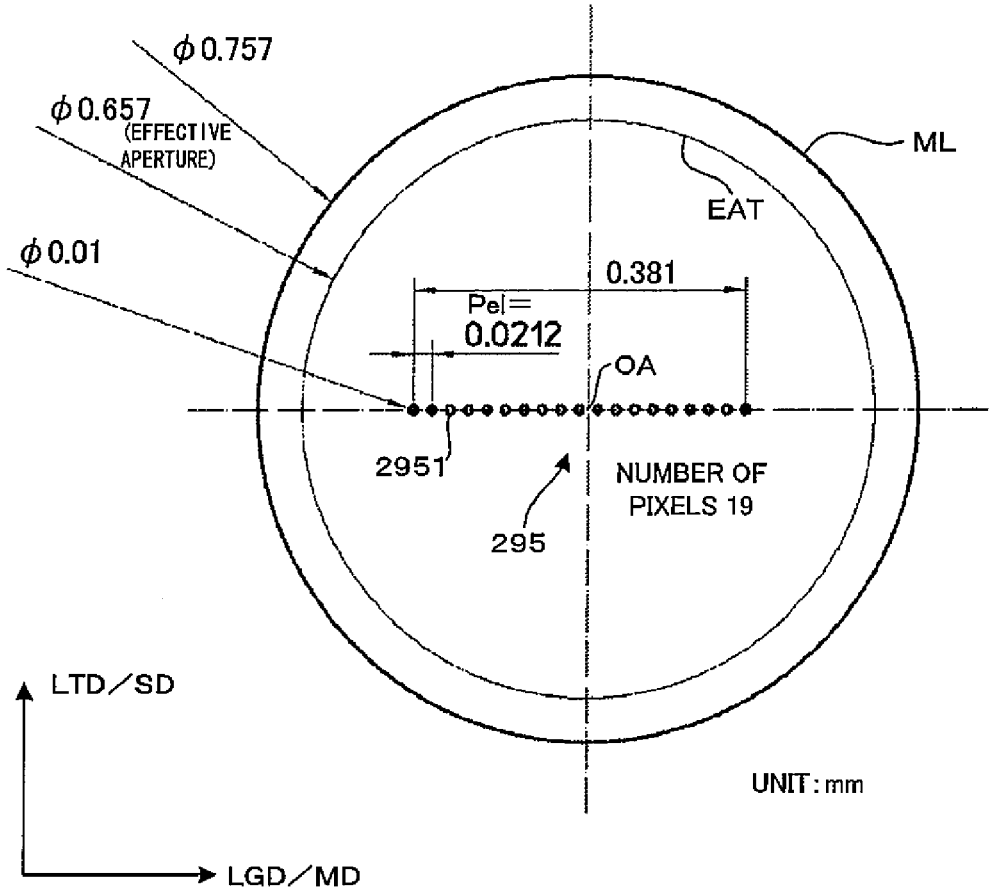

In this example, an exemplary construction of microlenses ML applicable to the invention is described. FIGS. 40 and 41 are diagrams showing a relationship between light emitting element groups and microlenses in this example. A plurality of light emitting element groups 295 are aligned at pitches, which are twice the light emitting element group pitch Psg (=Psg×2=0.8044 mm), in the longitudinal direction LGD to form one light emitting element group row 295R. Two light emitting element group rows 295R are arranged at the light emitting element group row pitch Psgr (=0.6967 mm) in the width direction LTD. Further, the respective light emitting element group rows 295R are displaced from each other by the light emitting element group pitch Psg (0.4022 mm) in the longitudinal direction LGD. In this way, the respective light emitting element groups 295 are arranged at mutually different positions in the longitudinal direction LGD.

In each light emitting element group 295, nineteen light emitting elements 2951 are aligned at light emitting element pitches Pel (=0.0212 mm) in the longitudinal direction LGD, and the width of the light emitting element group 295 in the longitudinal direction LGD is 0.381 mm. The diameter of the respective light emitting elements 2951 is 0.01 mm.

The microlenses ML are arranged to face the respective light emitting element groups 295 and image light beams from the light emitting element groups 295 that the microlenses ML are facing. The microlenses ML have a diameter of 0.757 mm and an effective aperture of 0.657 mm. In FIGS. 40 and 41, the diameter of a circle identified by reference numeral EAT is the effective aperture.

Figure 42:
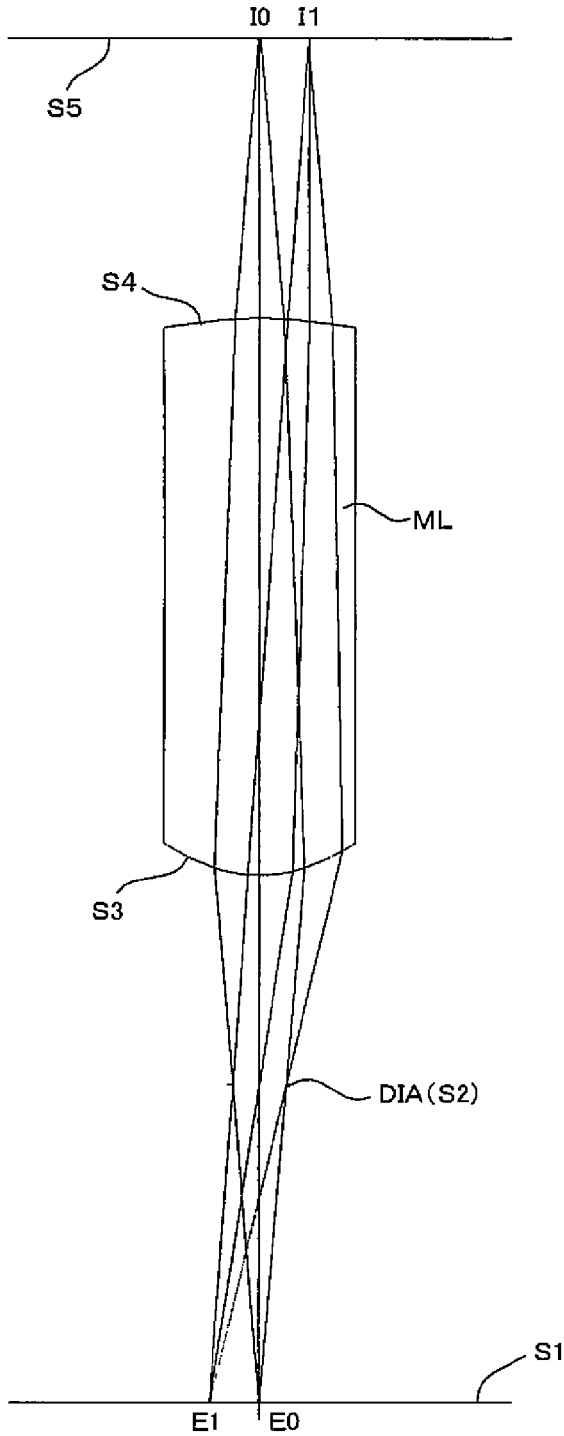
FIG. 42 is a lens sectional view showing the construction of the microlens in this example.

FIG. 42 is a lens sectional view showing the construction of the microlens in this example. As shown in FIG. 42, the microlens ML has an incident surface (surface number S3) and an emergent surface (surface number S4) and both the incident and emergent surfaces have finite curvatures. An aperture diaphragm DIA (surface number S3) is disposed substantially at a front focus position to telecentrically construct an image side. In FIG. 42 are shown a beam emitted from an object point E0 on an optical axis OA and imaged at an image point 10 on the optical axis OA and a beam emitted from an object point E1 and imaged at an image point I1. As can be understood from these beam diagrams, light beams from the light emitting elements 2951 are imaged in an inverted manner.

FIGS. 43A to 43D show lens data of the microlenses in the example. FIG. 43A shows various optical data such as wavelength λ of light beams, lens diameter D of the microlenses ML, aperture diameter Da of the aperture diaphragm DIA, optical magnification β and maximum angle of view ω. FIG. 43B shows lens data in the example. As shown by the surface numbers S3, S4 of FIG. 43B, both incident and emergent surfaces of the microlenses ML have aspherical shapes. FIG. 43C shows the aspherical coefficients of the incident and emergent surfaces. The surface shapes of the incident and emergent surfaces are given by the coefficients of FIG. 43C and an aspherical surface definitional equation written in FIG. 43D.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A line head, comprising:

a head substrate;

a first chip that includes light emitting elements and is on the head substrate;

a second chip that includes light emitting elements, is on the head substrate and is arranged in a first direction to the first chip, the first direction being on the head substrate;

a third chip that includes light emitting elements, is on the head substrate and is arranged in a second direction to the first chip, the second direction being on the head substrate and orthogonal or substantially orthogonal to the first direction;

a lens array that has lenses facing the first chip, lenses facing the second chip, and lenses facing the third chip; and a light shielding member that is arranged between the head substrate and the lens array, wherein the lenses facing the first chip are arranged in the second direction, have an inverting property, and image a light emitted from light emitting elements of the first chip, the lenses facing the second chip are arranged in the second direction, have an inverting property, and image a light emitted from light emitting elements of the second chip, the lenses facing the third chip are arranged in the second direction, have an inverting property, and image a light emitted from light emitting elements of the third chip, the light emitting elements are arranged at facing positions to which the lenses face, and form light emitting element groups, the light shielding member is formed with light guiding holes that are in correspondence with the light emitting element groups, light emitted from the light emitting element groups passes through the light guiding holes and is imaged by the lenses, the light shielding member prevents interference of light between two light emitting element groups of the first chip and the second chip arranged in the first direction, and the light shielding member prevents interference of light between two light emitting element groups of the first chip and the third chip arranged in the second direction.

2. The line head according to claim 1, wherein the light emitting elements are aligned in the second direction to form a light emitting element row in the light emitting element group.

3. The line head according to claim 2, wherein light emitting element rows are arranged at mutually different positions in the first direction in the light emitting element group.

4. The line head according to claim 1, wherein the first chip, the second chip and the third chip are structured to expose corresponding exposure regions of an image plane by causing lights to be emitted from the light emitting elements at the facing positions, and the exposure regions adjacent to each other partly overlap and form overlapping exposure regions.

5. The line head according to claim 1, wherein the light emitting elements are LEDs.

6. The line head according to claim 5, wherein the first chip, the second chip and the third chip are LED array chips that include the LEDs.

7. The line head according to claim 1, wherein the light emitting elements are surface emitting laser diodes.

8. The line head according to claim 1, wherein the absolute value of magnification of the lenses is larger than one.

9. The line head according to claim 1, wherein the light guiding holes are in the form of cylindrical holes.

10. An image forming apparatus, comprising:

a latent image carrier on a surface of which a latent image is formed in an exposed part when the surface is exposed with a light; and a line head that includes:

a head substrate;

a first chip that includes light emitting elements and is on the head substrate;

a second chip that includes light emitting elements, is on the head substrate and is arranged in a first direction to the first chip, the first direction being on the head substrate;

a third chip that includes light emitting elements, is on the head substrate and is arranged in a second direction to the first chip, the second direction being on the head substrate and orthogonal or substantially orthogonal to the first direction;

a lens array that has lenses facing the first chip, lenses facing the second chip, and lenses facing the third chip; and a light shielding member that is arranged between the head substrate and the lens array, wherein the lenses facing the first chip are arranged in the second direction, have an inverting property, and image a light emitted from light emitting elements of the first chip to the surface of the latent image carrier, the lenses facing the second chip are arranged in the second direction, have an inverting property, and image a light emitted from light emitting elements of the second chip to the surface of the latent image carrier, the lenses facing the third chip are arranged in the second direction, have an inverting property, and image a light emitted from light emitting elements of the third chip to the surface of the latent image carrier, the light emitting elements are arranged at facing positions to which the lenses face, and form light emitting element groups, the light shielding member is formed with light guiding holes that are in correspondence with the light emitting element groups, light emitted from the light emitting element groups passes through the light guiding holes and is imaged by the lenses, the light shielding member prevents interference of light between two light emitting element groups of the first chip and the second chip arranged in the first direction, and the light shielding member prevents interference of light between two light emitting element groups of the first chip and the third chip arranged in the second direction.

11. The image forming apparatus according to claim 10, wherein a plurality of the light emitting elements are arranged at a facing positions to which the lenses face, the first chip, the second chip and the third chip are structured to expose corresponding exposure regions of the latent image carrier surface by causing light to be emitted from the light emitting elements at the facing positions, and the exposure regions adjacent to each other partly overlap and form overlapping exposure regions.

12. The image forming apparatus according to claim 11, wherein the lenses focus light emitted from the light emitting elements at the facing positions toward the latent image carrier surface which moves in a first direction, the light emitting elements at the facing position in the first chip, the second chip and the third chip emit light at timings in conformity with a movement of the latent image carrier, and the exposure regions adjacent in a second direction partly overlap in the second direction and form the overlapping exposure regions.

13. The image forming apparatus according to claim 11, wherein the absolute value of the magnification of the lenses is larger than 1.

* * * * *